US011443722B2

(12) United States Patent
Spangler et al.

(10) Patent No.: US 11,443,722 B2
(45) Date of Patent: Sep. 13, 2022

(54) FOLDABLE STRINGED INSTRUMENT

(71) Applicant: Ciari Guitars, Inc., San Diego, CA (US)

(72) Inventors: Jonathan D Spangler, San Diego, CA (US); James Coleman Lee, Carlsbad, CA (US); Matthew Poster, Madison, WI (US); Jesse Darley, Madison, WI (US); Elliot Sather, San Francisco, CA (US)

(73) Assignee: Ciari Guitars, Inc., San Diego, CA (US)

( * ) Notice: Subject to any disclaimer, the term of this patent is extended or adjusted under 35 U.S.C. 154(b) by 0 days.

(21) Appl. No.: 17/471,287

(22) Filed: Sep. 10, 2021

(65) Prior Publication Data

US 2021/0407468 A1 Dec. 30, 2021

Related U.S. Application Data

(63) Continuation of application No. 16/757,353, filed as application No. PCT/US2018/056802 on Oct. 19, 2018, now Pat. No. 11,120,776.

(Continued)

(51) Int. Cl.

*G10D 1/08* (2006.01)
*G10D 3/12* (2020.01)

(Continued)

(52) U.S. Cl.

CPC ..... *G10D 1/08* (2013.01); *G10D 3/06* (2013.01); *G10D 3/095* (2020.02); *G10D 3/12* (2013.01); *G10D 3/10* (2013.01); *G10D 3/14* (2013.01)

(58) Field of Classification Search

CPC ..... G10D 1/08; G10D 3/095; G10D 3/06; G10D 3/12; G10D 3/14

See application file for complete search history.

(56) References Cited

U.S. PATENT DOCUMENTS 519,409 A 5/1894 Middlebrooke
3,910,152 A 10/1975 Kusakawa (Continued)

FOREIGN PATENT DOCUMENTS

FR 2870380 11/2005
GB 2363508 12/2001

(Continued)

OTHER PUBLICATIONS

Eyal Fendell, "Foldable Electric Guitar" at p. 4 of 12 of "2010 Portfolio" at www.coroflot.com/eyalfendell/portfolio2010, Publication Date 2008, 12 pages, Israel.

(Continued)

*Primary Examiner* — Robert W Horn

(74) *Attorney, Agent, or Firm* — Jonathan Spangler; Jay Bell

(57) ABSTRACT

A foldable stringed instrument, for example in the form of a travel guitar that folds mid-neck to assume a reduced profile is described. The mid-neck folding is accomplished in a symmetrical manner about a three-part hinge located in the neck to configure the travel guitar into a reduced profile. The bridge assembly can be translated longitudinally relative to the head of the guitar to allow sufficient detensioning of the guitar strings to enable an upper portion of the neck to be folded away from a lower portion of the neck and/or body to assume a reduced profile. To deploy the travel guitar for playing, the upper portion of the neck is unfolded into alignment with the lower portion of the neck and/or body, and the bridge assembly translated longitudinally relative to (Continued)

the head and locked in position to allow the guitar to be tuned for playing.

20 Claims, 70 Drawing Sheets

Related U.S. Application Data

(60) Provisional application No. 62/574,746, filed on Oct. 19, 2017.

(51) Int. Cl.

| | |
|---|---|
| ***G10D 3/095*** | (2020.01) |
| ***G10D 3/06*** | (2020.01) |
| *G10D 3/10* | (2006.01) |
| *G10D 3/14* | (2020.01) |

(56) References Cited

U.S. PATENT DOCUMENTS

| | | | |
|---|---|---|---|
| 4,073,211 | A | 2/1978 | Jorgensen |
| 4,111,093 | A | 9/1978 | Field et al. |
| 4,191,085 | A | 3/1980 | Litwin |
| 4,254,683 | A | 3/1981 | Nulman |
| 4,332,184 | A | 6/1982 | Phillips |
| 4,385,543 | A | 5/1983 | Shaw et al. |
| 4,592,265 | A | 6/1986 | Steinberger |
| 4,638,708 | A | 1/1987 | Kamal |
| 4,686,882 | A | 8/1987 | Shaw |
| 4,939,970 | A | 7/1990 | Hoshino et al. |
| 5,233,896 | A | 8/1993 | Worthington et al. |
| 5,353,672 | A | 10/1994 | Stewart |
| 5,383,385 | A | 1/1995 | Gilbert |
| 5,390,578 | A | 2/1995 | Raymer |
| 5,728,956 | A | 3/1998 | Feiten et al. |
| 5,949,005 | A | 9/1999 | Peterson |
| 6,025,548 | A | 2/2000 | Ehrlich |
| 6,028,255 | A | 2/2000 | Myronyk |
| 6,353,164 | B1 | 3/2002 | Corsi |
| 6,791,022 | B2 | 9/2004 | Green |
| 6,833,501 | B2 | 12/2004 | Jagmin |
| 6,956,157 | B2 | 10/2005 | Strobel |
| D516,114 | S | 2/2006 | Leach |
| 7,179,975 | B2 | 2/2007 | Feiten et al. |
| 7,332,662 | B2 | 2/2008 | Kandrack et al. |
| 7,365,254 | B2 | 4/2008 | Johansson |
| 7,659,467 | B2 | 2/2010 | Adams |
| 7,696,419 | B2 | 4/2010 | Chadwick, V |
| 7,705,224 | B1 | 4/2010 | Ward |
| 7,712,608 | B2 | 5/2010 | Leach |
| 7,732,689 | B1 | 6/2010 | Jiang et al. |
| 7,754,950 | B2 | 7/2010 | Leach |
| 7,872,185 | B1 | 1/2011 | Chadwick |
| 8,119,892 | B2 | 2/2012 | Leach et al. |
| 8,183,446 | B1 | 5/2012 | Ward |
| 8,203,058 | B2 | 6/2012 | Leach |
| 8,273,974 | B1 | 9/2012 | Gonzalez |
| 8,288,637 | B2 | 10/2012 | Kingsley |
| 8,378,192 | B1 | 2/2013 | Harmon |
| 8,710,346 | B2 | 4/2014 | Behringer et al. |
| 9,424,818 | B1 | 8/2016 | Spangler et al. |
| 9,466,268 | B2 | 10/2016 | Knight |
| 9,514,719 | B1 | 12/2016 | Ward |
| 9,633,631 | B1 | 4/2017 | Lin et al. |
| 9,697,808 | B1 | 7/2017 | Sanzo et al. |
| 10,079,006 | B2 | 9/2018 | Brain |
| 10,540,946 | B2 | 1/2020 | Reddick |
| 10,810,974 | B2 * | 10/2020 | Spangler ..... G10D 3/18 |
| 11,120,776 | B2 * | 9/2021 | Spangler ..... G10D 3/12 |
| 11,268,310 | B1 * | 3/2022 | Spangler ..... E05D 3/06 |
| 2004/0182220 | A1 | 9/2004 | Strobel |
| 2004/0194606 | A1 | 10/2004 | Koeppe et al. |
| 2006/0144208 | A1 | 7/2006 | Kandrack et al. |
| 2007/0056429 | A1 | 3/2007 | Poschelk |
| 2007/0131082 | A1 | 6/2007 | Feiten et al. |
| 2007/0144328 | A1 | 6/2007 | Johansson |
| 2007/0289427 | A1 | 12/2007 | Liang |
| 2008/0141488 | A1 | 6/2008 | Leach |
| 2008/0156180 | A1 | 7/2008 | Bagale |
| 2009/0084243 | A1 | 4/2009 | Pyper-Scott |
| 2009/0100981 | A1 | 4/2009 | Chadwick, V |
| 2011/0308373 | A1 | 12/2011 | Leach et al. |
| 2013/0058507 | A1 | 3/2013 | Arkn s-Pedersen et al. |
| 2014/0260889 | A1 | 9/2014 | Anderson |
| 2016/0225351 | A1 | 8/2016 | Knight |
| 2018/0053491 | A1 | 2/2018 | Spangler et al. |
| 2018/0211639 | A1 | 7/2018 | Niiro |
| 2019/0295514 | A1 | 9/2019 | Spangler |
| 2021/0056939 | A1 | 2/2021 | Spangler |

FOREIGN PATENT DOCUMENTS

| | | | | |
|---|---|---|---|---|
| GB | 2419219 A | * | 4/2006 | ..... G10D 1/08 |
| GB | 2428862 | | 2/2007 | |
| WO | 2019079782 | | 4/2019 | |

OTHER PUBLICATIONS

Jason Heredia, "Arcus Collapsible Guitar" https://theawesomer.com/arcus-collapsible-guitar/11426/, Publication Date Jul. 30, 2008, 5 Pages, Location (City and/or Country) Unknown.

PCT International Search Report and Written Opinion of the International Searching Authority, PCT/US2018/056802, dated Jan. 4, 2019.

* cited by examiner

FOLDABLE STRINGED INSTRUMENT

CROSS REFERENCES TO RELATED APPLICATIONS

The present application is a continuation application claiming priority to U.S. application Ser. No. 16/757,353 (filed Apr. 17, 2020), which is a 371 international application claiming priority to PCT/US2018/056802 (filed Oct. 19, 2018), which claims priority to U.S. Provisional Patent App. Ser. No. 62/574,246 (filed Oct. 19, 2017), the entire contents of which are hereby expressly incorporated by reference into this disclosure as if set forth fully herein.

BACKGROUND OF THE INVENTION

I. Field of the Invention

The present invention relates generally to stringed musical instruments and, more particularly, to stringed musical instruments (such as a guitar) capable of being played anywhere, but configured to assume a reduced profile for ease of travel and/or compact storage.

II. Discussion of the Prior Art

Stringed instruments, such as guitars, have enjoyed among the highest popularity among musical instruments. Most stringed instruments have a solid neck rigidly coupled to either a hollow or solid body. This construction, while aiding in predictable tuning and quality of play, render many stringed instruments cumbersome for travel (e.g. air, train, auto, etc. . . . ), particularly given the additional bulk of the associated case (hard or soft). While various stringed instruments have been attempted to make it easier and/or more convenient to travel with or store these stringed instruments, most are simply smaller or scaled down versions of their traditional counterparts, which still present challenges for travel and/or predictable tuning and quality of play. The present invention is directed at overcoming, or at least improving upon, the disadvantages of the prior art.

SUMMARY OF THE INVENTION

The present invention accomplishes this goal by providing a foldable stringed instrument in the form (by way of example only) of a travel guitar that folds mid-neck to assume a reduced profile. While referred to hereinafter within the context of an electric travel guitar, it will be appreciated that the scope of the invention extends beyond guitars and may include, by way of example only, any of a variety of stringed instrument that would benefit from a reduced profile for ease of travel and/or storage (e.g. acoustic guitar, bass guitar, ukulele, etc. . . . ). According to one aspect, the travel guitar may be configured to house or receive or otherwise couple to a tablet computer (e.g. iPad by Apple, Inc.) and/or a smart phone (e.g. iPhone by Apple, Inc.) having one or more applications (apps) for driving the operation, functionality and/or effects associated with the travel guitar. According to one aspect, the mid-neck folding is accomplished in a symmetrical manner about a three-part hinge located in the neck to configure the travel guitar into a reduced profile.

In another aspect, the travel guitar may be configured such that a bridge assembly can be translated longitudinally relative to the head of the guitar to allow sufficient detensioning of the guitar strings to enable an upper portion of the neck to be folded away from a lower portion of the neck and/or body to assume a reduced profile. When it is desired to deploy the travel guitar for playing, the upper portion of the neck may be unfolded into alignment with the lower portion of the neck and/or body, and the bridge assembly translated longitudinally relative to the head and locked in position to allow the guitar to be tuned for playing. Translation or movement of the bridge assembly may be accomplished manually (e.g. through the use of a handle member or other manual actuation mechanism coupled to the bridge assembly) and/or through the use of servo motors (not shown) disposed with the guitar which, when actuated, will move the bridge assembly relative to the neck of the guitar to selectively tension and detension the strings. In either embodiment (manual or automated), the physical movement of the bridge assembly may be effectuated by coupling the bridge assembly to slidable rail(s) within the body and/or slidable plate(s) on the surface of the travel guitar.

In another aspect, the travel guitar may be configured with one or more translating truss rods or truss assemblies housed within at least a portion of the neck to bolster its strength and rigidity for more accurate and prolonged tuning and fret alignment. In one aspect, the translating truss rods are rigid, unitary structures capable of being translated longitudinally within one or more recesses or passageways formed in the upper neck portion and/or lower neck portion between a locked position and an unlocked position. In the locked position, each unitary truss rod is disposed at least partially within both the lower portion and upper portion of the neck, which locks the upper neck portion in alignment with the lower neck portion. In the unlocked position, each unitary truss rod is disposed within the lower neck portion and/or body portion, and removed from the upper neck portion, which unlocks the upper neck portion and thereby allows it to be folded into a reduced profile.

As set forth herein, each truss rod is of unitary, straight construction and may be translated with or independent of the translating bridge assembly. The translation of each truss rod may occur simultaneous with the translation of the bridge assembly, or slightly staggered in time. Staggering translation to assume a reduced profile first involves translating the bridge assembly relative to the neck of the guitar (e.g. away according to one aspect) in order to reduce the tension of the guitar strings, followed by translating each truss rod into the unlocked position such that the upper neck portion may be folded towards the lower neck portion. Staggering translation during deployment of the travel guitar first involves translating each truss rod into the locked position after the upper neck portion and lower neck portion have been brought into longitudinal alignment, followed by translating the bridge assembly relative to the neck of the guitar in order to increase the tension of the guitar strings in preparation for tuning.

Each truss rod may be constructed from a material having properties sufficient to bolster the strength and rigidity of the neck of the travel guitar, including but not limited to metal, carbon fiber, etc. . . . . Each truss rod may be manufactured having any number of solid cross-sectional shapes (e.g. circular, oval, triangular, etc. . . . ) and/or non-solid cross-sectional shapes (e.g. generally crescent-shaped, generally V-shaped, generally U-shaped, etc. . . . ). If configured having a non-solid cross-sectional shape, the "open" side of the truss rod may be disposed within the neck so as to face generally towards the underside of the neck (versus towards the fret board). This configuration will provide the greatest strength and rigidity for the strut to resist the tendency of the neck to bend under the tension of the guitar strings after they have been tuned.

In one aspect, a foldable stringed instrument is provided having a lower neck portion, an upper neck portion, a translating bridge assembly, and a translating truss assembly. The lower neck portion is moveably coupled to the upper neck portion. The lower and upper neck portions each include a fret board with a plurality of spaced apart frets disposed along at least port of the upper surface. Each neck portion also includes at least one elongated recess dimensioned to be in linear alignment when the lower and upper neck portions are in linear alignment. The translating bridge assembly is configured with a translating tail piece to be selectively moved in a linear manner relative to the lower and upper neck portions. The translating tail piece of the translating bridge assembly is configured to secure a first end of a set of musical strings that extend over the first and second neck portions.

Linear movement of the translating tail piece of the translating bridge assembly in a first direction relative to the lower and upper neck portions increases tension applied to the musical strings to create a tensioned string state. Linear movement of the translating tail piece of the translating bridge assembly in a second direction relative to the lower and upper neck portions decreases tension applied to the musical strings to create a detensioned string state. The translating truss assembly is dimensioned to be selectively moved in a linear manner within the recesses of the first and second neck portions when the first and second neck portions are in linear alignment. The translating truss assembly is capable of being linearly moved in a first direction when the musical strings are in the detensioned state in order to unlock the neck hinge assembly such that said lower and upper neck portions can be folded relative to one another about the neck hinge. The translating truss assembly is also capable of being linearly moved in a second direction when the strings are in said detensioned state in order to align and lock the neck hinge to maintain the lower and upper neck portions in linear alignment.

In another aspect, the first direction of the translating tail piece of the translating bridge assembly is linearly away from the lower and upper neck portions and the second direction of the translating tail piece of the translating bridge assembly is linearly towards the lower and upper neck portions.

In another aspect, the first direction of the translating truss assembly is linearly away from the lower and upper neck portions and the second direction of the translating truss assembly is linearly towards the lower and upper neck portions.

In another aspect, the lower and upper neck portions are moveably coupled such that the lower and upper neck portions maybe folded relative to one another such that the surface of the fret board of the lower neck portion is facing generally away from the surface of the fret board of the upper neck portion.

In one aspect, the strings may be configured to have modest tension (e.g. 1-5 pounds of force) after the translating bridge assembly has been actuated to detension the strings. In this manner, the strings will automatically "follow the fold" when the neck hinge assembly is in the folded configuration and avoid any vertical and/or lateral translation that would cause the strings to disengage from the neck.

In one aspect, one or more supplemental string barriers may be used to further ward against the strings moving vertically and/or laterally while in the detensioned state and becoming disengaged from the neck. The supplemental string barriers will preferably have sufficient clearance relative to the fret board (e.g. ¼ inch above the frets) such that the strings are not clamped or otherwise constricted during the folding and unfolding process, but rather are merely constrained vertically and/or laterally to prevent disengagement from the neck. In one aspect, the supplemental string barriers may be magnetically coupled to the neck adjacent to the neck hinge for ease of placement and removal. For example, the supplemental string barriers may have magnets disposed therein which can couple to magnets or magnetically-attractive materials (e.g. steel) located in the neck adjacent to the neck hinge (or vice versa).

In another aspect, the foldable stringed instrument includes at least one on-board electrical component and at least one electrical connector to establish electrical communication between the at least one on-board electrical component and at least one external component.

In another aspect, the foldable stringed instrument includes a body coupled to the lower neck portion, the body including a handle member coupled to the translating truss assembly and translating bridge assembly. In one embodiment, the handle provides mechanical leverage and purchase point(s) for the user to easily actuate the translating bridge assembly and translating truss assembly so as to linearly move the floating tail piece of the translating bridge assembly and the translating truss elements in the first direction and the second direction. In one aspect, the actuation is staggered such that the strings are detensioned before the translating truss elements are removed from the neck hinge to transition from the playing position to the folded position, and conversely the translating truss elements are engaged into the neck hinge assembly before the translating tail piece of the translating bridge assembly is returned to the fully tuned state for playing.

In another aspect, the foldable stringed instrument includes a body coupled to the lower neck portion, wherein the body includes at least one recess dimensioned to receive aspects of at least one of the translating bridge assembly, the translating truss assembly, supplemental string barriers for use in string containment during the folding and unfolding process, and a handle for selectively actuating the translating bridge assembly and translating truss assembly to transition the stringed instrument between the playing position and folded position.

BRIEF DESCRIPTION OF THE DRAWINGS

Many advantages of the present invention will be apparent to those skilled in the art with a reading of this specification in conjunction with the attached drawings, wherein like reference numerals are applied to like elements and wherein.

DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure. The travel guitar disclosed herein boasts a variety of inventive features and components that warrant patent protection, both individually and in combination.

Figure 1:
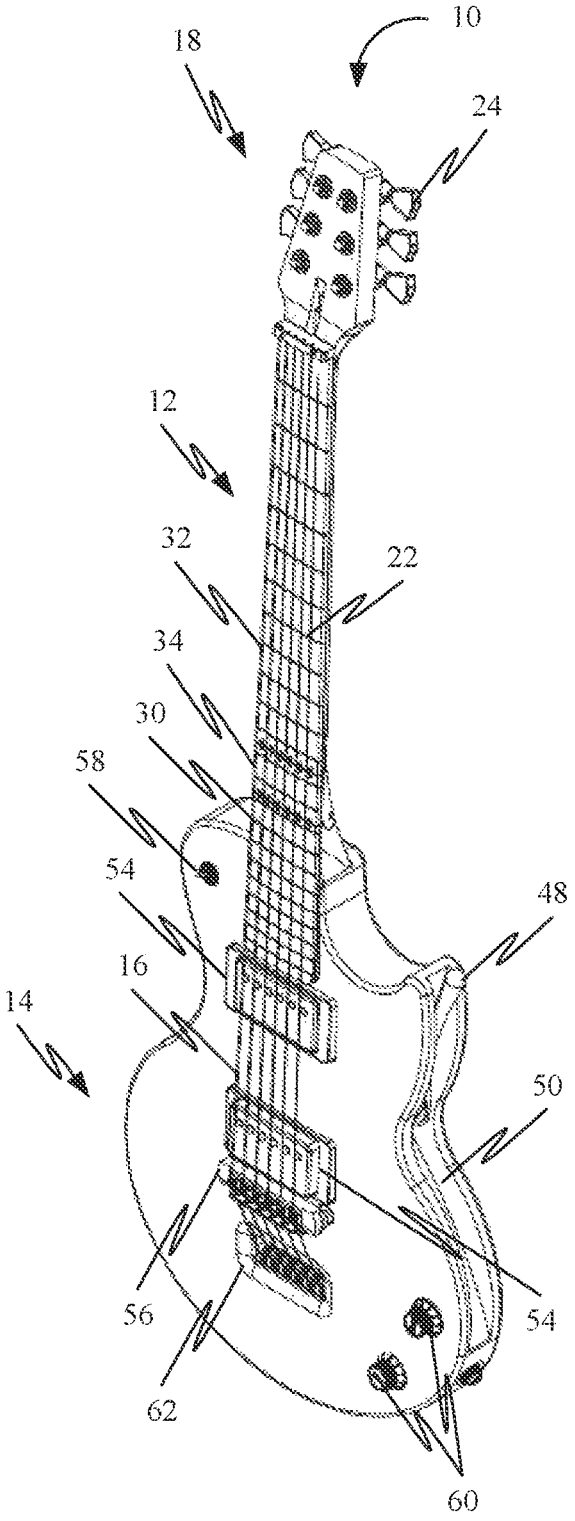
FIGS. 1-2 are perspective views of a foldable electric guitar in the playing position and folded position, respectively, according to an aspect of the present invention.
Figure 2:
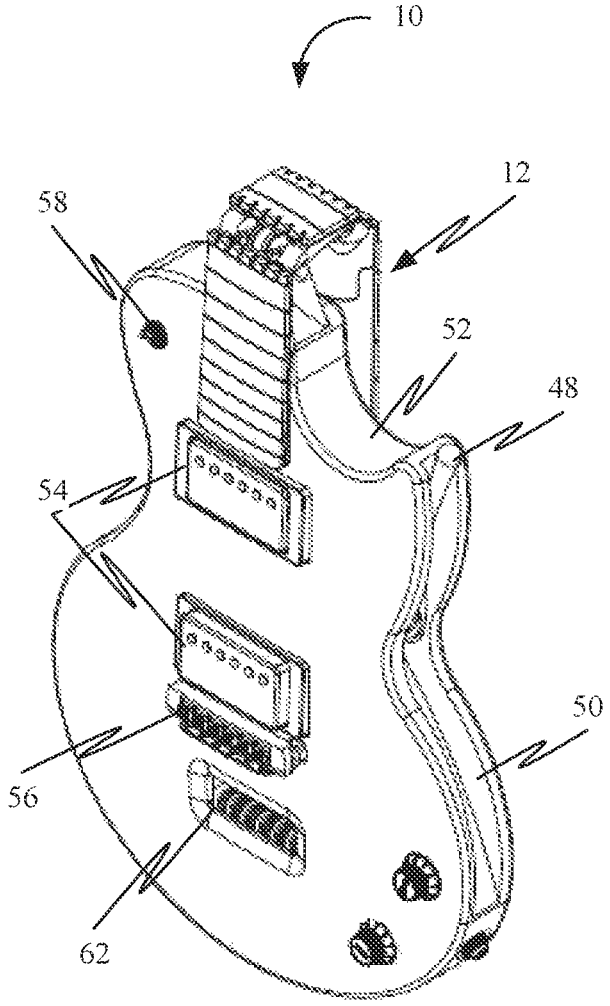

FIGS. 1-10 illustrate a foldable electric guitar 10 according to one aspect in both the straight, playing configuration (FIG. 1) and folded, travel configuration (FIG. 2). The electric guitar 10 includes a neck 12 and a body 14 with a plurality of guitar strings 16 extending between a head 18 coupled to or forming part of the neck 12 and a translating bridge assembly 20 coupled to or forming part of the body 14. The neck 12 includes a lower neck portion 30, an upper neck portion 32 and a middle neck portion 34 with respective fretboard sections having a plurality of frets 22 which, in use, allow a player of the guitar 10 to create any of a variety of musical notes by depressing the various strings 16 between the various frets 22 as known in the art. The neck 12 also includes a hinge assembly 36 including a hinge base 38, a middle hinge 40 and an upper hinge 42 (see FIG. 4). The head 18 includes a number of tuning machines 24 to allow the strings 16 to be tuned as known in the art, as well as a nut 44 having an string-capturing feature as will be described below.

The translating bridge assembly 20 enables a user to selectively tension and detension the strings 16, while a translating truss assembly 46 enables the user to selectively lock and unlock the hinge assembly 36. More specifically, the translating truss assembly 46 cooperates with the neck portions 30, 32, 34 in order to selectively lock and bolster the structural integrity of the hinge assembly 36 while in the playing, straight position shown in FIGS. 3-5, as well as selectively unlock the hinge assembly 36 to enable the neck regions 30, 32, 34 to allow the guitar 10 to transition into the folded, travel configuration shown in FIGS. 6-10 for convenient storage and travel.

In one aspect, the translating bridge assembly 20 and translating truss assembly 46 are coupled together and also with a rotatable handle 48 such that a guitar player can simply and easily rotate the handle 48 disposed along an edge of the body 14 in order to actuate the translating bridge assembly 20 and translating truss assembly 46 according to the principles of the present invention. The handle 48 is shown in FIG. 1 nested within a recess 50 formed along the lower periphery of the body 14 (e.g. in the lower lobe of the body 14 while in the playing configuration of FIGS. 3-5 and in the upper lobe of the body 14 adjacent to the cut-away 52 while in the folded configuration of FIGS. 6-10). The cut-away 52 is a void created by removing part of the body 14 adjacent to the lower portion 30 of the neck 12 in order to functionally allow the player to access the upper frets 22 to play any of the range of higher notes (e.g. for playing leads vs. rhythm).

The body 14 may include any number of suitable features, including but not limited to one or more pick-ups 54 for converting the vibrations of the strings 16 into electrical signals to be transmitted to an amplification source (e.g. amplifier, headphones, smart phone speaker, etc. . . . ), an adjustable-height bridge 56 for selectively raising and lowering the height of the strings 16 relative to the neck 12 and body 14, a selector switch 58 for activating one or both of the pick-ups 54, and one or more controllers 60 for controlling aspects of the electrical signals (e.g. tone and volume). The body 14 also includes an aperture 62 dimensioned to allow the strings 16 to pass from the top of the guitar 10 (after passing over the adjustable bridge 56) in order to be coupled to the translating bridge assembly 20, which resides in a recess 64 formed along the back of the body 14. Although not shown, the body 14 or other aspects of the guitar 10 may be equipped with any of a variety of on-board electronics (e.g. tuners, synthesizers, pick-ups, batteries, AC/DC power, input jacks for amplifiers, etc. . . . ) and may also include the capability to connect to and/or receive a smart phone and/or a computer tablet (not shown) having one or more applications (apps) for driving the operation, functionality and/or effects associated with the travel guitar 10.

The electric guitar 10 may be dimensioned to have a folded footprint in the range of 16-19 inches in length, 2-4 inches in height, and a width ranging from 10-14 inches, but these ranges are set forth by way of example only. The guitar 10 is preferably dimensioned such that, when folded, it can fit into a briefcase, back-pack, carry-on luggage (for air travel), etc. . . . . It is contemplated that the guitar 10 will come with a protective shell or container with form-fitted and padded recesses to safely carry the guitar 10 while in the folded configuration. The form-fitting protective shell or container may be dimensioned to fit within any number of other bags or luggage (e.g. briefcase, back-pack, carry-on luggage (for air travel), etc. . . . ). In this manner, the guitar 10 may be toted during travel in whatever luggage or baggage the user would ordinarily or already be using (e.g. briefcase, back-pack, carry-on luggage) as opposed to forcing them to take another article of luggage or baggage which may prompt needing to check a bag during air travel. This effectively reduces the risk of damage to the guitar that accompanies checking it into baggage handling (e.g. sub-zero temperatures at altitude in the cargo bay, damage due to mistreatment or neglect by baggage handling systems or personnel, etc. . . . ), as well as the added expense of checking luggage. The guitar 10 weighs between 6 and 8 pounds, although lower weights may be achieved by optimizing mechanisms and material selection (that is, using lightweight woods, non-wood alternatives such as carbon fiber, etc. . . . ).

Figure 8:
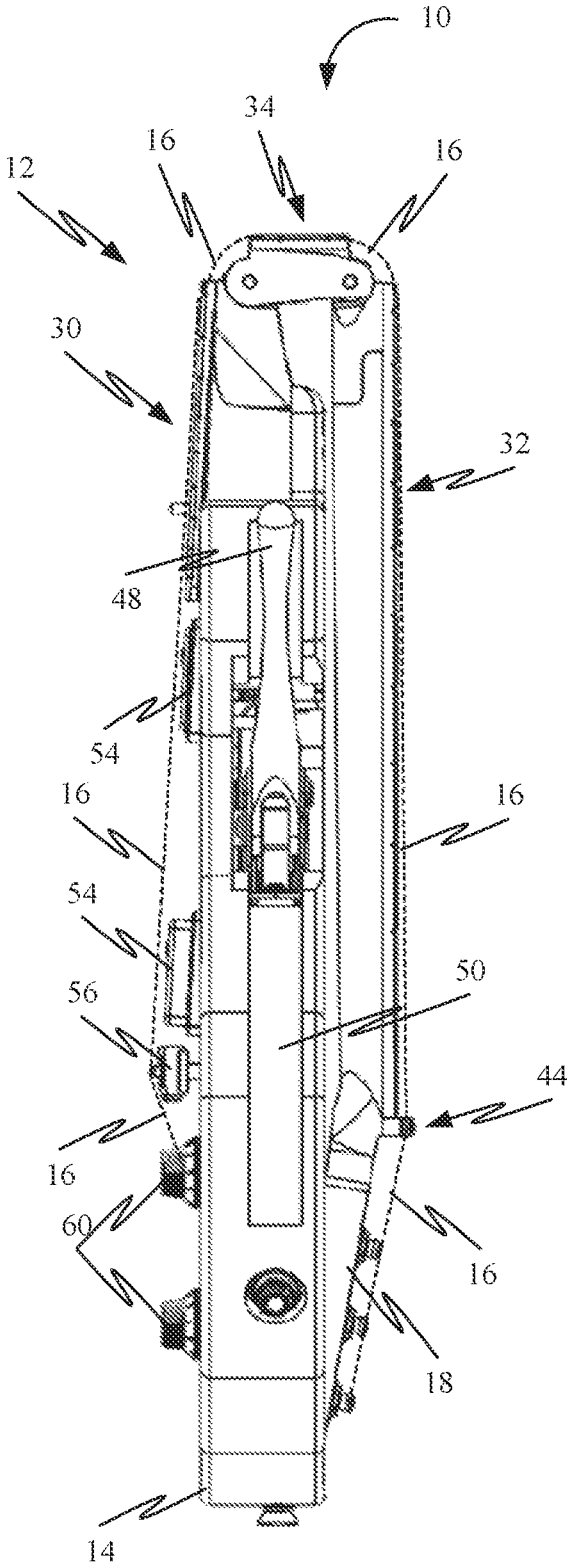
FIGS. 8-10 are side, front end, and back end views, respectively, of the foldable electric guitar in the folded position showing the string path according to an aspect of the present invention.
Figure 9:
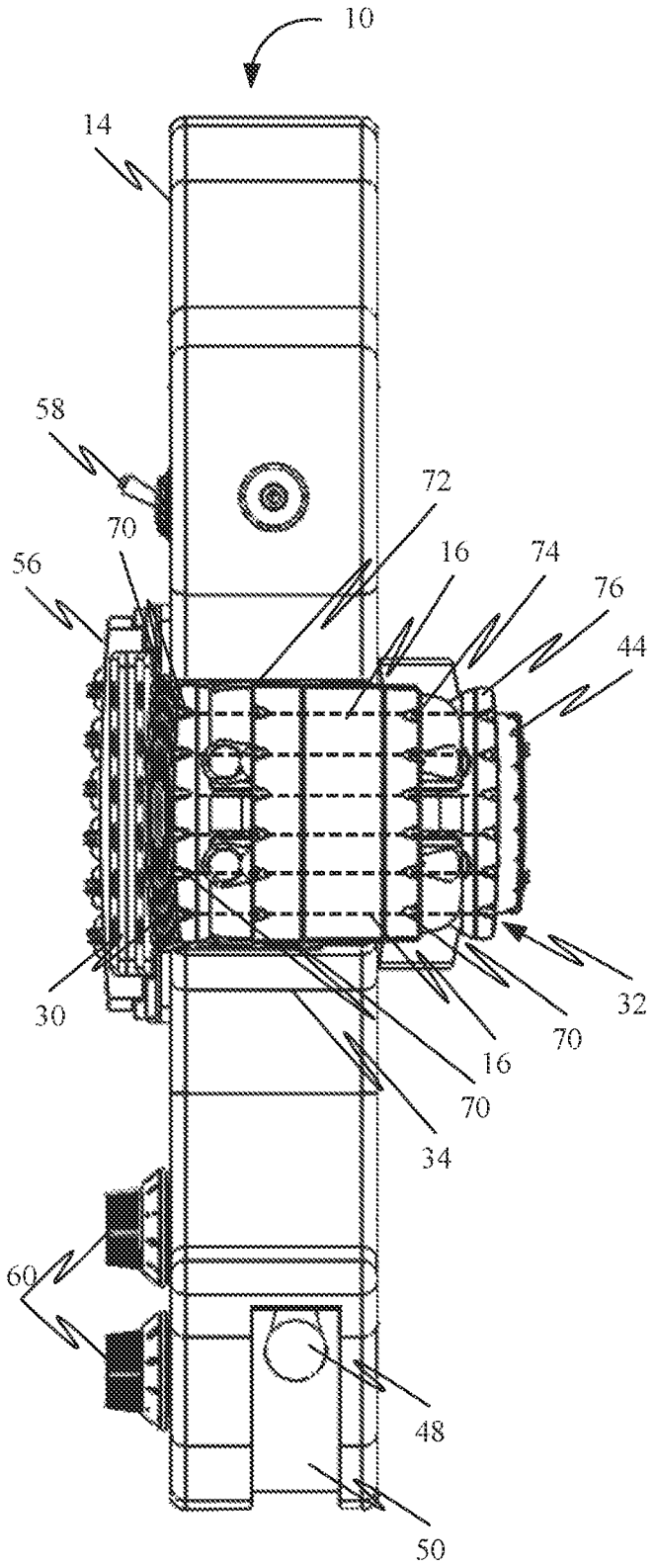
Figure 10:
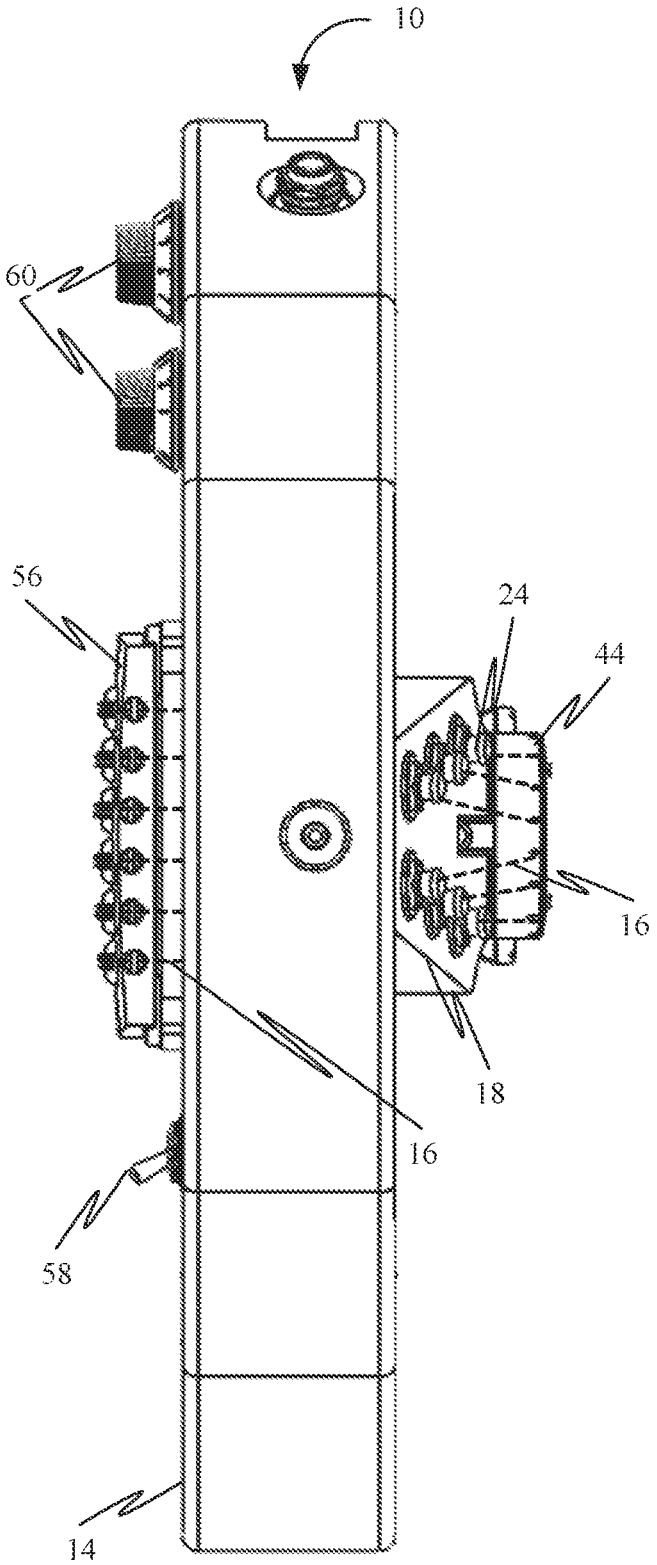

The electric guitar 10 also boasts elegant and effective string management during the folding and unfolding processes, such as shown in FIGS. 8-10. This is accomplished in number of manners, all of which are intended to prevent or otherwise minimize the likelihood of having the strings 16 migrate vertically and/or laterally, which could cause the strings 16 to disengage or disassociate from the neck 12 during or after the folding process. These manners include, but are not necessarily limited to, maintaining modest tension on the strings 16 during and after the folding process (as will be discussed below), as well as actively restraining the strings 16 at multiple locations along the string path (as will be discussed below).

The translating bridge assembly 20 includes one or more springs 66 which exert only modest forces (e.g. 1-5 pounds) on the strings 16 while the guitar 10 is transitioned into and maintained in the folded configuration. During the process of folding, the modest tension on the strings 16 causes the strings 16 "follow the fold" and assume the string path shown in FIG. 8 (with strings 16 as dotted lines), which will be detailed now. The strings 16 are anchored within a floating tailpiece (not shown) forming part of the translating bridge assembly 20. From this anchor point, the strings 16 pass rearwardly to a roller assembly 68 (FIG. 4) disposed within the body 14, then curve along the exterior of individual rollers on the roller assembly 68 and angularly upward through the aperture 62 in the body 14 where they pass over individual rollers forming part of the adjustable bridge assembly 56 en route to the tuning machines 24. While in the folded configuration, this involves the strings 16 passing from the adjustable roller assembly 68 through string grooves 76 formed along the upper edge of the fretboard of the lower neck portion 30, through string grooves 45 formed along the lower edge of the fretboard of the middle neck portion 34, through string grooves 47 formed along the upper edge of the fretboard of the middle neck portion 34, through string grooves 49 formed along the lower edge of the fretboard of the upper neck portion 32, through the apertures formed in the nut 44 before passing into (and preferably being locked into) the tuning machines 24 on the head 18. As best viewed in FIG. 9, the strings 16 are effectively registered within the various grooves 70, 72, 74, 76 such that they are unlikely to migrate vertically and/or laterally to disengage from the neck 12 during or after the folding process.

String management is also served through the use of locking tuning machines 24, as are known in the art. Locking tuning machines 24 include one or more set screws or nuts that can be adjusted to physically lock the strings 16 to the tuning machine 24, which will prevent the strings 16 from unspooling as can be the case when tension is removed from strings 16 wound around standard, non-locking tuning machines.

Figure 11:
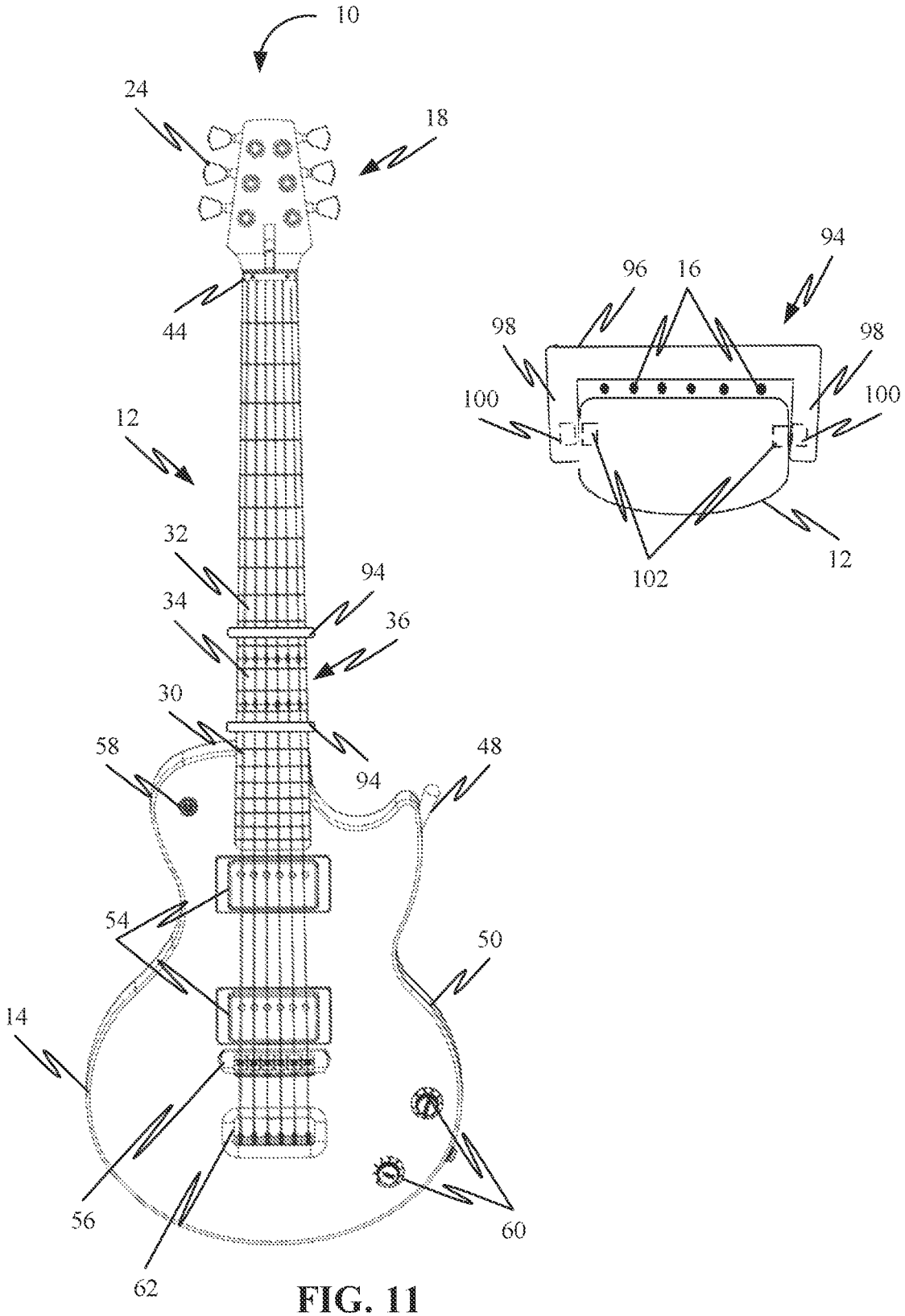
FIG. 11 is a front view of the foldable electric guitar equipped with a captive nut assembly and optional capo-like string management device (inset) according to aspects of the present invention.
Figure 12:
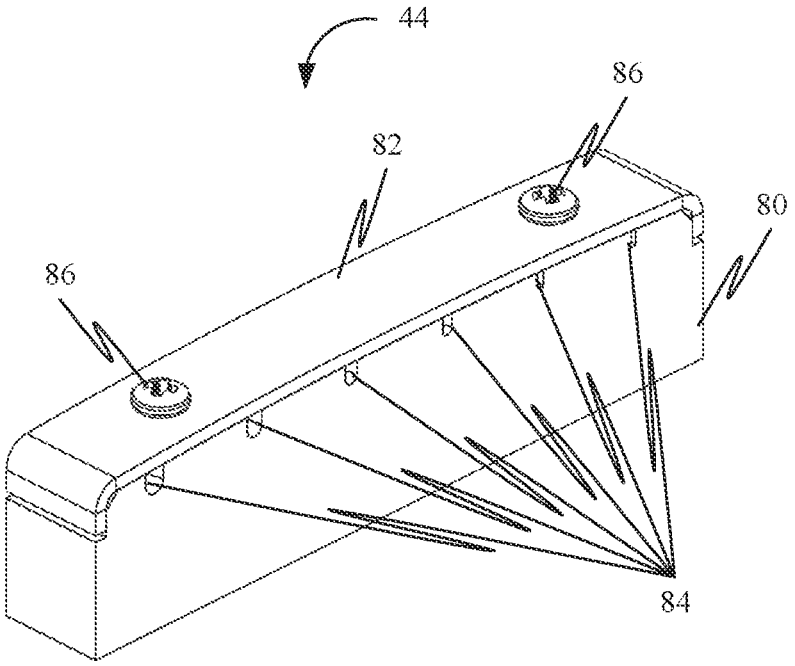
FIGS. 12-13 are perspective views of a captive nut assembly in fully assembled and exploded forms, respectively, according to an aspect of the present invention.
Figure 13:
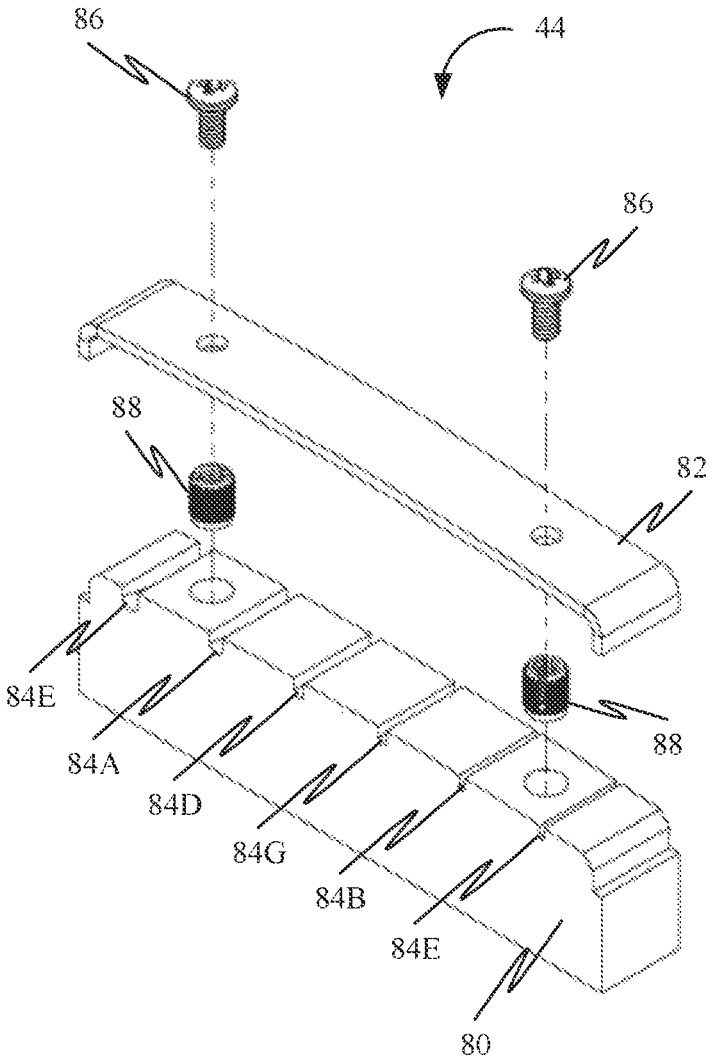

The travel guitar 10 may also equipped with the captive nut system 44 as shown in FIGS. 1-11, which is helps capture or otherwise restrain the strings 16 as they pass towards engagement with the tuning machines 24. As shown more fully in FIGS. 12-13, the captive nut 44 includes a base member 80 and a cover member 82. The base member 80 is made of typical nut material (e.g. bone) and includes the typical string slots 84 to pass the strings 16 therethrough. For ease of understanding, each slot 84 in FIGS. 12-13 is denoted with letters corresponding to the string (EADGBC) that goes therethrough. The cover member 82 is selectively removable from the base member 80 via the application or removal of machine screws 86 into threaded bushings 88 recessed within the base member 80.

Figure 14:
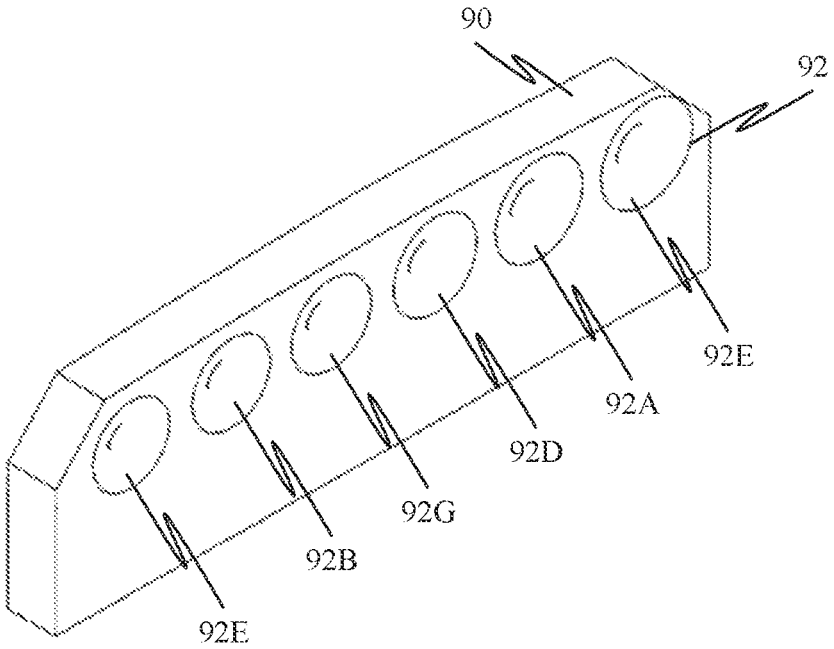
FIGS. 14-15 are perspective views of an captive nut assembly of integral construction according to an aspect of the present invention.
Figure 15:
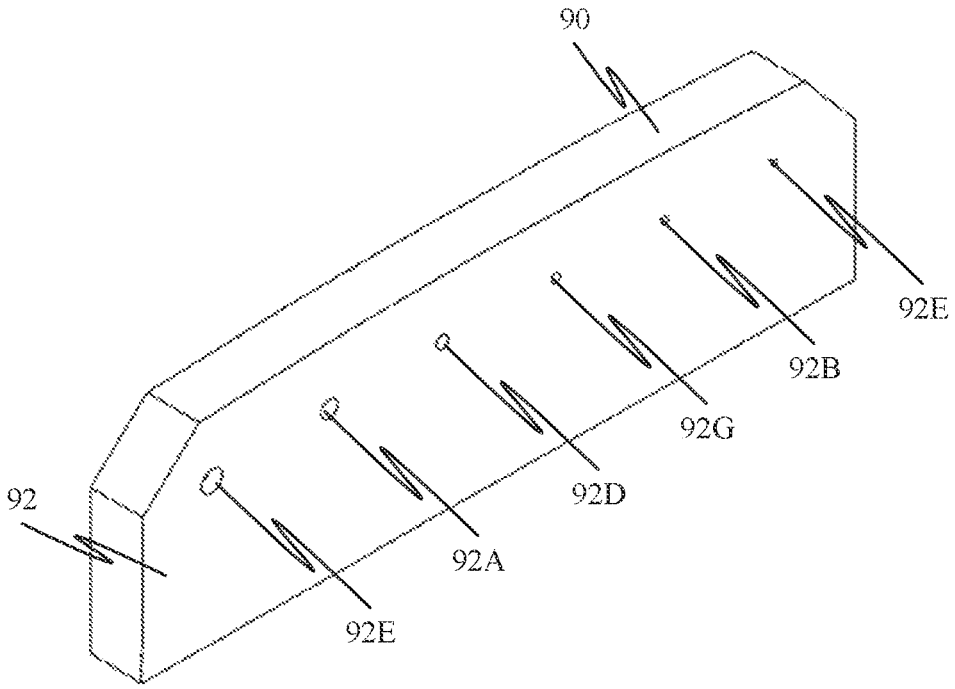

It will be appreciated that the engagement between the base member 80 and cover member 82 may be accomplished in any other suitable manner, including but not limited to replacing the threaded bushings 88 with magnets and either embedding a ferromagnetic metal within the cover member 82 or using a ferromagnetic metal to construct the cover member 82 (e.g. iron, cobalt, nickel, steel, etc. . . . ). In this construction, a user would simply need to manually pull off the cover member 82 to access the strings 16 (such as to change the strings 16), as opposed to using a screw driver with the embodiment shown in FIGS. 12-13. FIG. 14-15 illustrate yet another version, which is a single nut 90 having a string bores 92 formed therethrough for the passage of the strings 16 and string management restraint during the folded state. As above, each bore 92 in FIGS. 14-15 is denoted with letters corresponding to the string (EADGBC) that goes therethrough.

String management may also be served through the use of a string capture mechanism above and/or laterally to the strings 16 such that, during and after the folding process, the strings 16 are unable to migrate laterally and/or vertically to the point the strings 16 could disengage from the neck 12. FIG. 11 illustrates one such manner, namely via the use of a loose-fitting capo-type string management device 94. The string management device 94 includes a cross-bar 96, a pair of side bars 98, wherein the cross-bar 96 is configured to be placed a sufficient distance over the fretboard so the strings 16 aren't pinched as with a standard capo but rather are laterally and vertically (but not longitudinally) constrained so as to prevent the strings 16 from dissociating or disengage from the neck 12 during or after the folding process. The string management device 94 may be positioned anywhere along the length of the neck 12, but may find particular utility and effectiveness in preventing string migration and disassociation when placed adjacent to and/or over the hinge assembly 36 (that is, over the upper end of the lower neck portion 30, over the lower end of the upper neck portion 32 and/or over the middle neck portion 34).

To help maintain the string management device 94 in position after placement, one or more of the cross bar 96 and/or side bars 98 may be equipped with one or more magnets or magnetically-attractive materials (e.g. steel) such as shown generally at 102. The neck 12 may similarly be equipped with one or more magnets or magnetically-attractive materials (e.g. steel) such as generally shown at 102. Equipped in this manner, the string management device 94 can be easily placed over the strings 16 before, during and after the folding process to prevent string disengagement from the neck 12. Although not shown, it is also contemplated that each string management device 94 may be kept in magnetically-enabled recesses within the body 14 of the guitar 10. In this manner, the string management device 94 may be easily stored as part of the guitar 10 (as opposed to storing in a bag or the like) until use with low likelihood of being lost or misplaced.

Figure 16:
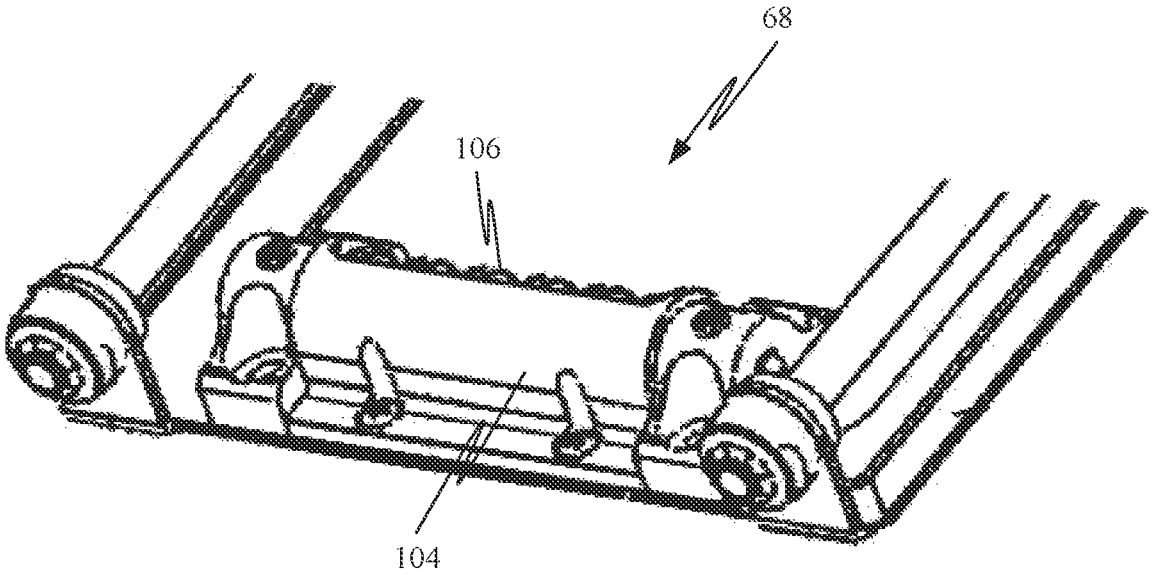
FIGS. 16-18 are perspective views of a string roller assembly and an optional string management device (string guide over the roller assembly) according to aspects of the present invention.
Figure 17:
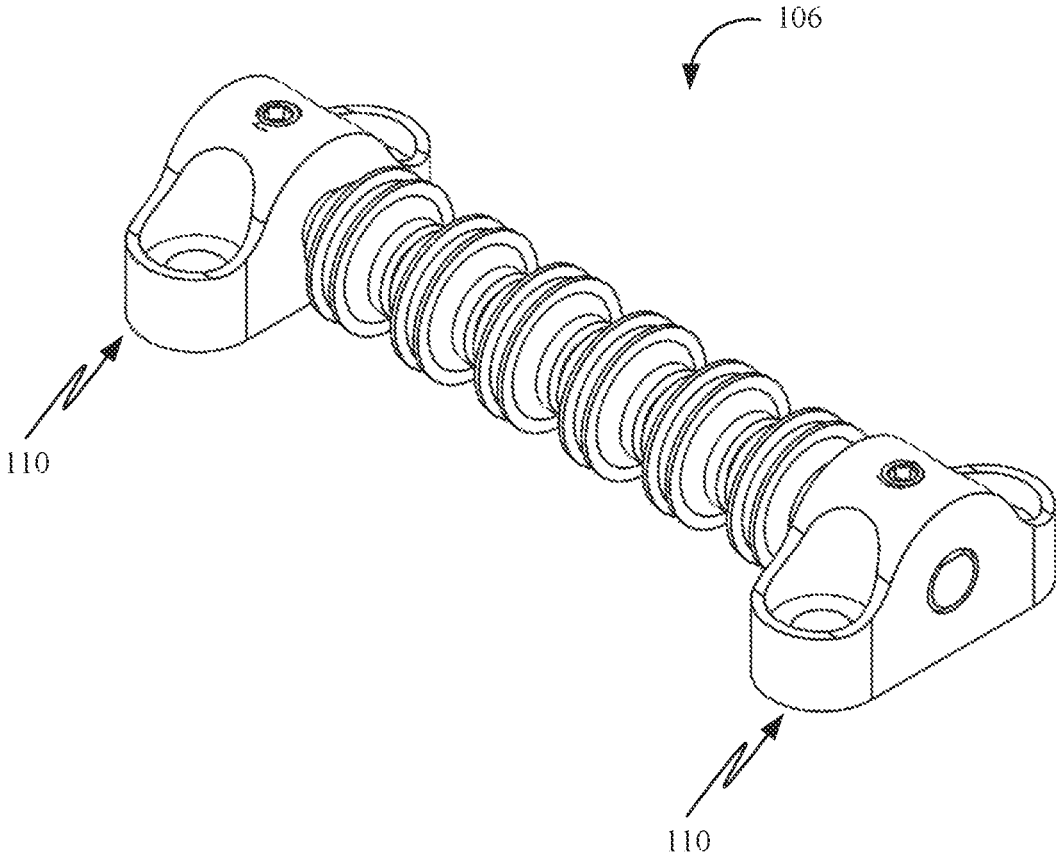
Figure 18:
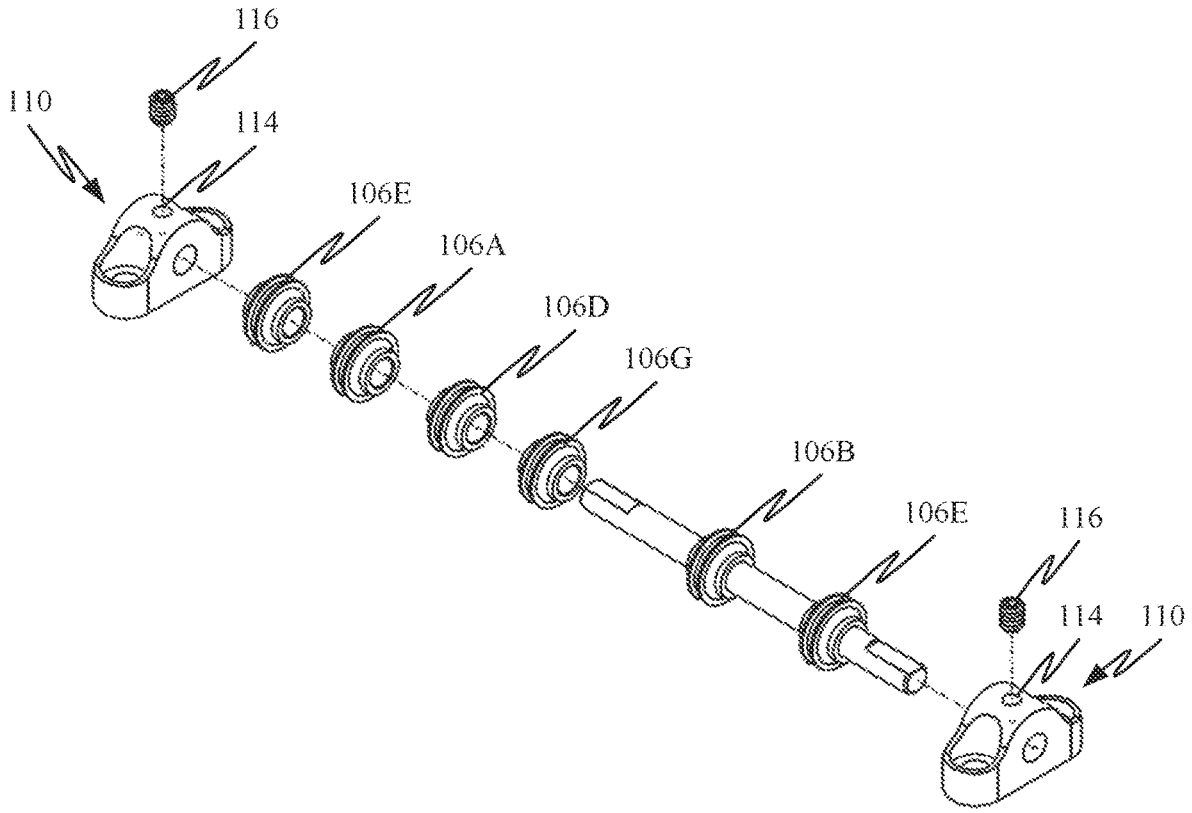

Any number of additional string management features may be provided, including but not limited to constraining or otherwise preventing or minimizing the migration of the strings 16 as they pass over the roller assembly 68 (FIG. 4) during the folding or unfolding state or after the folding process. Referring to FIGS. 16-18, this may be accomplished by positioning a string guard 104 adjacent to the roller assembly 68. The roller assembly 68 includes a plurality of rollers 106 rotatably disposed about an axel 108 that spans between first and second mounting members 110. The rollers 106 are denoted letters corresponding to the respective guitar string used for that roller 106. The axel 108 includes generally flat end regions 112 that extend into the mounting members 110 and are secured within threaded apertures 114 via set screws 116. If the string guard 104 is used, the strings 16 will have a vertical restraint as they pass over the rollers 106 in the detensioned state during folding or unfolding and/or after the folding process. It will be understood that the string guide 104 is purely optional.

Figure 19:
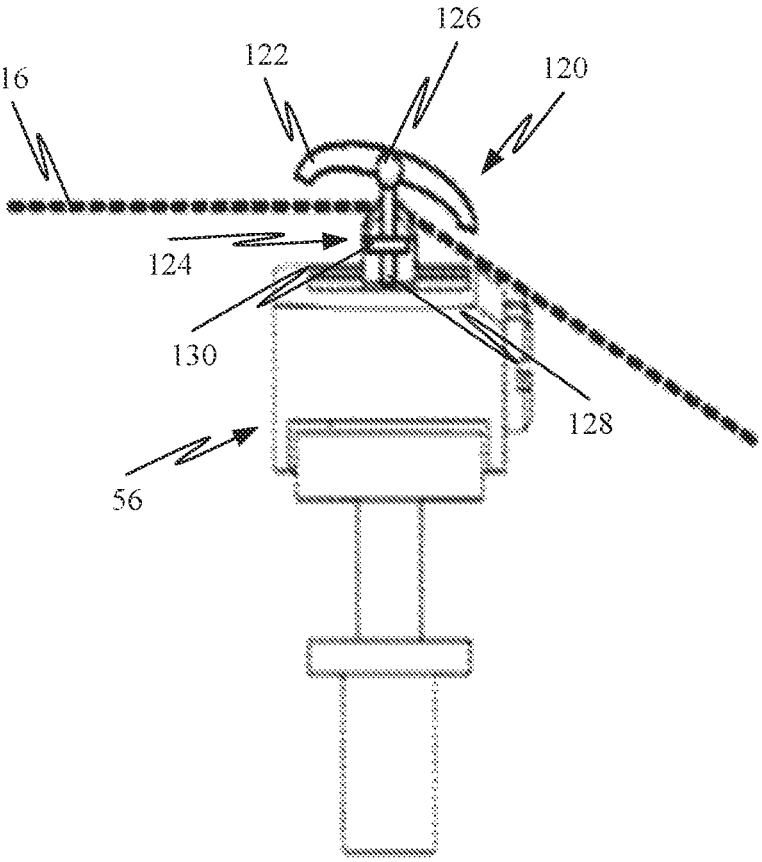
FIGS. 19-21 are perspective views of a height-adjustable bridge assembly and an optional string management device (string cover over the bridge assembly) according to aspects of the present invention.
Figure 20:
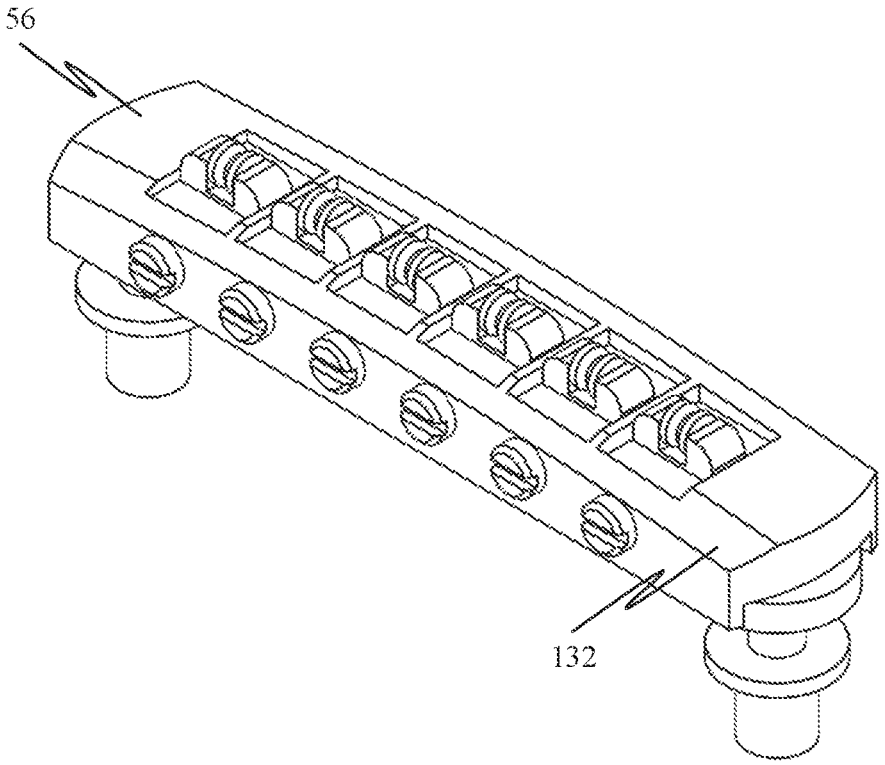
Figure 21:
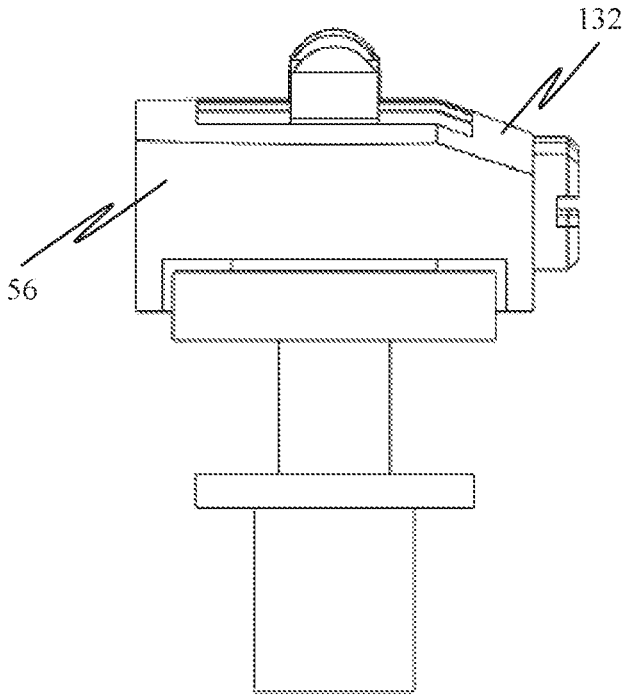

Yet another string management features may be provided, including but not limited to constraining or otherwise preventing or minimizing the migration of the strings 16 as they pass over the adjustable height bridge 56 during the folding or unfolding state or after the folding process. FIGS. 19-21 illustrate a bridge string guide 120 for use with a bridge assembly 56. The bridge assembly 56 may be any number of suitable adjustable bridges. The bridge string guide 120 includes a string cover 122, a pair of height-adjustable stand assemblies 124, and an axel 126 extending between the stand assemblies 123 and through an internal aperture disposed longitudinally through the string cover 122. The string cover 122 has a length sufficient to be positioned transversely over all of the strings 16, a width sufficient to cover at least half of the width of the bridge assembly 56 (FIG. 19), and a curved transverse cross-section capable of being rotatably adjusted relative to the strings 16. The height-adjustable stand assemblies 124 include a threaded post 128 with a rotatable thumb wheel 130. The threaded post 128 is rotatably coupled to the the axel 78. If the string cover 120 is used, the strings 16 will have a vertical restraint as they pass over the rollers of the height adjustable bridge 56 in the detensioned state during folding or unfolding and/or after the folding process. It will be understood that the string cover 120 is purely optional and may not be required.

Whether the string cover 120 is used or not, the bridge assembly 56 includes a beveled trailing edge 132 according to an aspect of the present invention. More specifically, the angle of the beveled trailing edge 132 enables the roller assembly 68 to be positioned as generally adjacent to floating bridge assembly 20 (FIG. 4), as opposed to near or adjacent to the back wall of the back cavity 64. This, in turn, avails space within the cavity 64 to receive the head 18 when the guitar 10 is in the folded state. This also has the added benefit of having a sharp break-angle for the string 16 (FIG. 19), which is helpful for increased sustain while playing.

Figure 22:
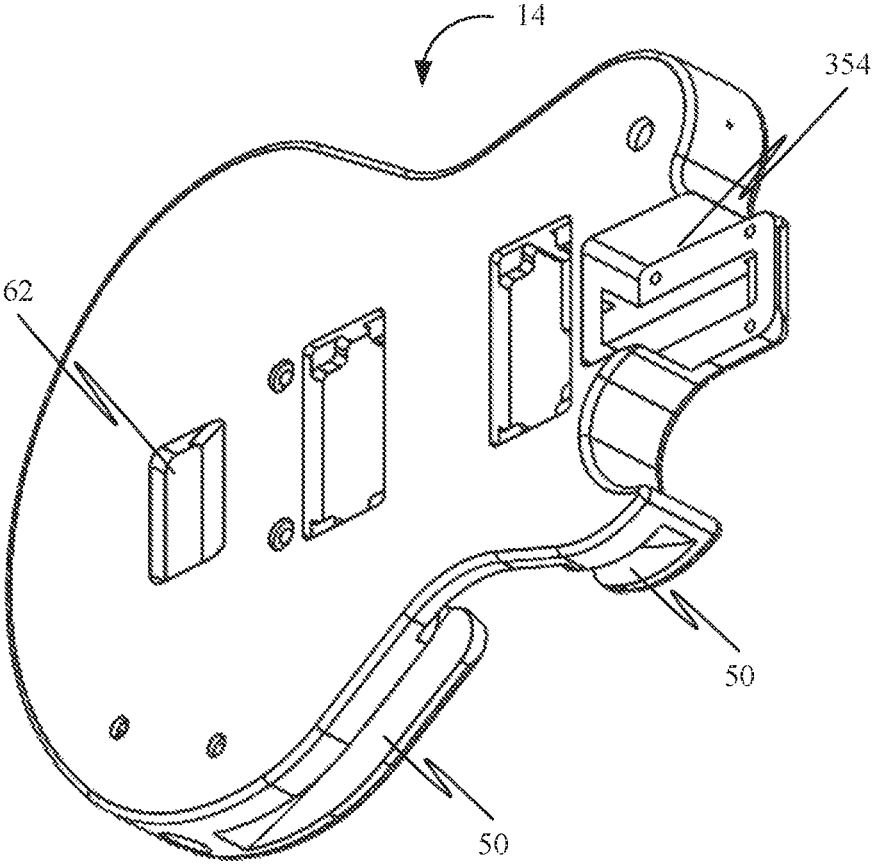
FIGS. 22-23 are front perspective and back views, respectively, of a guitar body (including back recess for translating bridge assembly, side recess for handle-actuation, top recess for string pass-through from back recess, and channel on back for receiving the coupler guide of the translating truss rod assembly) according to aspects of the present invention.
Figure 23:
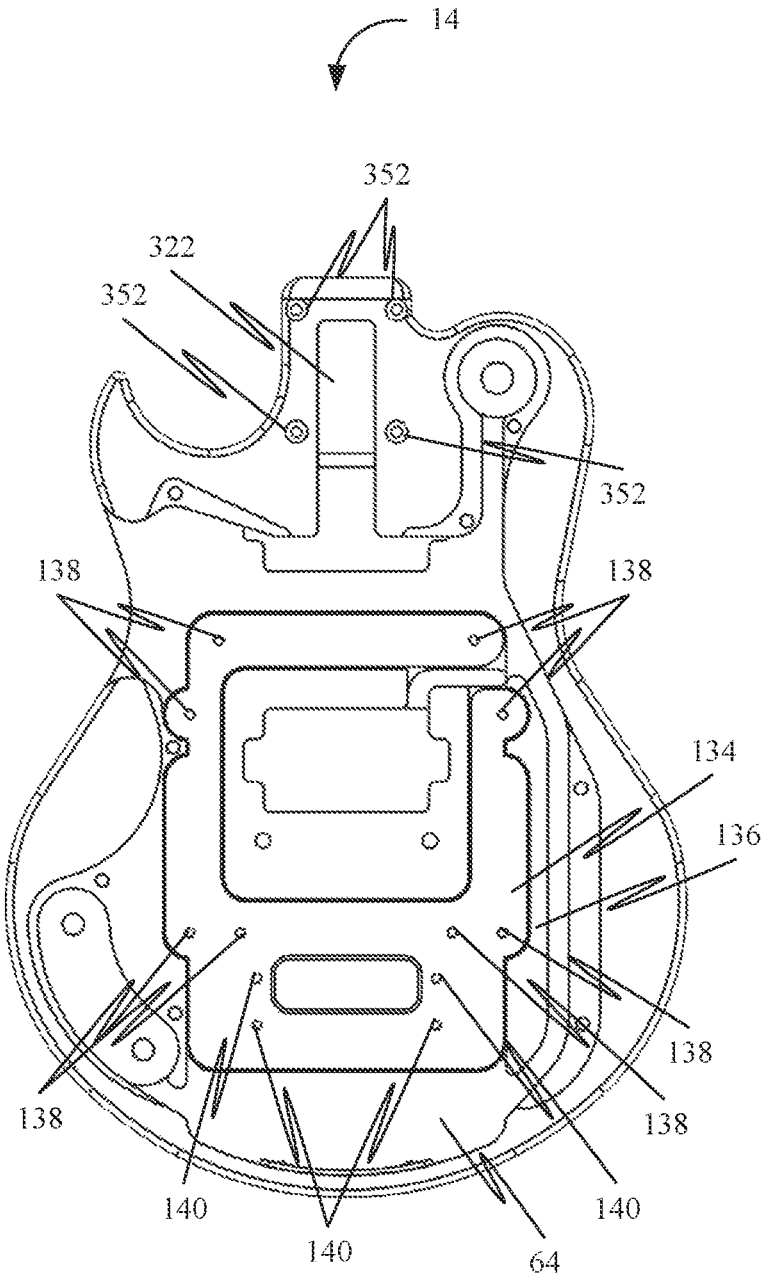

As shown in FIGS. 22-23, the body 14 is manufactured to include various apertures required to mount the typical guitar hardware (e.g. pick-ups 54, control knobs 60, pick-up selector switch 58, adjustable height saddle 56, etc. . . . ), but also the various apertures and recesses required for the actuation mechanisms of the present invention. These include the recess 64 formed in the back of the body 14 for the translating bridge assembly 20 and truss assembly 46, the side recess 50 formed along the lower perimeter of the body 14 for the lever 48, and the string aperture 62 located adjacent to the height-adjustable saddle 56 to pass strings from the translating bridge assembly 20 located in the recess 64.

Figure 24:
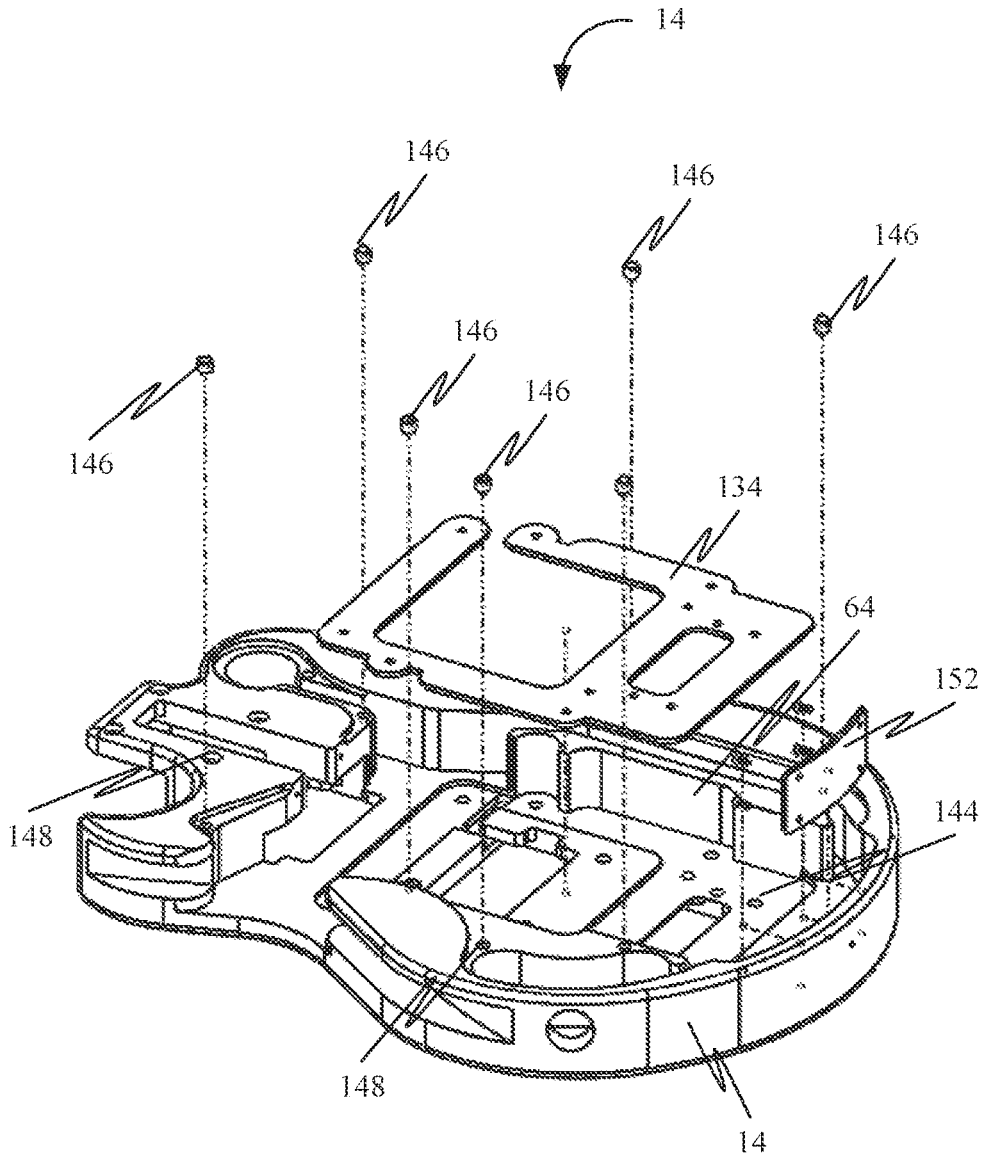
FIG. 24 is a back perspective view of a guitar body and mounting plate according to aspects of the present invention.

As best shown in FIGS. 23-24, to aid in mounting the translating bridge assembly 20, a plate 134 is provided within a recess 136 formed within the back recess 64. Preferably, the outer perimeter of the recess 136 closely matches the outer perimeter of the plate 134 to ensure tolerances are tight for assembly accuracy and quality controls according to the present invention. The height of the plate 134 should preferably match the depth of the recess 136 to ensure a flush fit between the upper surface of the plate 134 and the surrounding surfaces within the back recess 64. The plate 134 is preferably glued in place within the recess 136, but may be adhered or affixed in any suitable manners, including via the use of screws. The plate 134 includes a plurality of threaded holes to receive machine screws that are passed through apertures or bores formed in the translating bridge assembly 20 and string roller assembly 68. More specifically, bores 138 are for mounting the translating bridge assembly 20, while bores 140 are for mounting the string roller assembly 68 (via machine screws placed through the mounting members 110). In this manner, the translating bridge assembly 20 may be quickly, easily and robustly mounted within the recess 64 during assembly of the guitar 10. This rigid fixation will have the added benefit of increasing the sustain and tone of the guitar 10 during use based on the strong mechanical mating between the body 14 and the plate 134.

Figure 25:
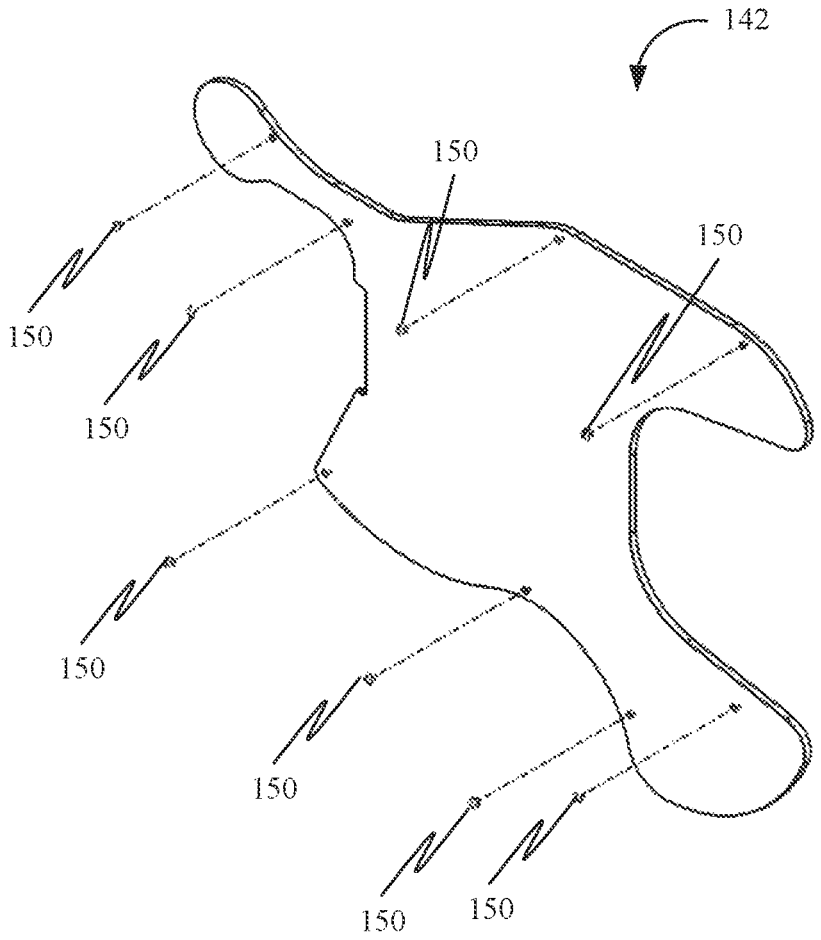
FIG. 25 is a perspective view of a cover for the back recess according to aspects of the present invention.
Figure 26:
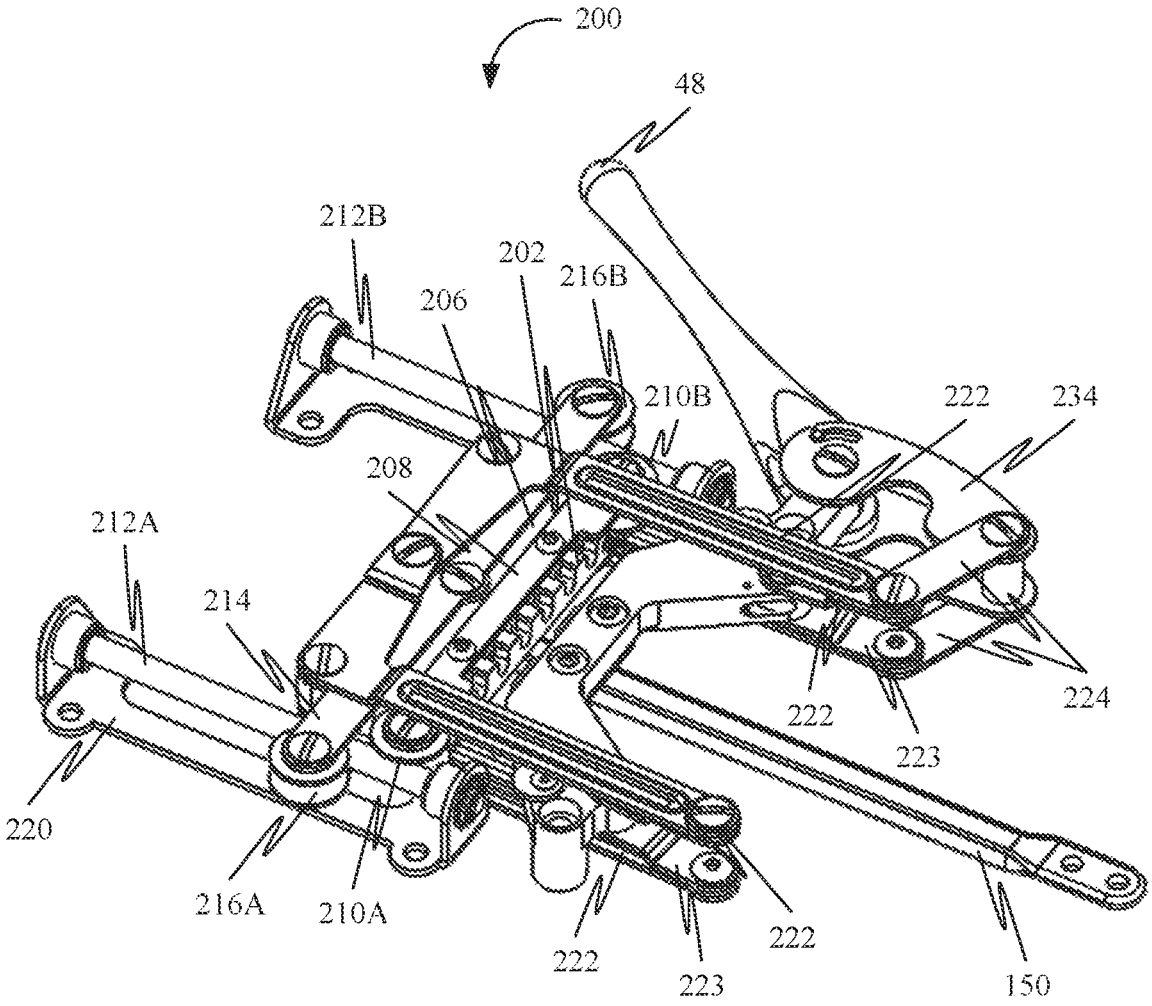
FIGS. 26-29 are perspective, bottom and side views, respectively, of an actuation mechanism for a foldable fretted instrument in the locked or tensioned configuration according to an aspect of the present invention, including handle, translating bridge assembly and aspect of a translating truss assembly.
Figure 27:
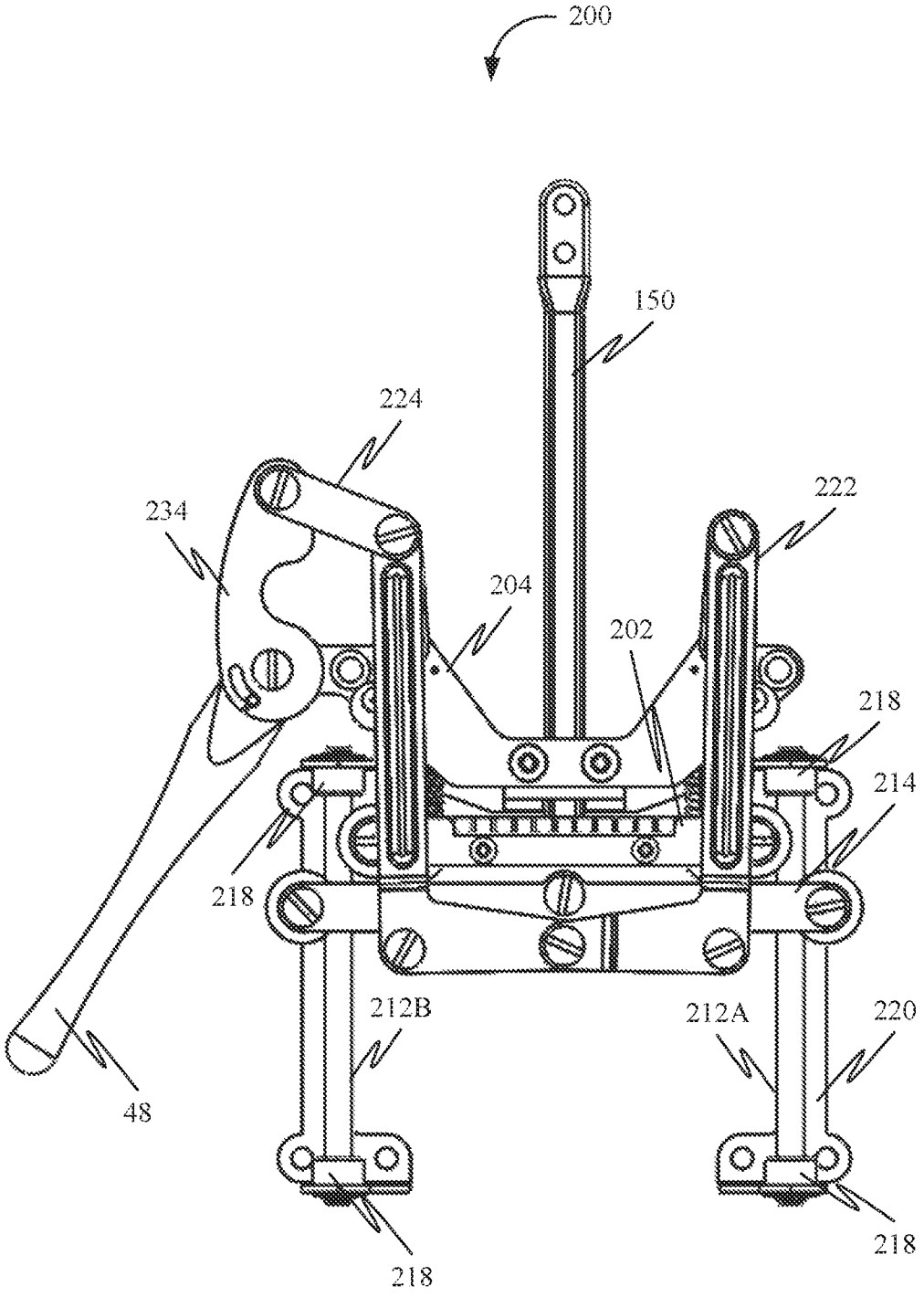
Figure 28:
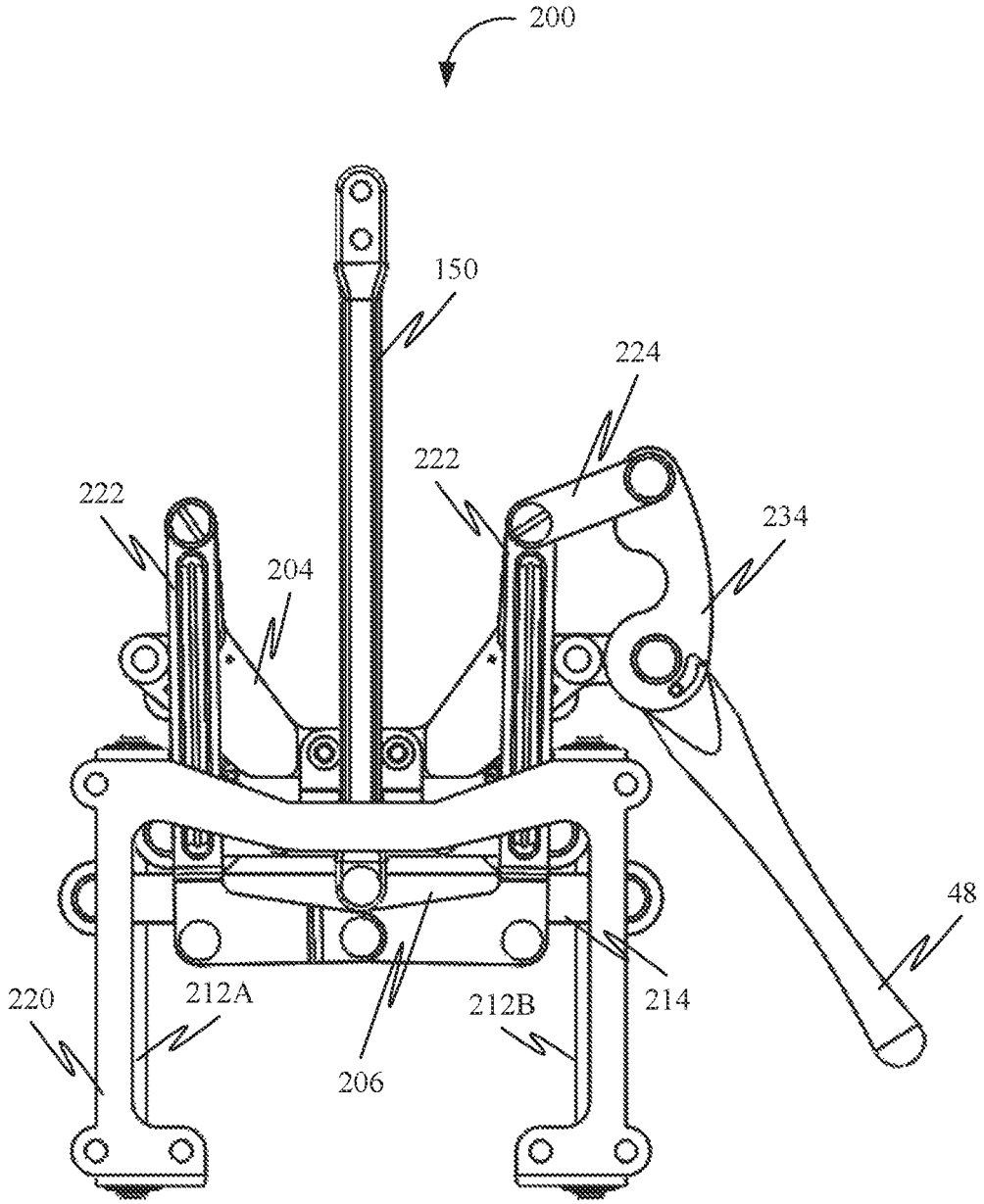
Figure 29:
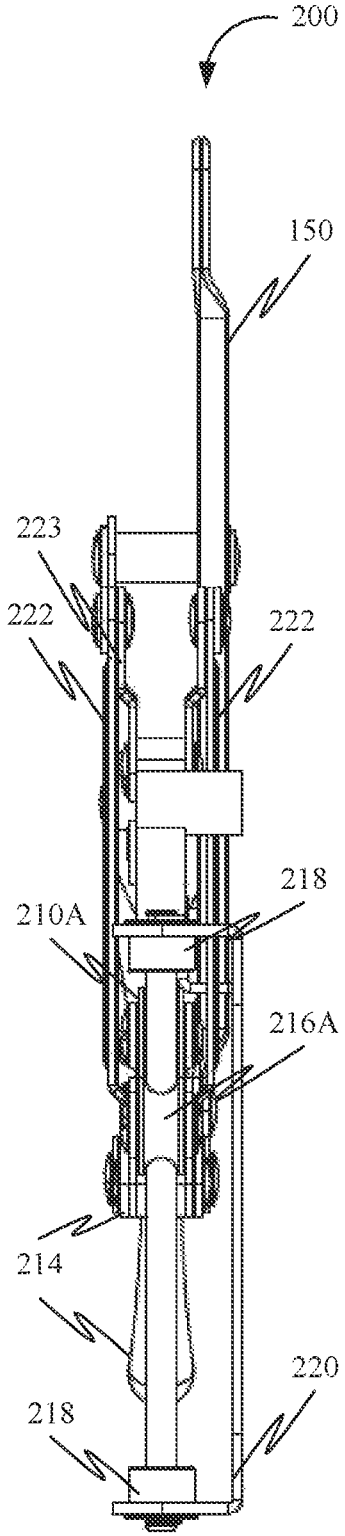

As shown in FIGS. 24-25, a back cover 142 is provided for enclosing the majority of the mechanisms disposed in the back recess 64. To do so, the back cover 142 has an outer periphery that is shaped in the same approximate contour as a recess 144 formed on the back of the body 14. The back cover 142 is preferably coupled to the body 14 through the use of magnets 146 mounted within bores 148 formed within the cover recess 144, which cooperate with magnets or ferromagnetic elements 150 (e.g. lugs or BBs of iron, cobalt, nickel, and steel) mounted at corresponding locations along the perimeter of the cover 142. In this manner, the back cover 142 may be quickly and easily removed, such as to change the strings or service the actuation mechanisms. The back cover 142 may be made of any suitable material, including but not limited to acrylic or other see-through material such that a user can visually inspect or admire the internal mechanisms forming the folding system of the present invention. A curved plate 152 is also provided for attachment to the rear wall of the recess 64 for the purpose of bolstering the structural integrity of the rear wall, which may be helpful in reinforcing the rear wall against impact.

Figure 30:
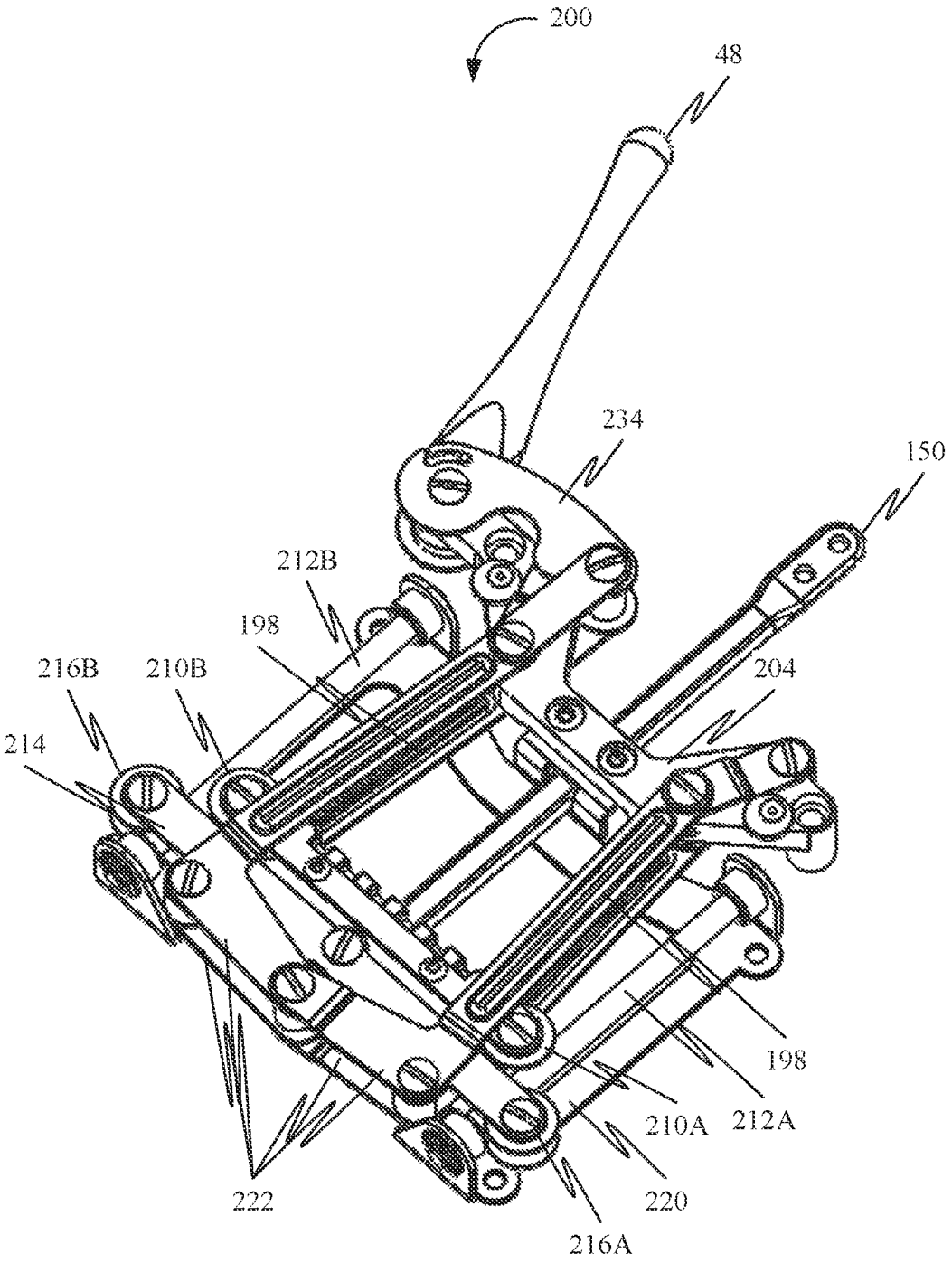
FIGS. 30-32 are perspective, top and bottom views, respectively, of an actuation mechanism of a foldable fretted instrument in the unlocked or detensioned configuration according to an aspect of the present invention, including handle, translating bridge assembly and aspect of a translating truss assembly.
Figure 31:
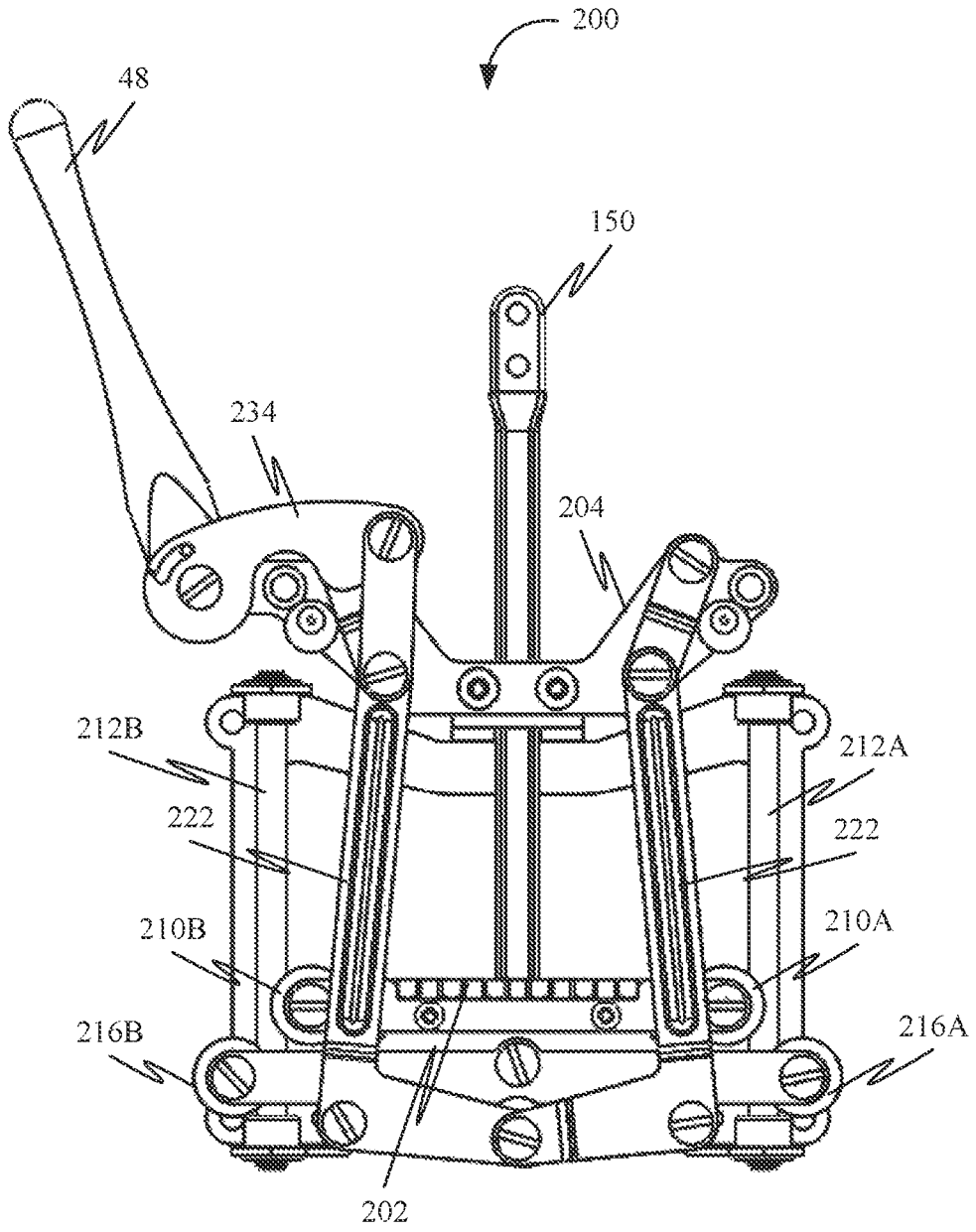
Figure 32:
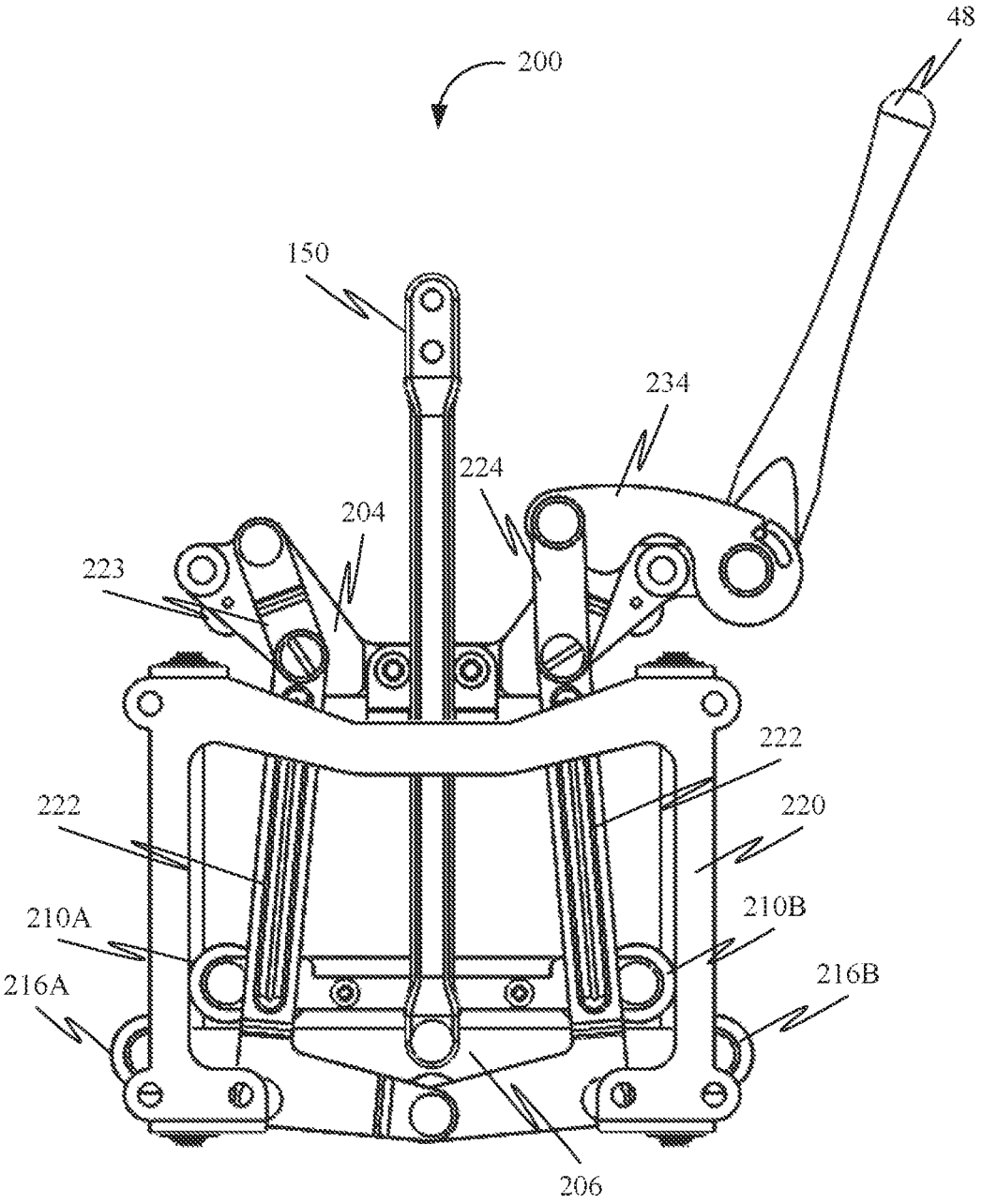
Figure 33:
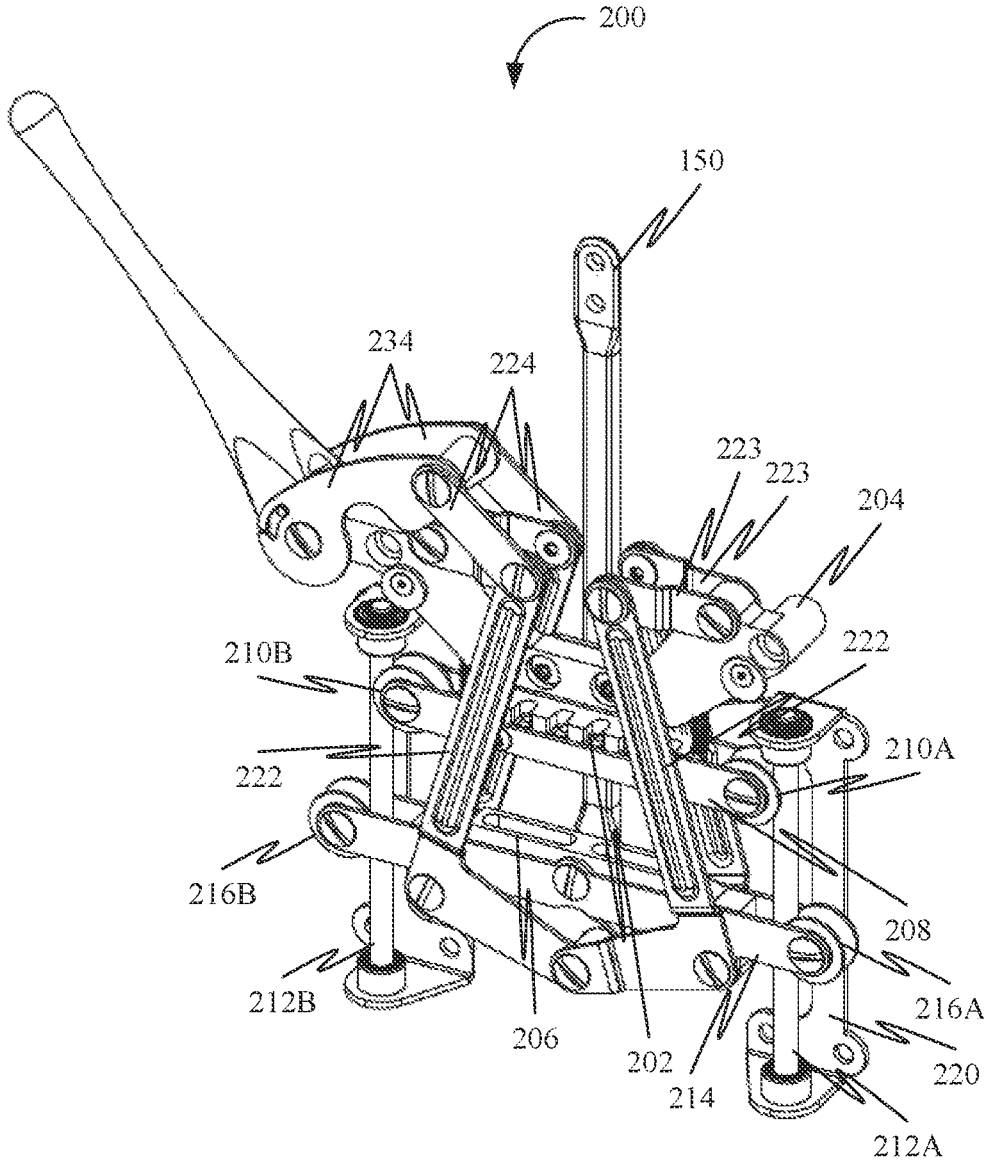
FIGS. 33-35 are perspective, top and bottom views, respectively, of an actuation mechanism of a foldable fretted instrument in transition between the locked and unlocked configuration according to an aspect of the present invention, including handle, translating bridge assembly and aspect of a translating truss assembly.
Figure 34:
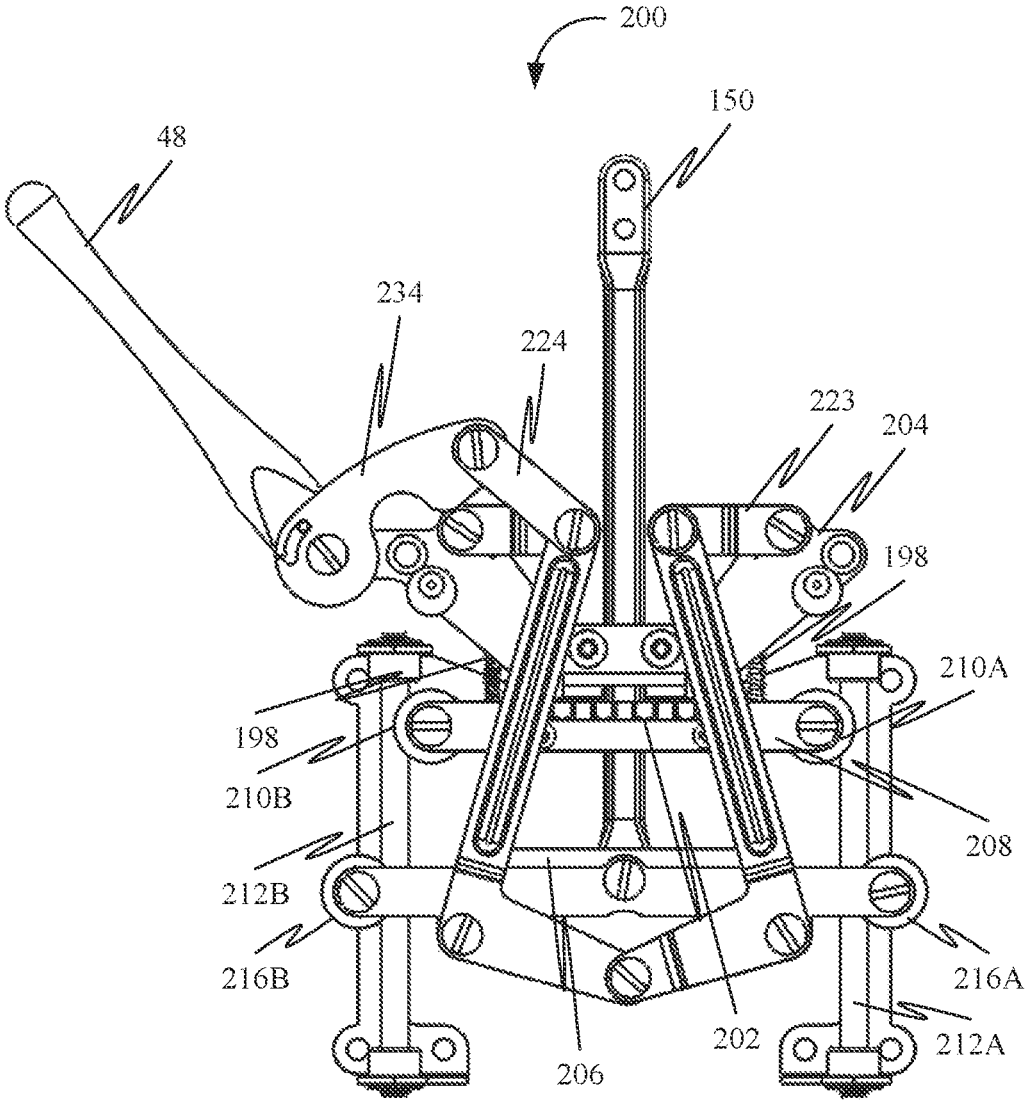
Figure 35:
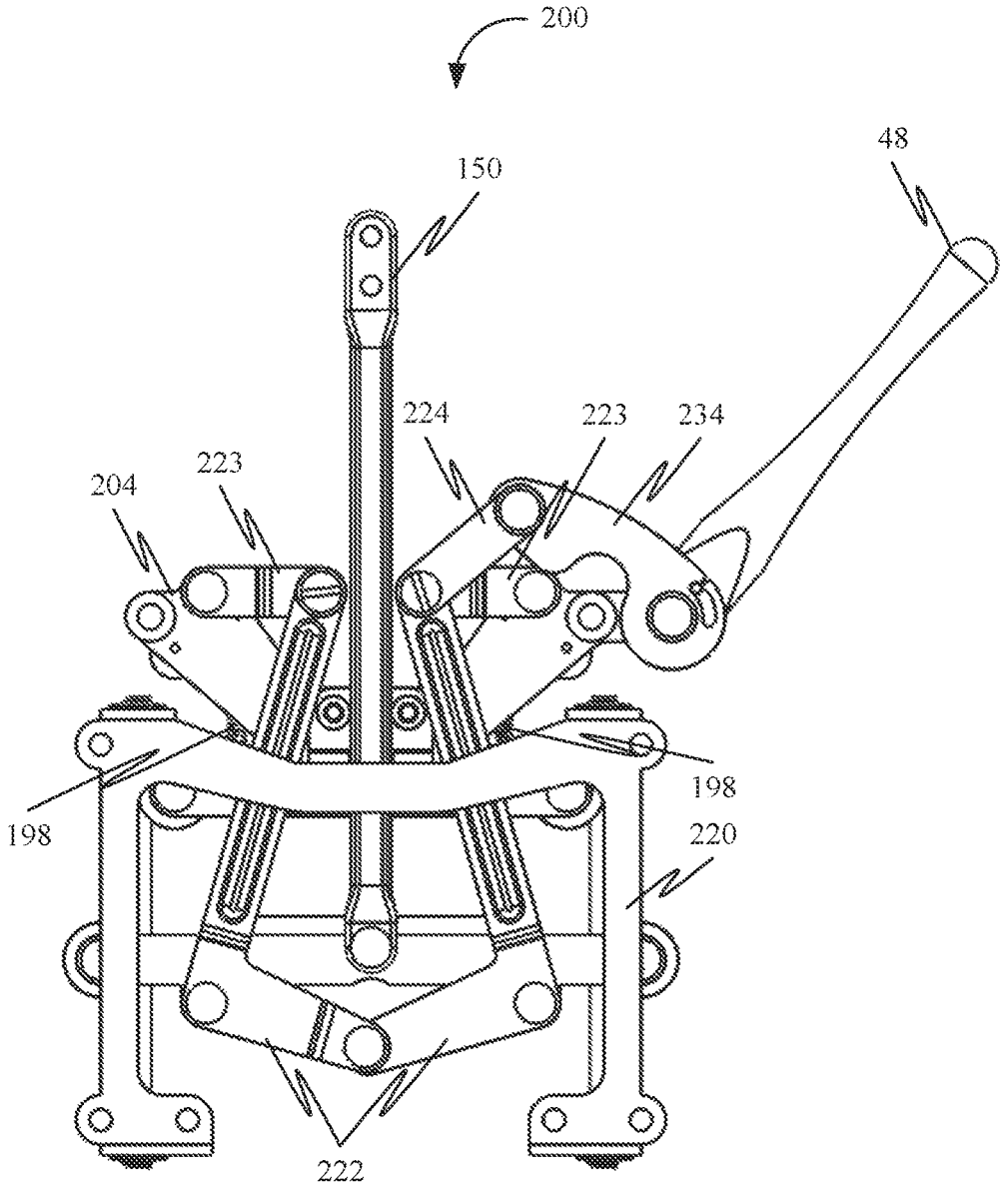

The actuation mechanisms associated with the handle 48, the translating bridge assembly 20 and the translating truss assembly 46 will now be described with reference to FIGS. 26-35, wherein FIGS. 26-29 show the mechanism 200 in the locked or tensioned configuration, FIGS. 30-32 show the mechanism 200 in the unlocked or detensioned configuration, and FIGS. 33-35 show the mechanism 200 in transition between the locked and unlocked configurations. As will be discussed below, the handle 48 is rotatably disposed within the recess 50 (at the approximate longitudinal midpoint) of the body 14 so it rotates within the same plane as the body 14. When the guitar 10 is in the playing position (see FIG. 3-5), the handle 48 is disposed within the lower part of the recess 50 (generally facing rearwards towards the end of the guitar 10) and the mechanism 200 is configured as shown in FIGS. 26-29. When the guitar 10 is in the folded position (see FIGS. 6-10), the handle 48 is disposed within the upper part of the recess 50 (generally facing towards the head 18) and the mechanism 200 is configured as shown in FIGS. 30-32.

Figure 3:
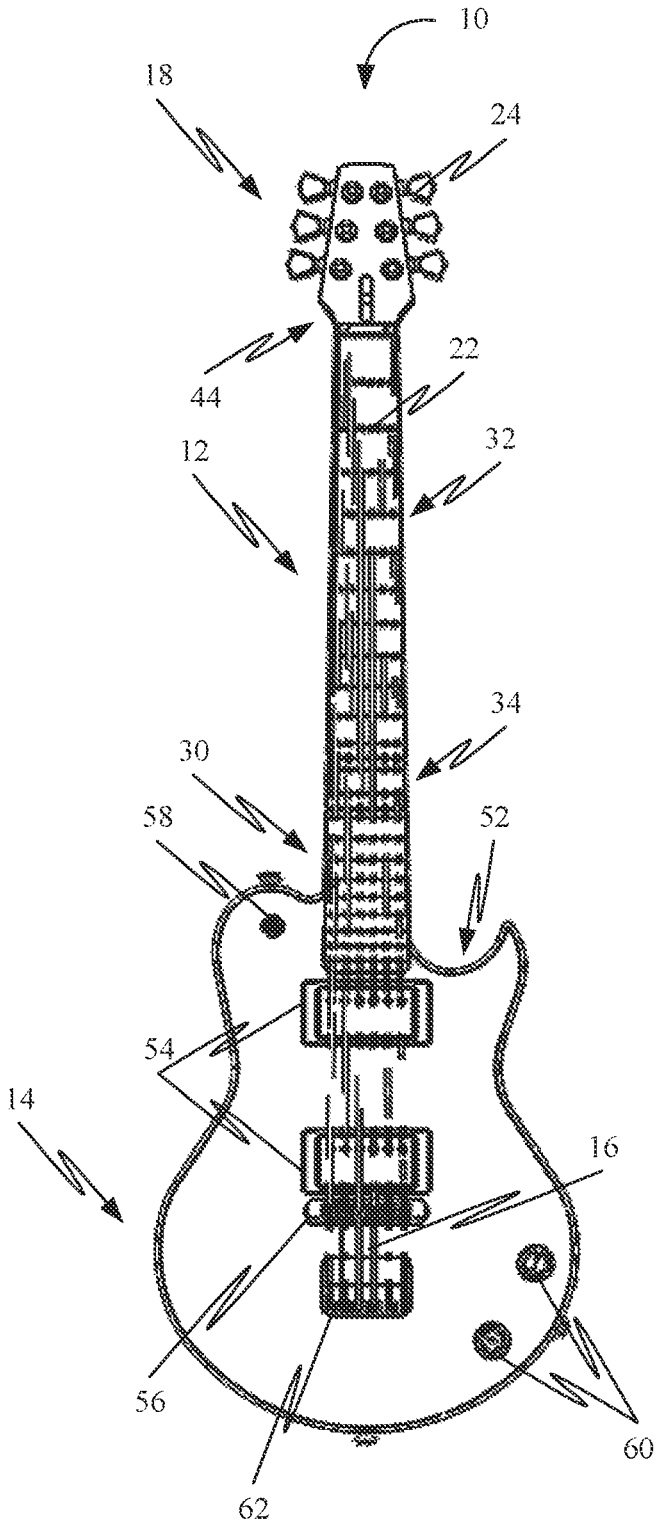
FIGS. 3-5 are front, back, and side views, respectively, of the foldable electric guitar in the playing position according to an aspect of the present invention.
Figure 4:
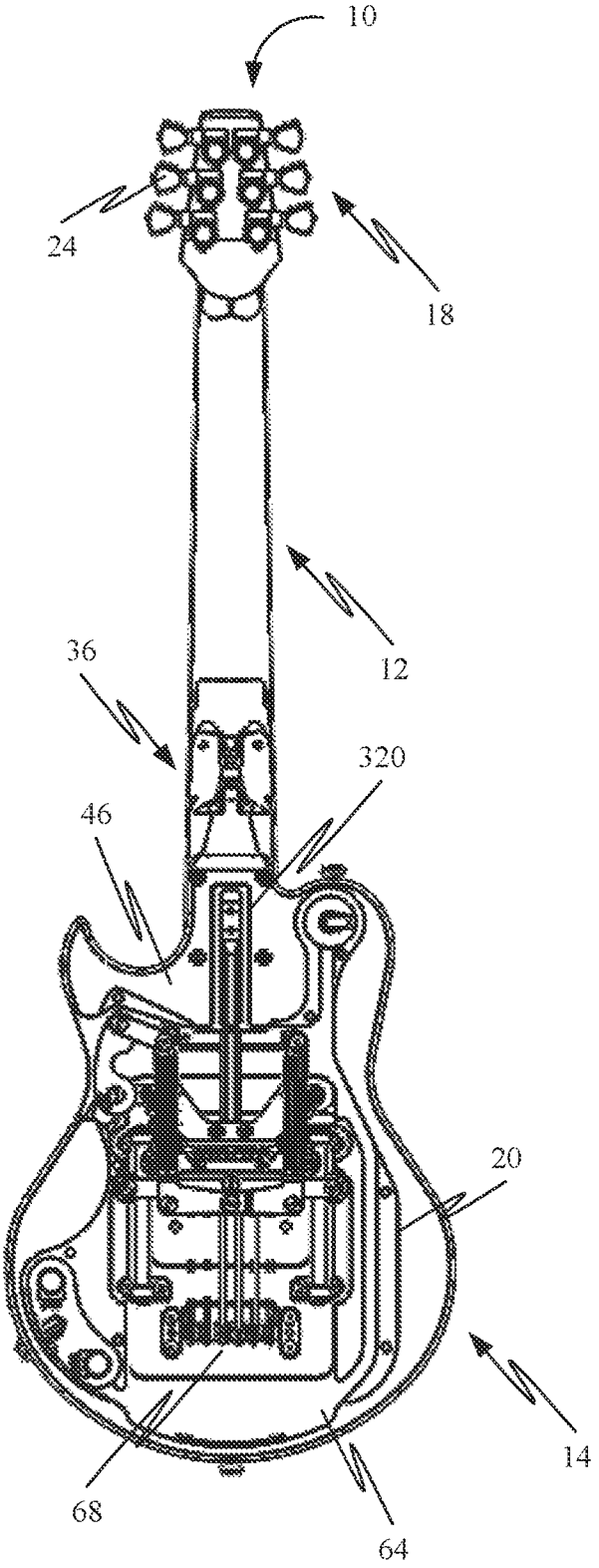
Figure 5:
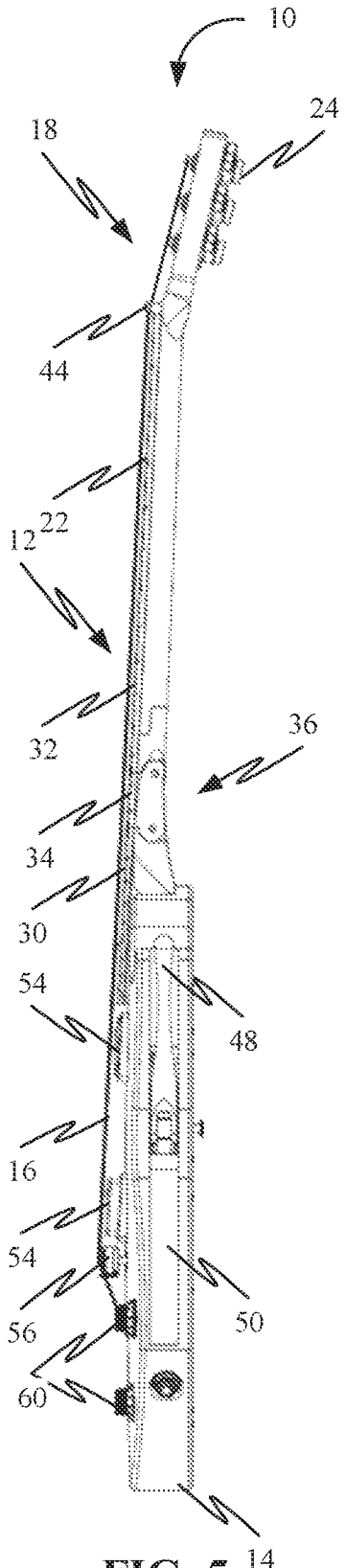
Figure 6:
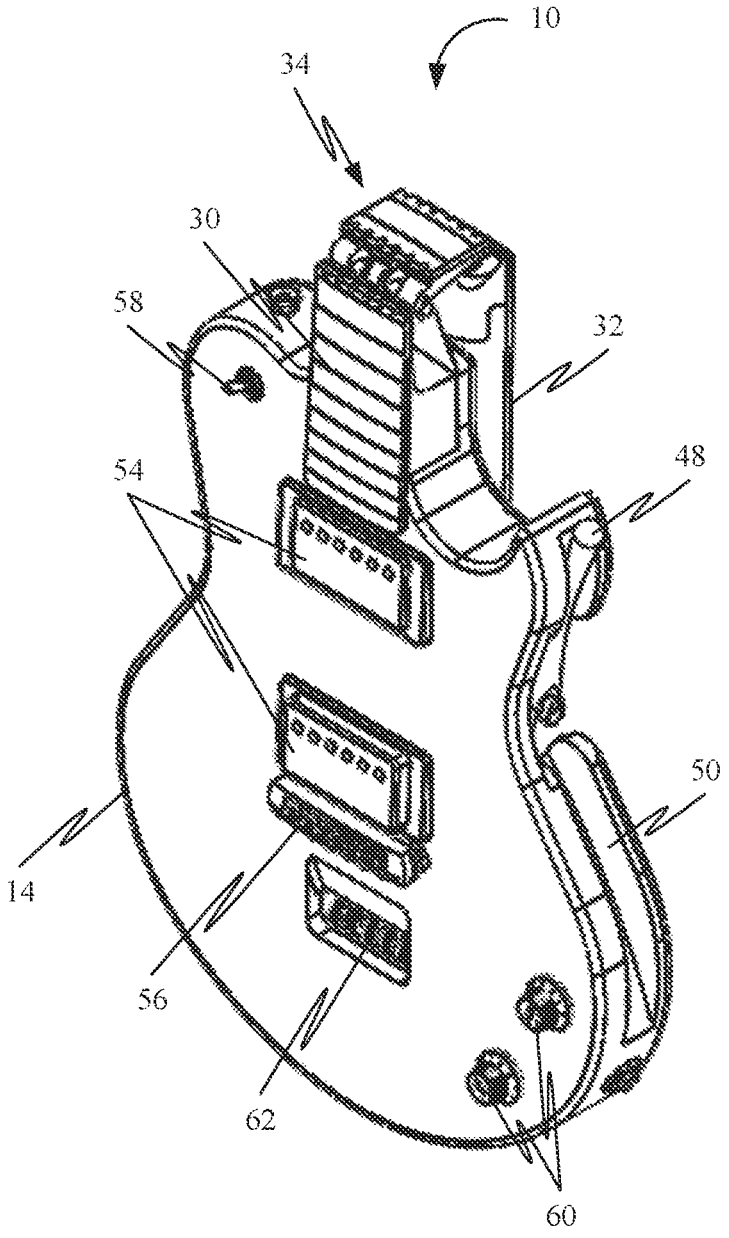
FIGS. 6-7 are perspective and back views, respectively, of the foldable electric guitar in the folded position according to an aspect of the present invention.
Figure 7:
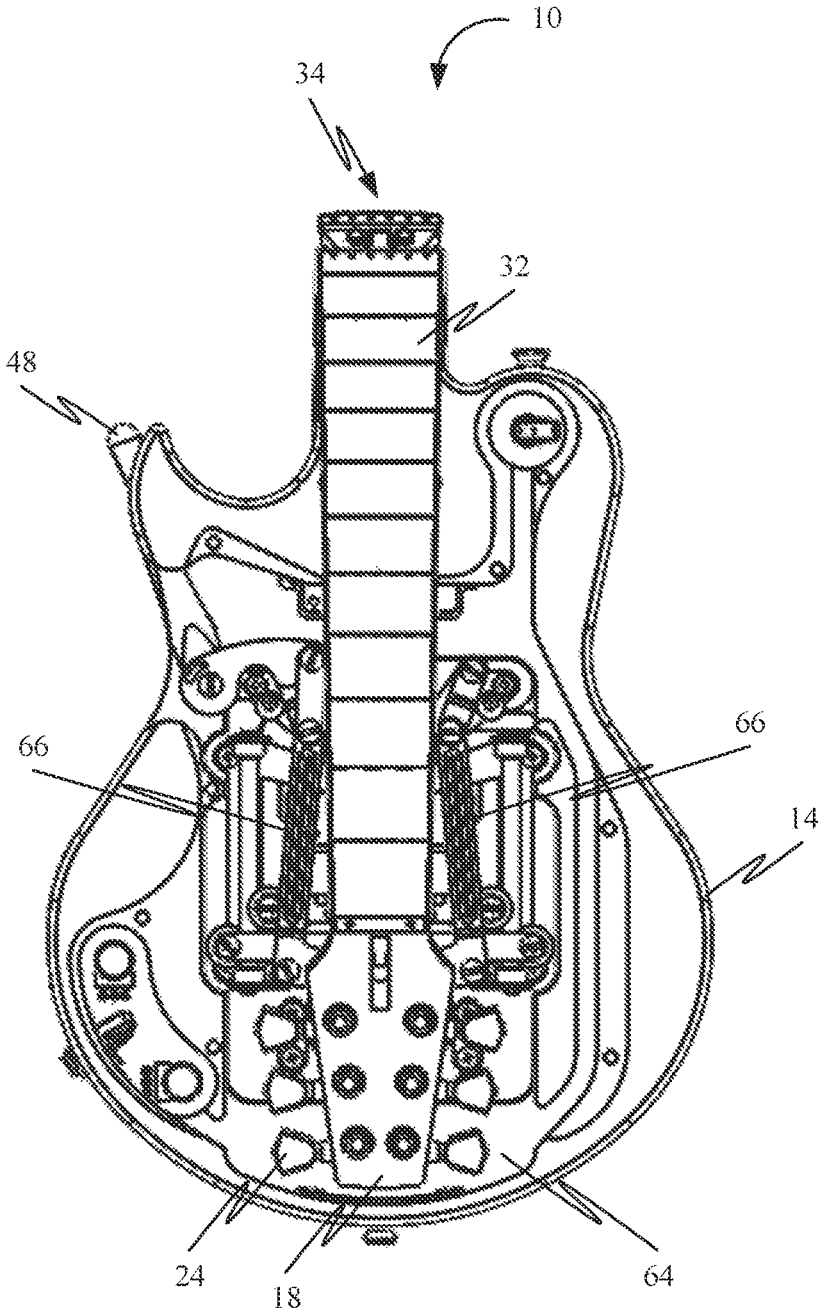

To transition from the folded state (FIG. 1) to the playing state (FIG. 2), the neck 12 is straightened relative to the body 16 and then the handle 48 is rotated downward (away from the head 18) as shown in FIGS. 33-35 and the mechanism 200 will move from the configuration shown in FIGS. 6-10 to the configuration shown in FIGS. 3-5 and bring a translating tail piece 202 into direct or near abutment with a datum block 204. When in the fully deployed configuration of FIGS. 3-5, the guitar 10 may be tuned and played. To transition from the playing state (FIG. 1) to the folded state (FIG. 2), the handle 48 is rotated upwards (towards the head 18) such that the translating tail piece 202 will be released and move away from the bridge datum block 204 to assume the configuration shown in FIGS. 30-32. The translating tail piece 202 is coupled to the datum block 204 via a pair of springs 198 that provide constant tension (ranging from 1-5 pounds) which acts against the guitar strings during the folded and transition states. In this manner, the strings always have modest tension, which helps them "follow the fold" and stay within grooves 70, 72, 74, 76 in the neck 12 during transition and in the folded state, as well as stay on the rollers 106 of the roller assembly 68 during transition and in the folded state.

Figure 36:
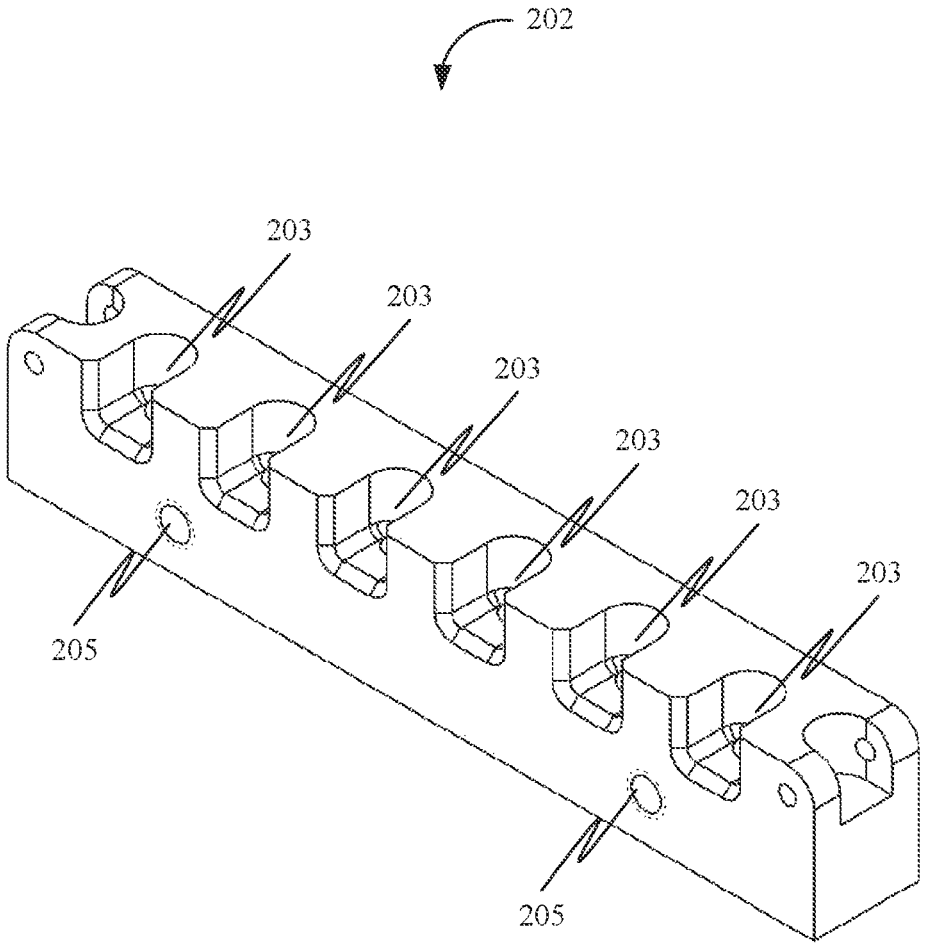
FIGS. 36-37 are perspective and top views of a translating tail piece forming part of an actuation mechanism for a foldable fretted instrument according to an aspect of the present invention.
Figure 37:
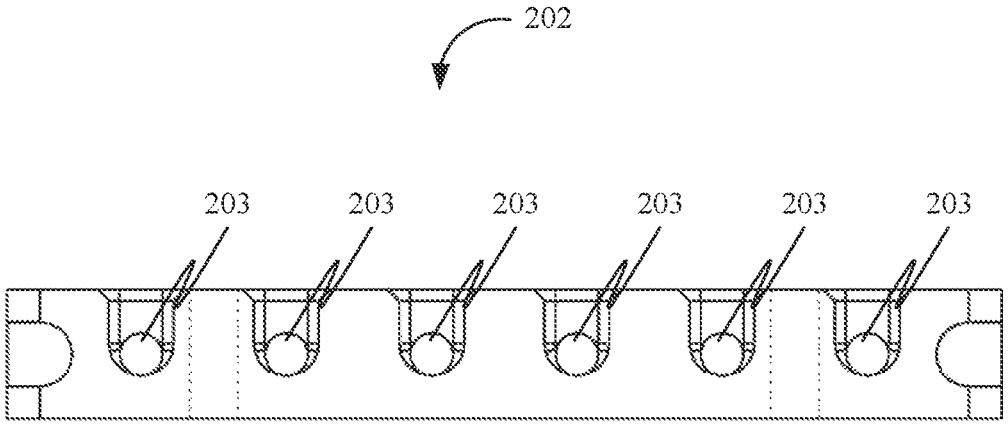
Figure 38:
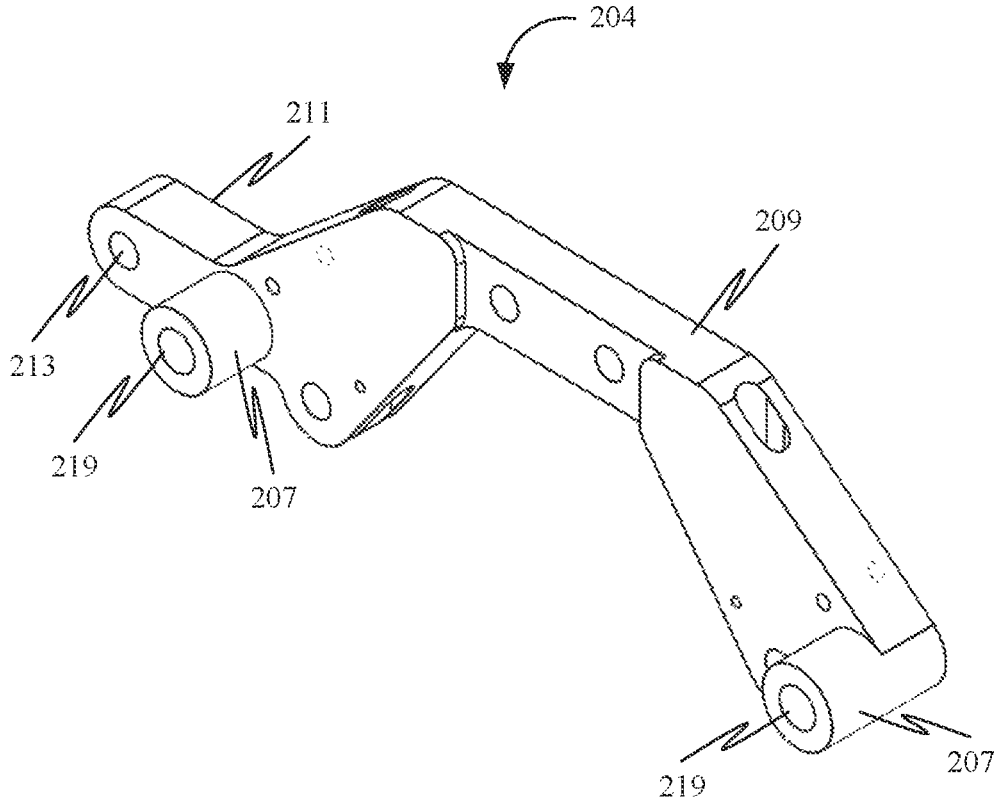
FIGS. 38-39 are perspective and top views of a datum block forming part of an actuation mechanism for a foldable fretted instrument according to an aspect of the present invention.
Figure 39:
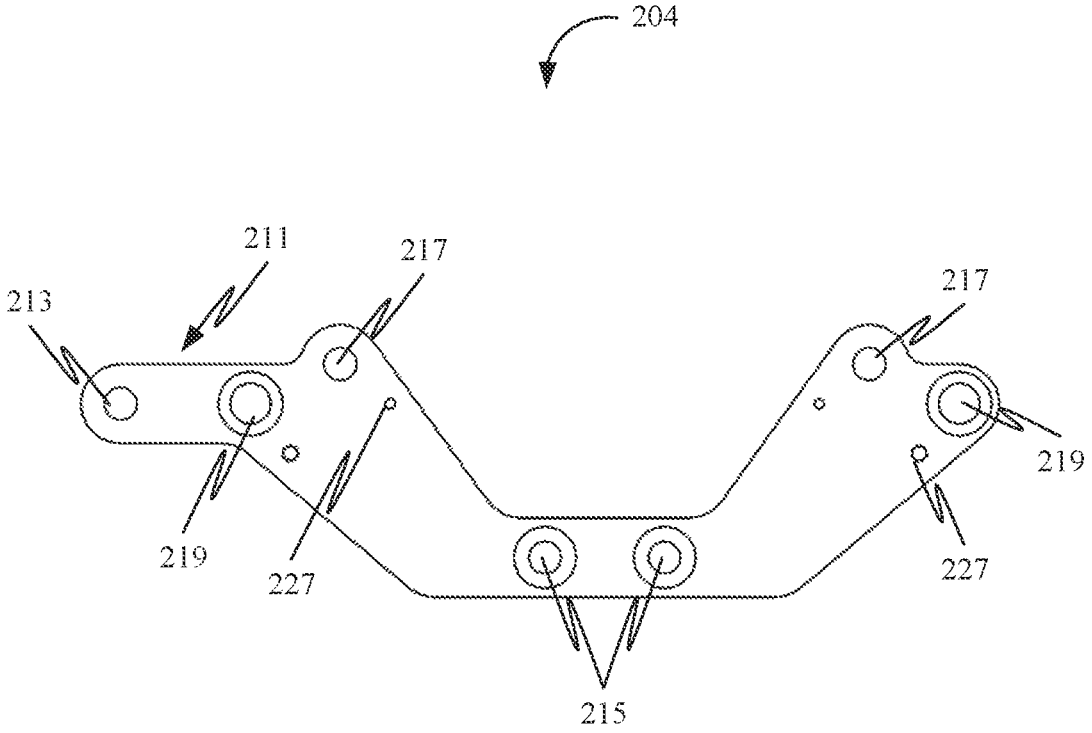
Figure 40:
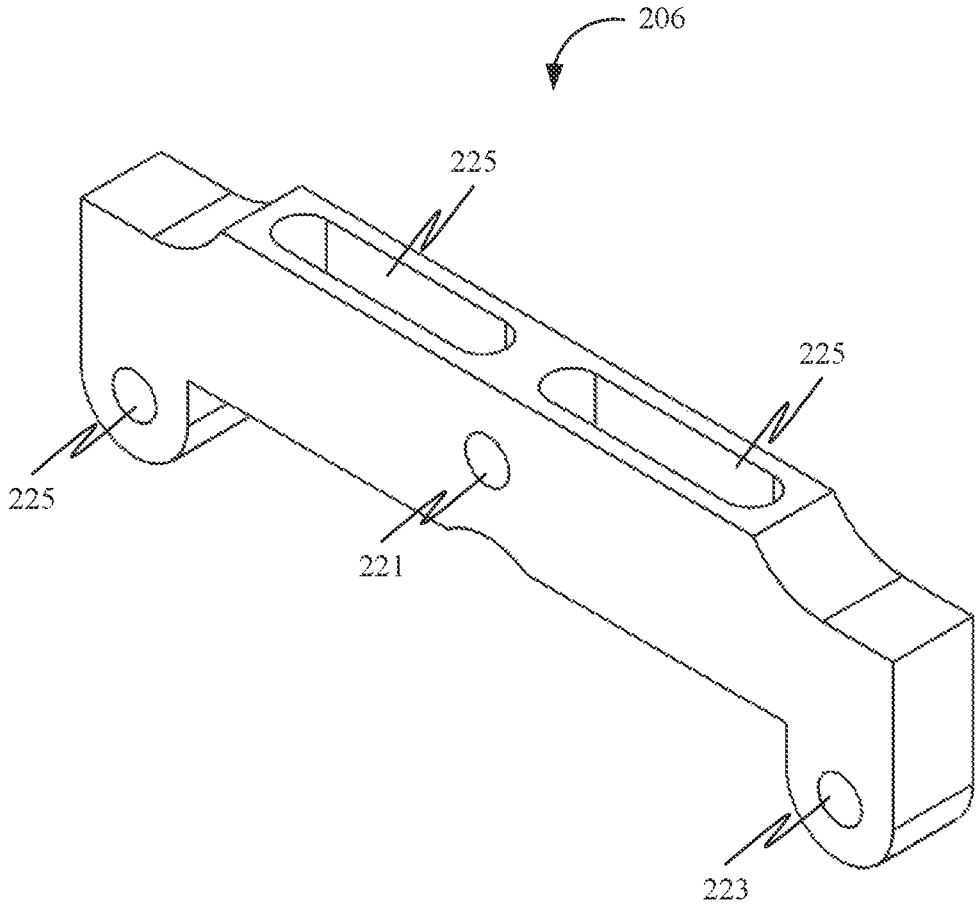
FIGS. 40-41 are perspective views of a bridge compression member forming part of an actuation mechanism for a foldable fretted instrument according to an aspect of the present invention.
Figure 41:
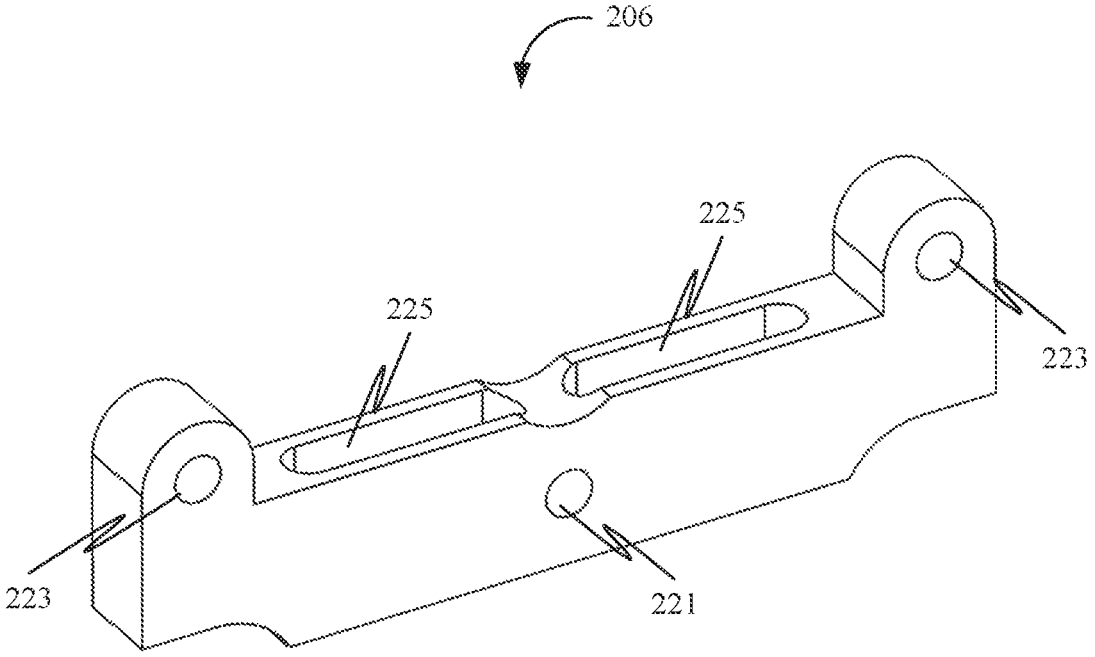

The translating bridge assembly 20 includes the translating tail piece 202 (FIGS. 36-37), the bridge datum block 204 (FIGS. 38-39), and a bridge compression member 206 (FIG. 40-41). The translating tail piece 202 (FIGS. 36-37) is the anchor for the strings 16 and, more specifically, includes a plurality of string apertures 203 extending generally parallel to the longitudinal axis of the guitar 10 so as to receive the strings 16 therethrough. It is from this anchor point that the strings 16 will be strung so as so create the string path explained above with reference to FIGS. 8-10. The translating tail piece 202 includes apertures 205 for the purpose of coupling to a cross-bar 208, which includes rollers 210*a*, 210*b* configured to translate or move along on the inside of the shafts 212*a*, 212*b*.

The bridge datum block 204 (FIGS. 38-39) is fixed and non-movable within the body 14 and serves as the surface against which the translating tail piece 202 is moved into direct or near abutment such that the strings 16 may be tuned into a playable condition. The bridge compression member 206 is coupled to a cross-bar 214 with rollers 216*a*, 216*b* configured to translate or move along on the outside of shafts 212*a*, 212*b*. The datum block 204 includes a rigid standoff extensions 207 integrally formed with the main body 209 of the datum block 204. The standoff extensions 207 are hollow and include an aperture dimensioned to pass a machine screw into the carriage 220 or, in the alternative, the plate 134 mounted within the back recess 64. In fact, it is contemplated that all the components of the translating bridge assembly 46 may be directly mounted to the plate 134, which may reduce weight and cost and simplify manufacture and assembly. The datum block 204 also includes an extension 211 equipped with an aperture 213 for rotatably coupling to the handle 48. The datum block 204 also includes apertures 215 for mounting to the carriage 220, but again it's contemplated that the datum block 204 could be mounted directly to the body 14 and/or the plate 134 without departing from the scope of the invention. The datum block 204 also includes apertures 217 for rotatably coupling to linkages, and lastly apertures 219 that extend through the standoff extensions 207.

Figure 70:
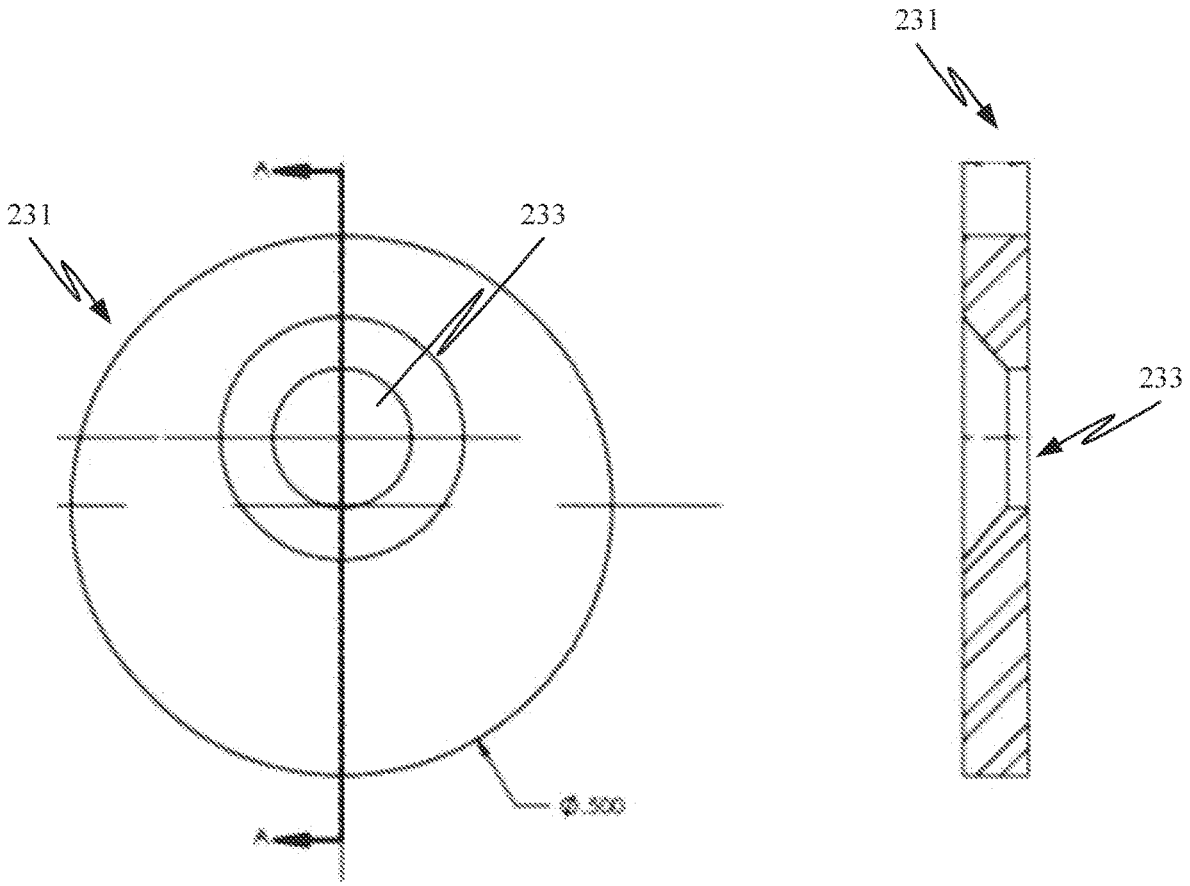
FIGS. 70 is an eccentric (asymmetrical) washer forming part of the actuation mechanism for a foldable fretted instrument according to aspects of the present invention.

The bridge datum block 204 also includes a threaded aperture 227 to receive an eccentric washer 231 as shown in FIG. 70. The eccentric washer 231 includes an aperture 233 that is off-axis or asymmetrically located relative to the central axis of the washer 231. In use, the eccentric washer 231 is affixed into threaded aperture 227, such as via a machine screw or the like. Based on the off-axis configuration, the eccentric washer 231 is capable of rotating in an asymmetrical manner about the machine screw. The purpose of the washer 231 is to allow a user or set-up technician to adjust the physical travel of the L-linkages 222 during the process of unlocking the actuation mechanism 200 for folding or preparing to re-actuate as shown in FIGS. 30-35. In other words, the eccentric washer 231 may be selectively positioned in order to physically abut and stop linkages 223 in order to stop any over-rotation, which may cause the linkages to hyper-extend and fail to re-actuate.

The bridge compression member 206 (FIG. 40-41) is rotatably coupled to distal ends of the L-arm linkages 222 and also to the proximal end of the elongated rod 150, which is in turn is coupled to the translating truss rod assembly 46 as will be described below. To do so, the compression member 206 includes apertures 221 to couple to the elongated rod 150 and apertures 223 to rotatably couple to the L-arm linkages 222. The L-arm linkages 222 pivot about the pins or posts extending through the apertures 221 such as shown in FIGS. 33-35. The compression member 206 also includes a pair of string apertures 225 through which the strings 16 pass at all times, that is, stringing, playing and folding the guitar 10.

Figure 69:
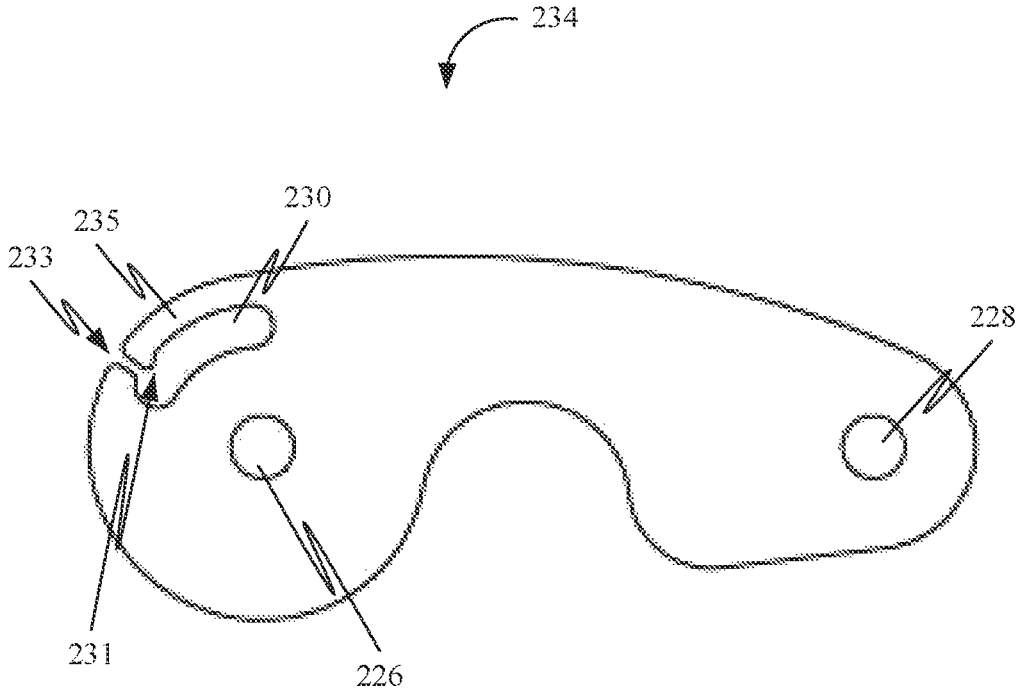
FIG. 69 is a side view of a curved linkage forming part of the actuation mechanism for a foldable fretted instrument according to aspects of the present invention.

The mechanism 200 associated with the translating bridge assembly 20 and translating truss assembly 46 includes a number of components, linkages, coupling mechanisms (e. nuts, bolts, washers, etc. . . . ). A pair of elongated L-shaped linkages 222 are at a distal end rotatably coupled to the cross-bar 214 and at a proximal end are rotatably coupled to a linkage 224, which in turn is rotatably coupled to a curved linkage 234 (FIG. 69). The curved linkage 234, in turn, is rotatably coupled to the handle 48. As best shown in FIG. 69, the curved linkages 234 include a first aperture 228 to rotatably couple to the short linkage 224, which are rotatably coupled to the L-shaped linkage 222. The curved linkages 234 include a second aperture 226, which are rotatably coupled to the handle 48. The handle 48 includes a pin (not shown) dimensioned to be received within a third aperture 230 of the curved linkage 234. In this manner, the handle 48 may be rotated partially from the locked position (facing rearwards within recess 50) towards the unlocked position without encountering any significant resistance so as to make it easy to remove the handle 48 from the recess 50.

The third aperture 230 includes a gap 233 that defines an arm 235 with a detent 231 on the distal end. The detent 231 and arm 235 cooperate with the pin of the handle 48 such that the pin will deform the arm 235 and the pin gets to the end of the length of aperture 230. This will provide a tactile feel for the user, as well as an audible snapping sound, which advantageously clearly denotes that the handle 48 has been extended into the fully locked position shown in FIGS. 3-5 or removed from the locked position to start the folding process as described above. Moreover, as best viewed in FIG. 33, the actuation mechanism 200 uses curved linkages 234 configured in this manner (that is, with detent 231, gap 233, arm 235 that cooperate with a pin on the handle 48), which provides this tactile and audible feedback it the handle 48 is in the fully locked and fully unlocked positions. This also advantageously maintains the handle 48 within the side recess 50 in both the playing and folded states.

When the pin (not shown) hits the end of the third aperture 230, it will then transmit the rotational force to the curved linkage 234 to drive it into rotation. This rotation will cause the linkage 224 to force the L-shaped linkages 222 into motion towards the end of the guitar 10 (opposite from the head 18), which in turn will cause the rolling cross-bar 214 and the accompanying bridge compression member 206 to move away from the translating tail piece 202 disposed on the rolling cross-bar 208. The removal of the bridge compression member 206 effectively unlocks the tail piece 202 from the locked position abutting or adjacent to the bridge datum block 204. This allows the tail piece 202 to move away from the datum block 204 via the rolling cross-bar 208 under the tension of the strings 16.

The strings 16 may travel in the range of approximately 1-2 inches during this initial detensioning process. One or more springs 198 are coupled to the floating tail piece 202 in order to dampen and control the degree of string detensioning, as well as provide modest tension on the strings 16 before, during and after the folding process in order to prevent the strings 16 from migrating vertically and/or laterally, which may otherwise allow the strings 16 to disassociate or disengage from the neck 12. The strings 16 may travel an additional distance during the folding process (that is, moving the upper neck portion 32 away from the playing position), in the range of between 1-2 inches.

As described above with reference to FIGS. 8-10, the strings 16 need to be routed from the back of the guitar 10, given that the translating tail piece 202 (which anchors the strings 16) is disposed within the recess 64 formed in the back of the body 14 of the guitar 10. To do so, the roller assembly 68 (FIGS. 17-18) is mounted on the plate 134 affixed within the recess 144 in the back recess 64 of the body 14. The roller assembly 68 includes a plurality of string rollers 106 (one for each string 16, for example 6 in the case of a 6-string guitar) rotatably disposed along the shaft 108 extending between the pair of mounting brackets 110 fixed to the plate 134 via machine screws threadedly engaged into bores 140 in the plate 134. The roller assembly 68 may be equipped with an optional backing plate 104 (FIG. 16) to help guide the strings 16 during the process of stringing the guitar, as well as maintain the strings 16 before, during and after the folding process such that the strings 16 don't migrate from their location within the roller assembly 68 and the respective position within each individual roller 106.

The shafts 212*a*, 212*b* may be coupled to a carriage 220 via a plurality of grommets 218. The grommets 218 are constructed from a rubber or polymer with sufficient flexibility, if employed, to allow the shafts 212 to float with six degrees of freedom relative to the carriage 220. This "intentional slop" will prevent the rollers 210, 216 from sticking or otherwise binding along the shafts 212 as may otherwise occur if the shafts 212 were immobilized and rigid relative to the carriage 220 or out of alignment.

Figure 42:
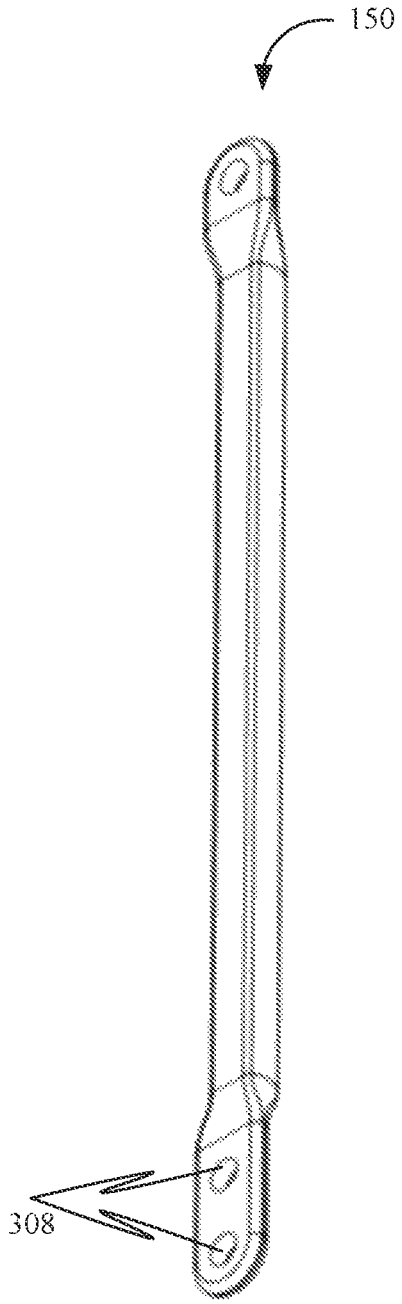
FIGS. 42-44 are perspective and top views of a translating truss rod assembly forming part of an actuation mechanism for a foldable fretted instrument according to an aspect of the present invention.
Figure 43:
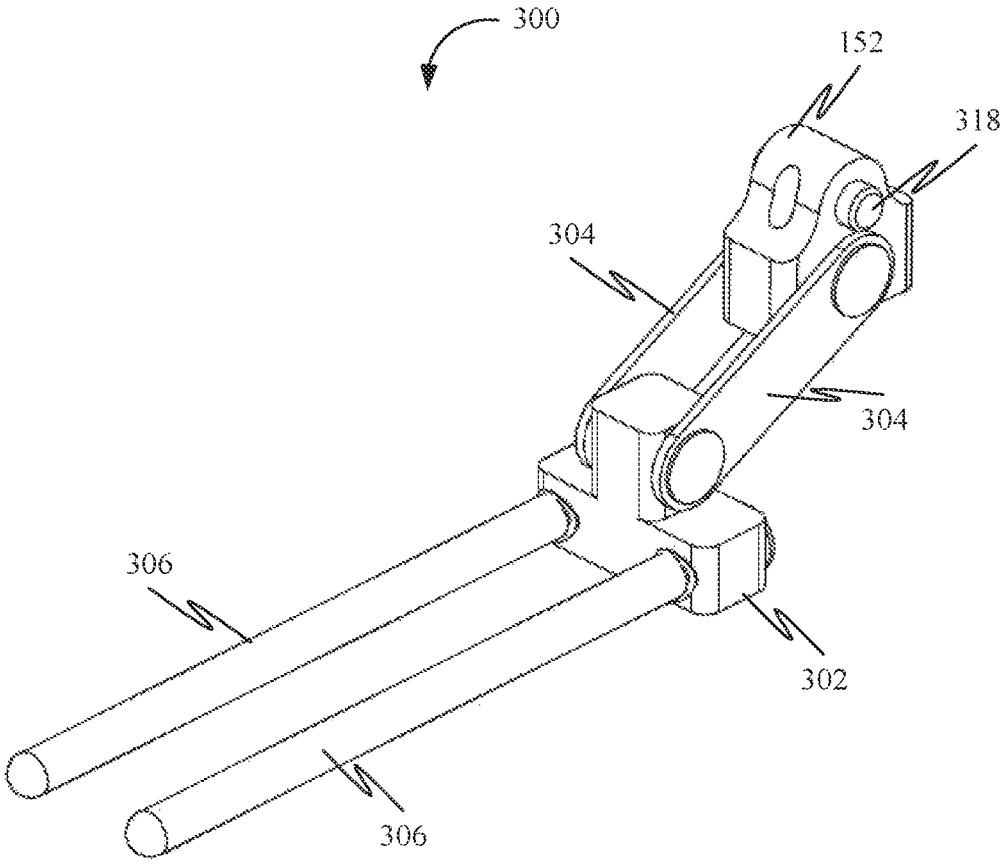

As shown in FIGS. 42-43, the translating truss assembly 46 includes an elongated rod 150 extending between a central extension member formed in the bridge compression member 106 and a dual truss rod assembly 300. The dual truss rod assembly 300 includes a coupler 152, a truss rod mounting block 302, links 304 rotatably interconnecting the coupler 152 and the truss rod mounting block 302, and two truss rods 306 extending longitudinally away from the mounting block 302. The coupler 152 is mounted to the end of the elongated rod 150 having dual apertures 308. More specifically, the underside of the coupler 152 is equipped with two threaded bores (not shown) that are dimensioned to threadedly receive machine screws to pass through the apertures 308 to secure the elongated rod 150 to the coupler 152. The truss rods 306 are dimensioned to extend entirely through the hinge assembly 36 when in the straight or playing configuration. When so extended, the hinge assembly 36 will be immobilized and locked such that the strings 16 may be tuned such that the guitar 10 may be played.

Figure 44:
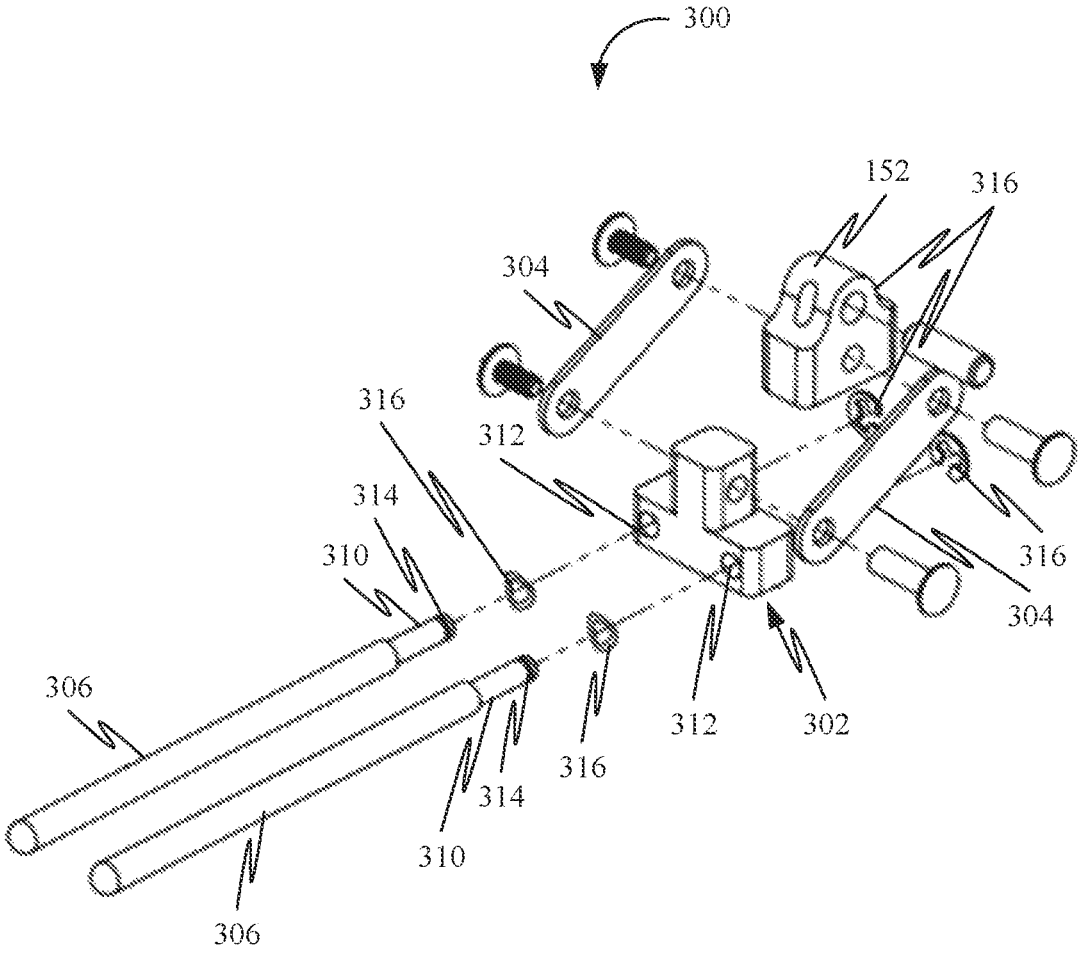

The truss rods 306 may be rigidly fixed to the mounting block 302 or equipped to float relative to the mounting block 302. By way of example only, with reference to FIG. 44, the desired float may be achieved by providing the proximal region 310 of each truss rod 306 with a reduced diameter relative to the diameter of the associated bore 312 of the coupler 152, as well as an annular recess 314. A wave washer 316 may be positioned over the proximal region 310 and an external clip ring 316 snapped into place within the annular recess 314. In so doing, the truss rods 306 will be able to shift modestly within the bore of the coupler 152 to allow the truss rods 306 to more easily advance into the bores in the hinge assembly 36.

Figure 45:
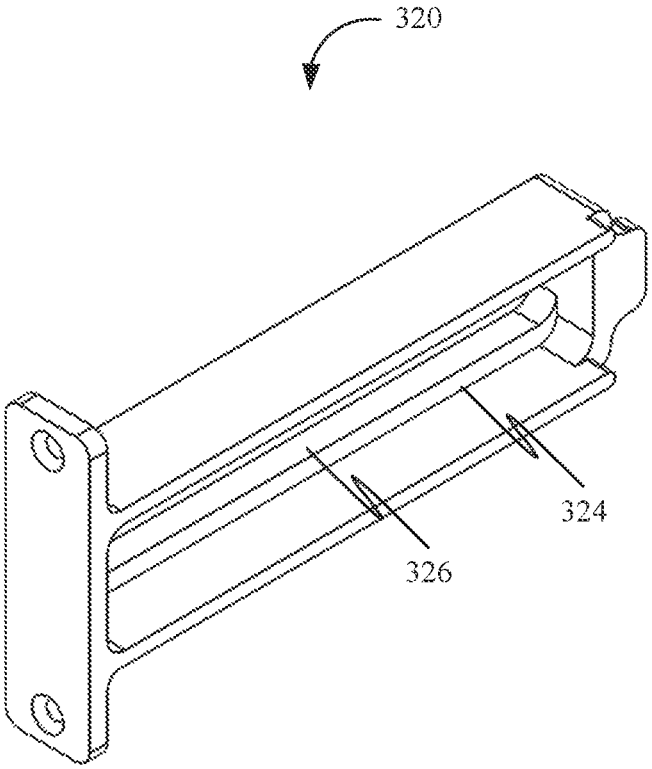
FIGS. 45-46 are perspective views of a coupler guide of a translating truss rod assembly forming part of an actuation mechanism for a foldable fretted instrument according to an aspect of the present invention.
Figure 46:
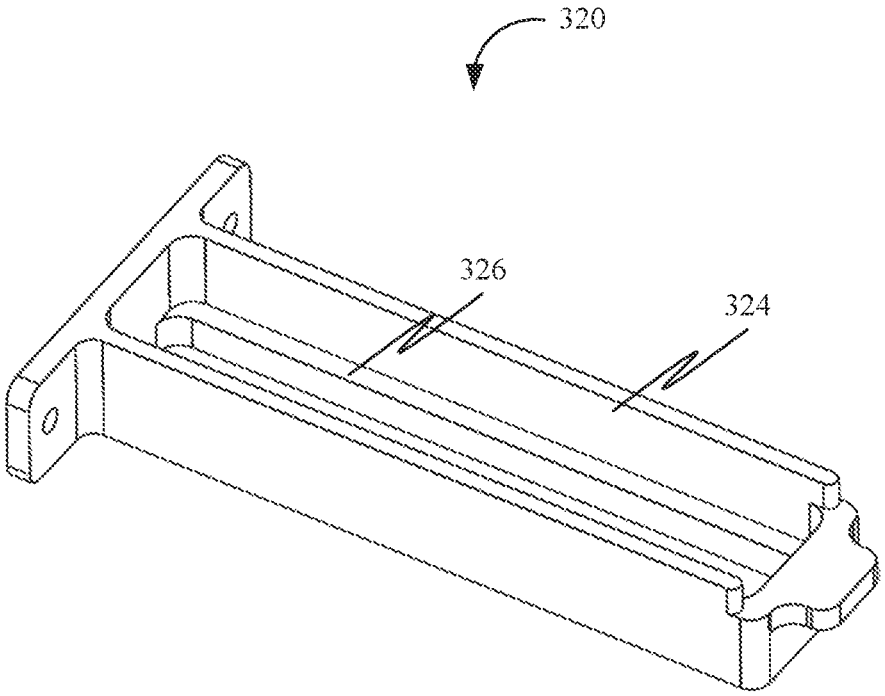
Figure 47:
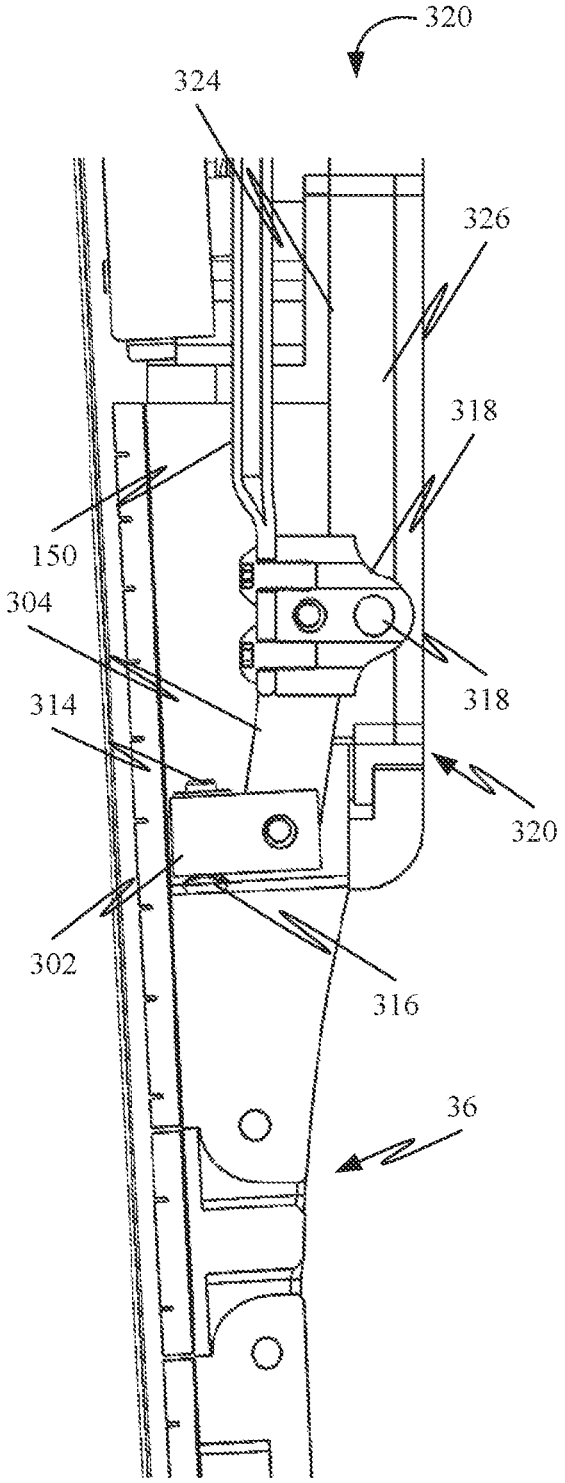
FIG. 47 is a partial cross-sectional side view of a translating truss assembly in use with the coupler guide of FIGS. 45-46 according to aspects of the present invention.

The coupler 152 also includes a post 318 designed to slide within a coupler guide 320 (FIGS. 45-46) mounted within a channel 322 (FIG. 23) formed in the back of the body 14. The coupler guide 320 is shown installed in the body 14 in FIGS. 4 and 47. The coupler guide 320 includes a recess 324 with a pair of parallel slide surfaces 326 having a gap therebetween that is greater than the width of the coupler 152 and less than the length of the post 318. In other words, the post 318 of the coupler 152 rides on the slide surfaces 324 and the coupler 152 translates freely within the gap when the translating truss assembly 46 is moved back and forth in use. In this manner, the coupler guide 320 and post 318 cooperate to provide vertical constraint and horizontal application of force without impeding the motion. This ensures the dual truss rods 306 are advanced in a linear manner into the bores formed within the hinge assembly 36.

Figure 48:
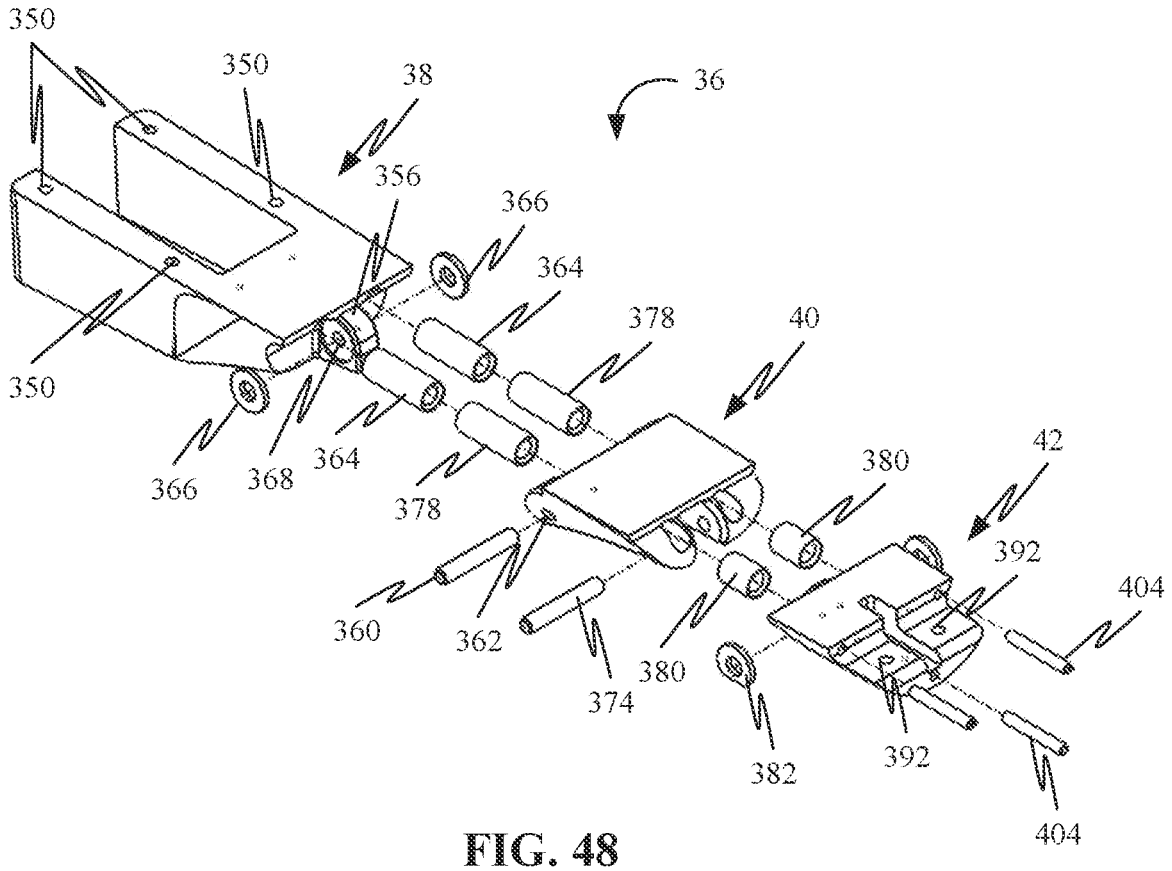
FIG. 48 is an exploded perspective view of hinge assembly forming part of a folding mechanism for a foldable fretted instrument according to aspects of the present invention.
Figure 49:
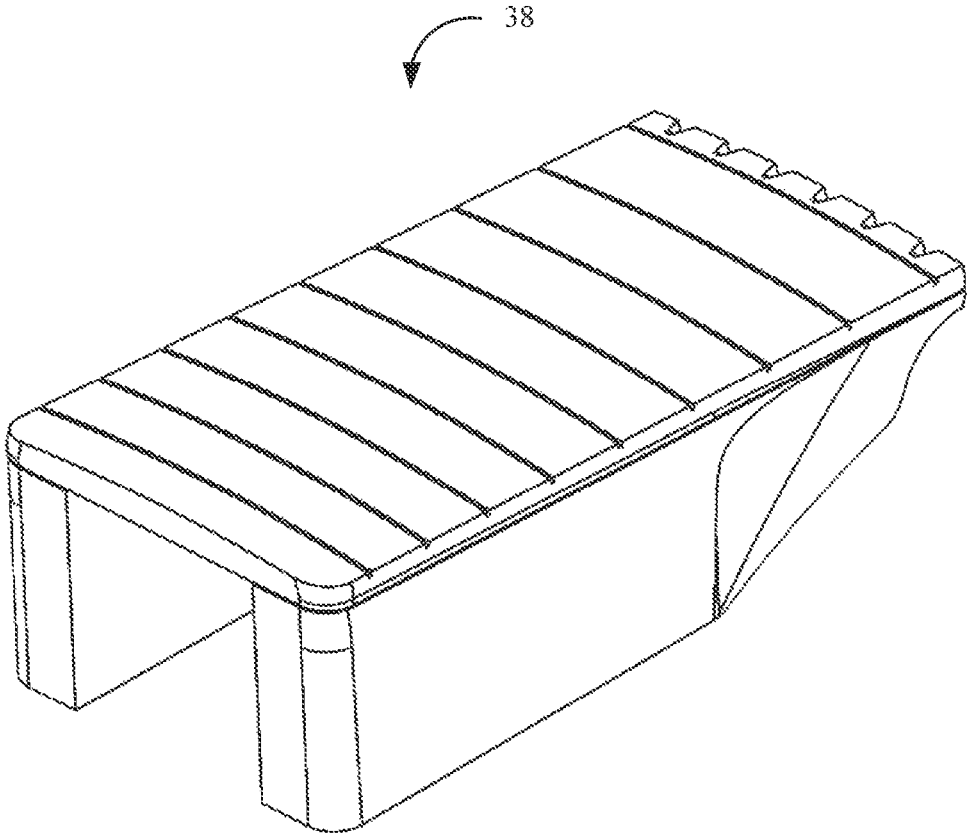
FIGS. 49-52 are various views of a hinge base forming part of a hinge assembly of a folding mechanism for a foldable fretted instrument according to aspects of the present invention.
Figure 50:
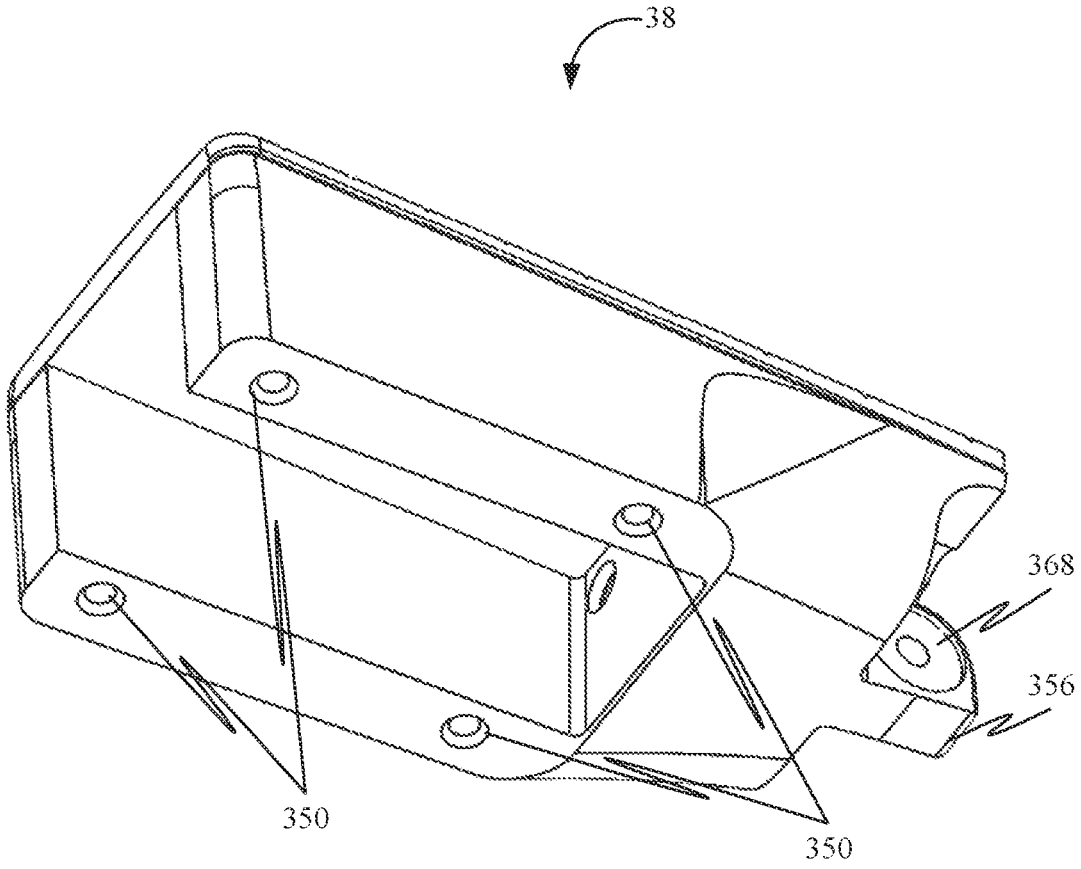
Figure 51:
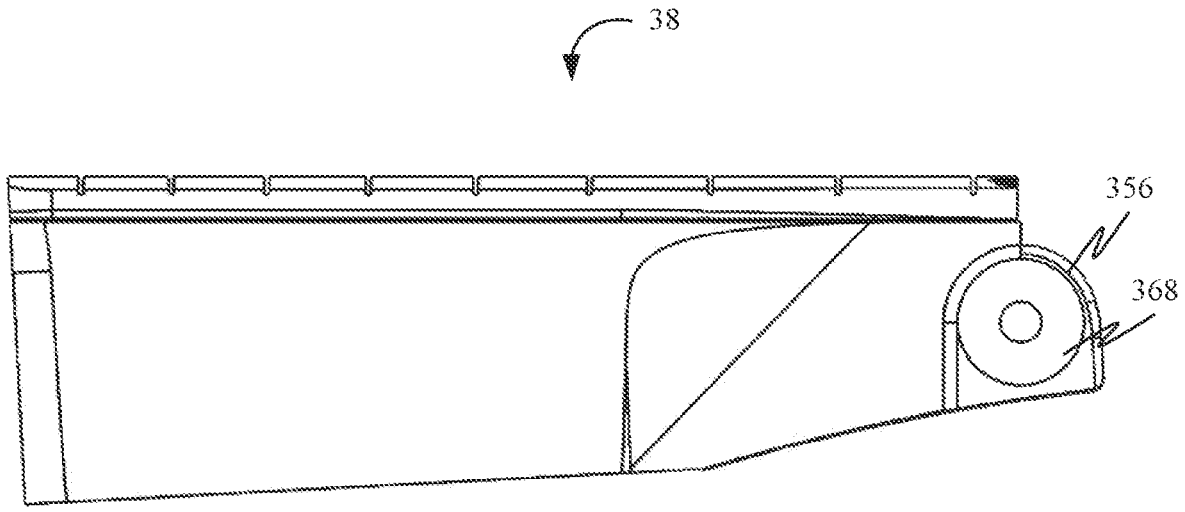
Figure 52:
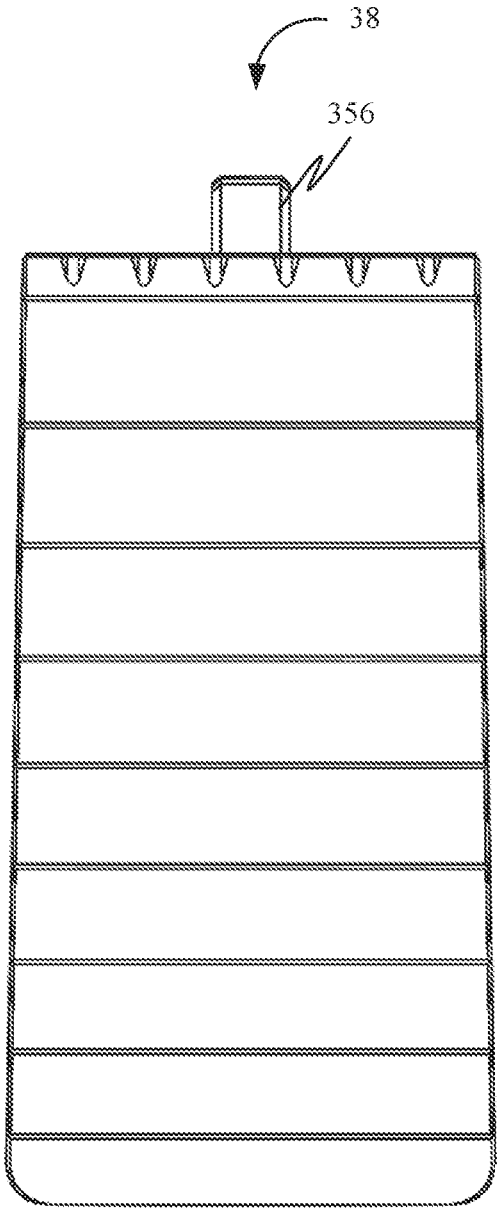
Figure 53:
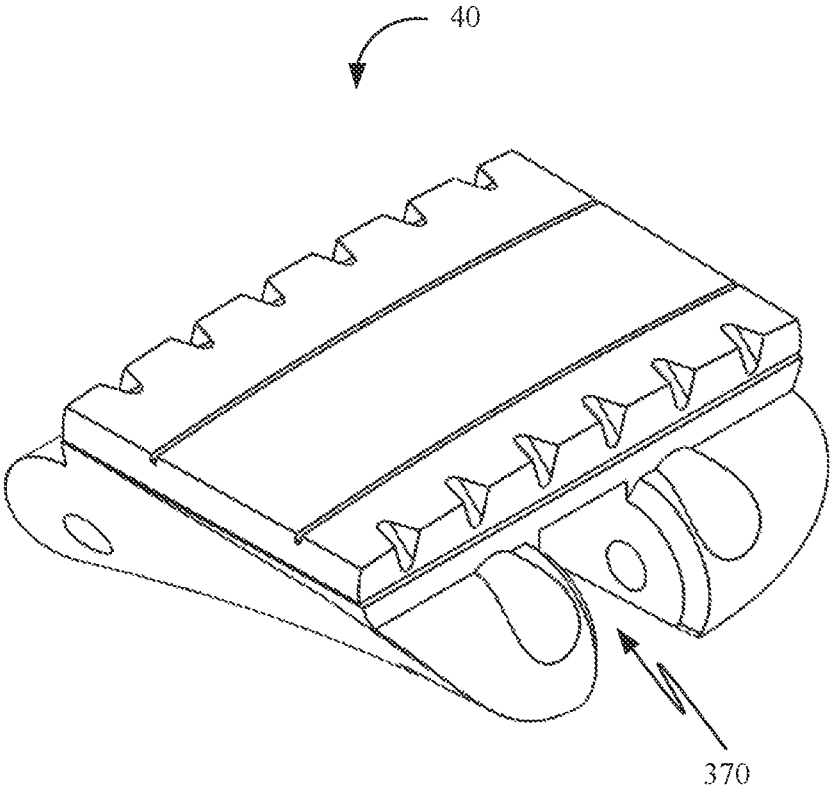
FIGS. 53-56 are various views of a middle hinge member forming part of a hinge assembly of a folding mechanism for a foldable fretted instrument according to aspects of the present invention.
Figure 54:
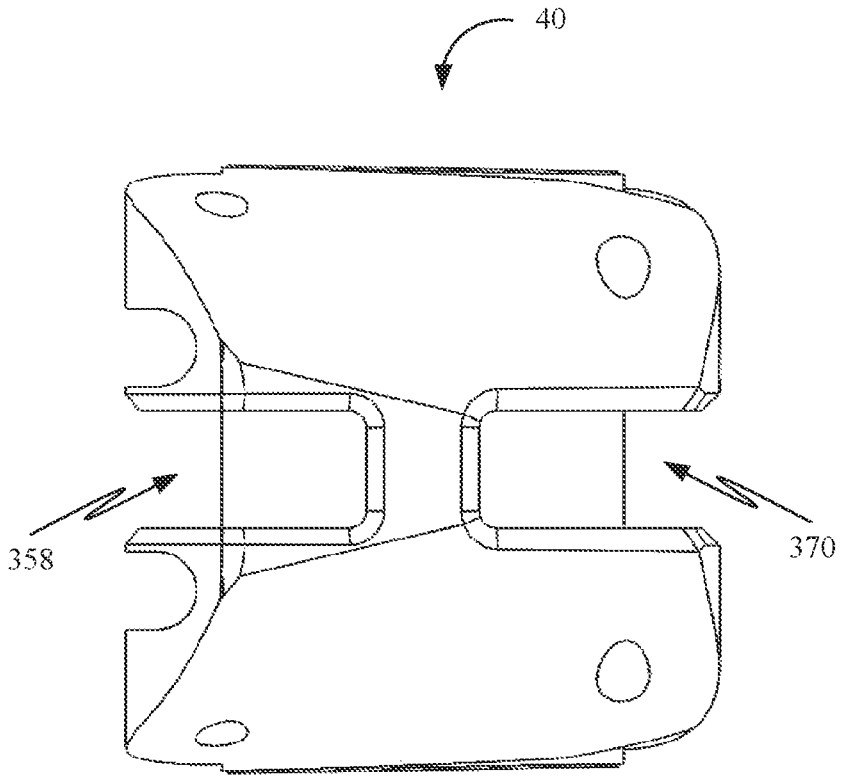
Figure 55:
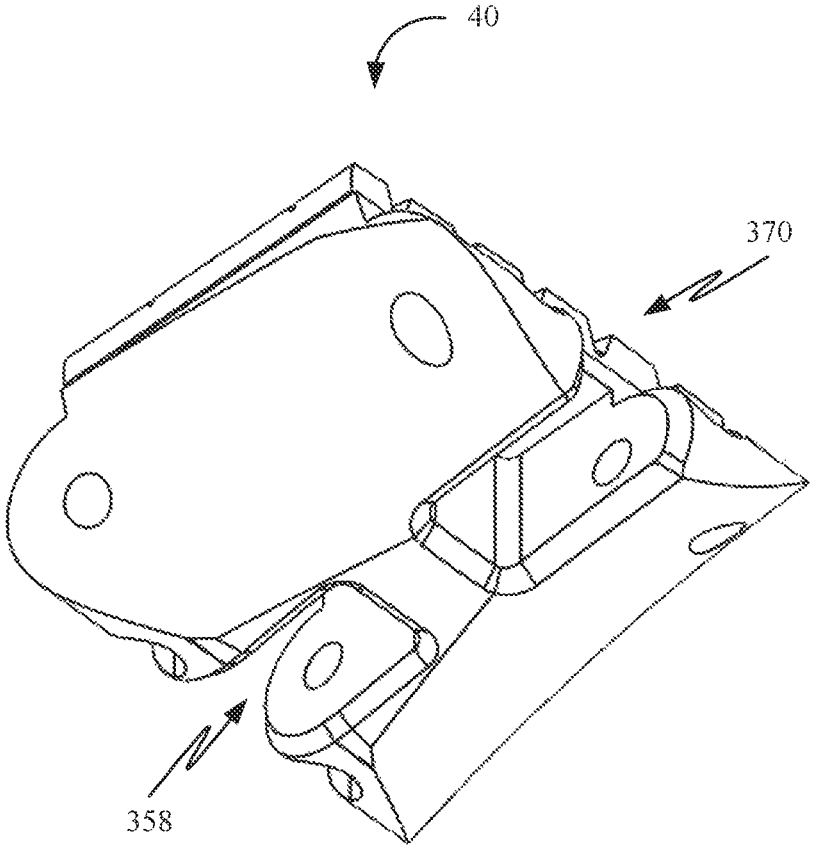
Figure 56:
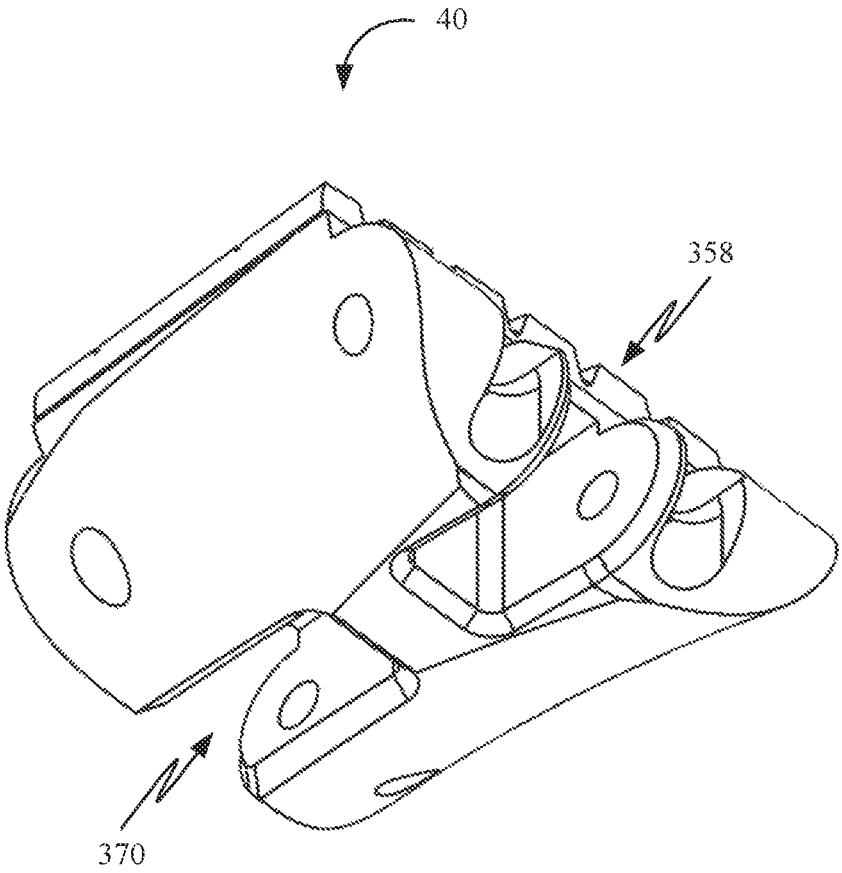
Figure 57:
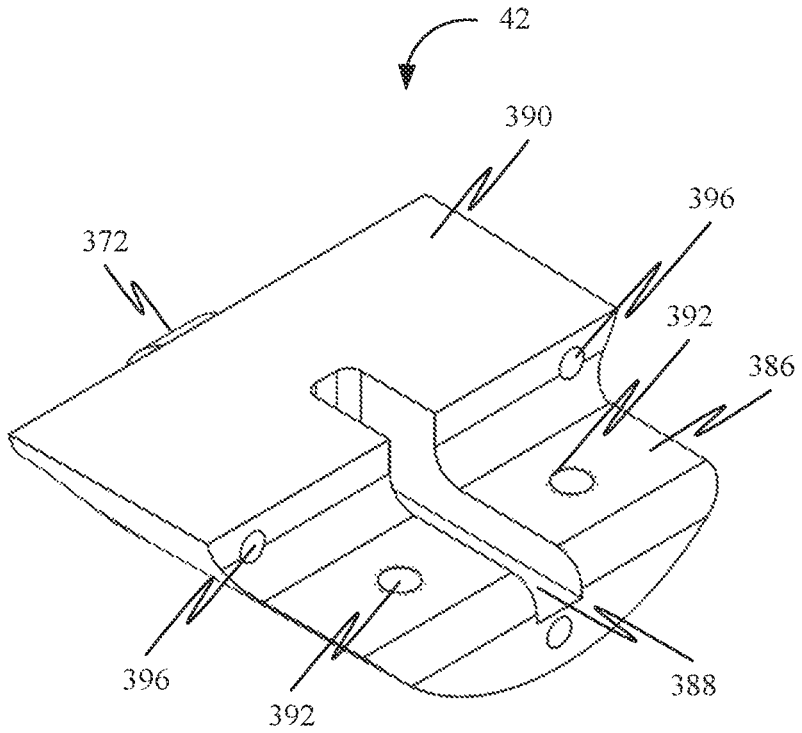
FIGS. 57-60 are various views of an upper hinge member forming part of a hinge assembly of a folding mechanism for a foldable fretted instrument according to aspects of the present invention.
Figure 58:
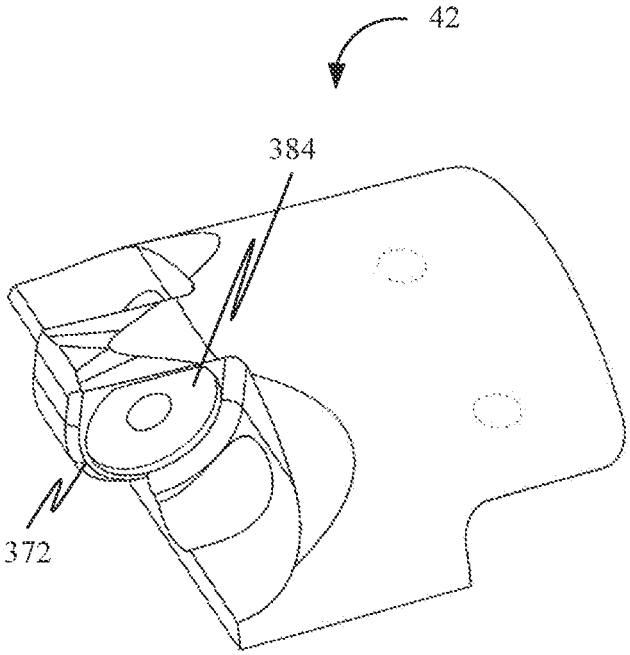
Figure 59:
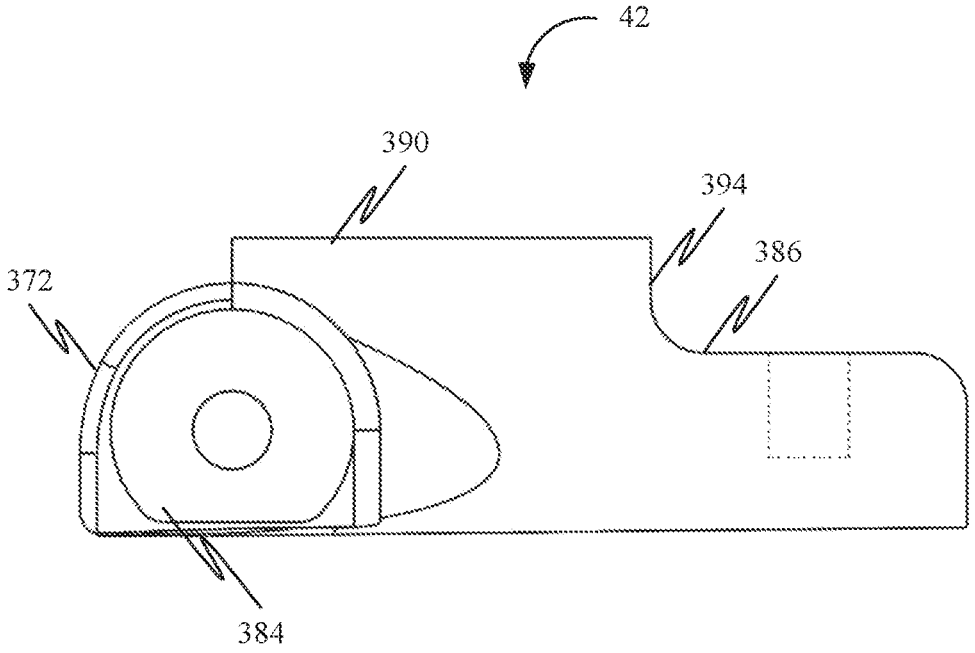
Figure 60:
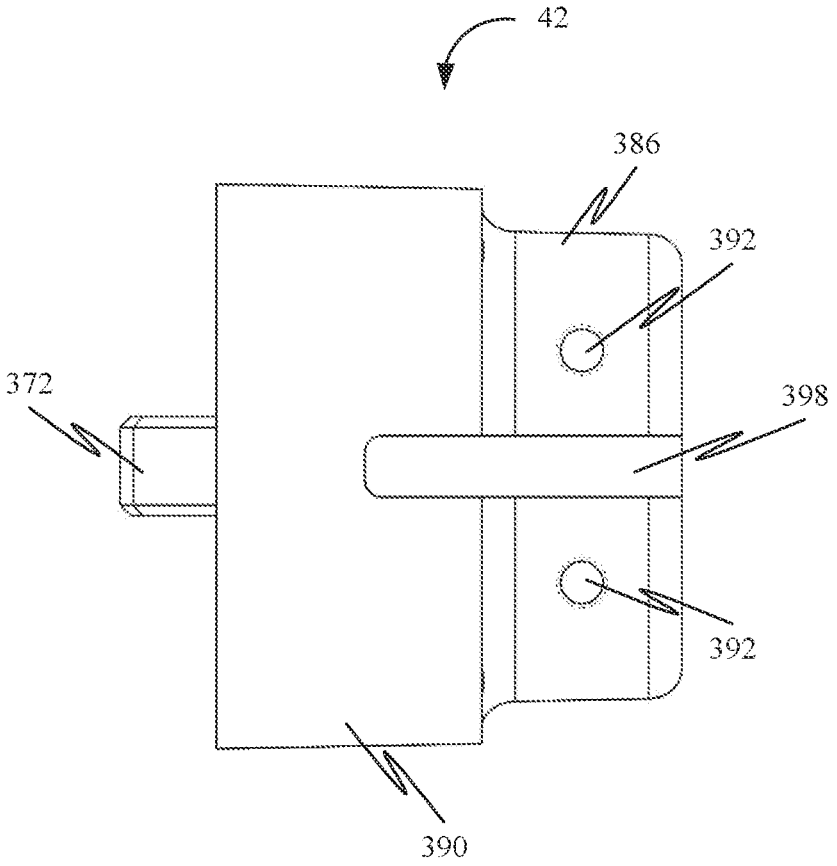
Figure 61:
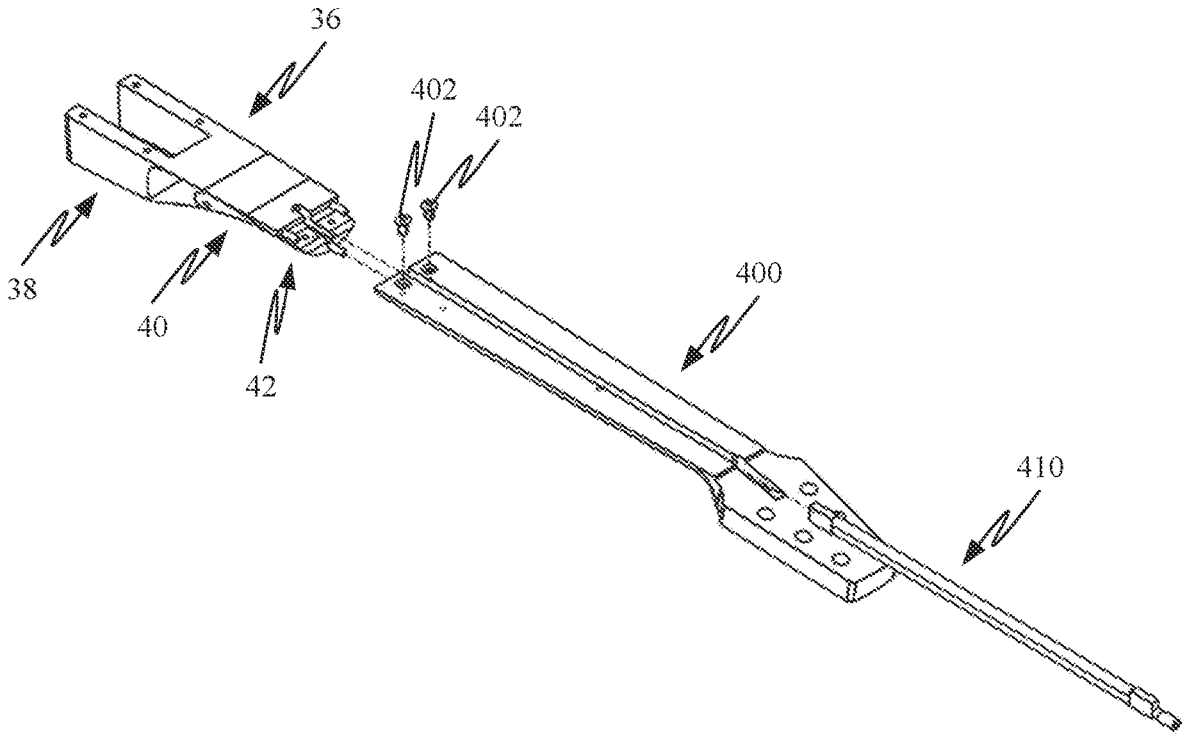
FIG. 61 is an exploded perspective view of the hinge assembly and neck sub-assembly in a straight configuration according to aspects of the present invention.

The hinge assembly 36 will now be described with reference to FIGS. 48-50, wherein FIG. 48 is an exploded view of the hinge assembly 36, FIGS. 49-52 detail the hinge base 38, FIGS. 53-56 detail the middle hinge 40, and FIGS. 57-60 detail the upper hinge 42. The hinge assembly 36 includes the hinge base 38, middle hinge 33, and upper hinge 42. The hinge assembly 36 may be constructed from any number of suitable materials, including but not limited to metal (e.g. aluminum), carbon-fiber, plastic, etc. . . . manufactured via any suitable techniques, including but not limited to machining, molding, 3D printing, etc. . . . .

The hinge base 38 includes multiple threaded bores 350 in the upper surface, which are dimensioned to receive machine screws (through apertures 352 in FIG. 23) for the purpose of mounting the hinge base 38 within the neck recess 354 (FIG. 22) after the neck 12 has been fully assembled. The hinge base 38 also includes a coupling extension 356 for rotatably coupling within a proximal recess 358 in the middle hinge 40 via a first pin 360 that extends through a bore 362 that passes perpendicularly through the first recess 358 when aligned with the coupling extension 356. The hinge base 38 also includes two elongated bores (not shown) dimensioned to receive sleeve bearings 364, which are in turn dimensioned to slidably receive the truss rods 306 to lock and unlock the hinge assembly 36 during use. To facilitate the rotation between the hinge base 38 and middle hinge 40, a nylon or Teflon-impregnated washer 366 may be placed within recesses 368 formed on either side of the coupling extension 356.

The middle hinge 40 includes the proximal recess 358 and a distal recess 370. The proximal recess 358 is dimensioned to rotatably engage to the coupling extension 356 of the hinge base 38 via the first pin 360 that extends through bore 362 that passes perpendicularly through the proximal recess 358 when aligned with the coupling extension 356 of the hinge base 38. The distal recess 370 is dimensioned to rotatably couple to the coupling extension 372 of the upper hinge 42 via a second pin 374 that extends through a bore 376 that passes perpendicularly through the distal recess 370 when aligned with the coupling extension 372 of the upper hinge 42. The middle hinge 40 has two elongated bores dimensioned to receive sleeve bearings 378, which are in turn dimensioned to slidably receive the truss rods 306 to lock and unlock the hinge assembly 36 during use. The upper hinge 42 has two bores (shorter than those of hinge base 33 and middle hinge 40) dimensioned to receive sleeve bearings 380, which are in turn dimensioned to slidably receive the truss rods 306 to lock and unlock the hinge assembly 36 during use. To facilitate the rotation between the hinge middle 40 and upper hinge 42, a nylon or Teflon-impregnated washer 382 may be placed within recesses 384 formed on either side of the coupling extension 372 of the upper hinge 42.

The upper hinge 42 includes the coupling extension 372, a stepped surface 386, and a midline recess 388. The coupling extension 372 operates to rotatably engage within the distal recess 370 of the middle hinge 40, as explained above. The stepped surface 386 is parallel to but spaced down from the upper surface 390 and includes two threaded bores 392. The vertical surface 394 includes an additional two bores 396. With combined reference to FIGS. 57-61, the upper hinge 42 is dimensioned to be affixed to a neck sub-assembly 400 via the insertion of machine screws 402 into through the threaded bores 392 in the stepped surface 386. To help bolster the rigidity of this union, dowel pins 404 may also be used extending from the horizontal bores and onward into corresponding bores formed in the abutting surface of the neck sub-assembly 400, as well as glue or other adhesive on the abutting surfaces. The midline recess 388 is dimensioned to receive the end of an adjustable truss rod 306 of standard construction, which may be operated to alter the curvature or alignment of the upper neck portion 32 through the rotation of a bolt element 212 located adjacent to the head 18 of the neck 12.

Figure 62:
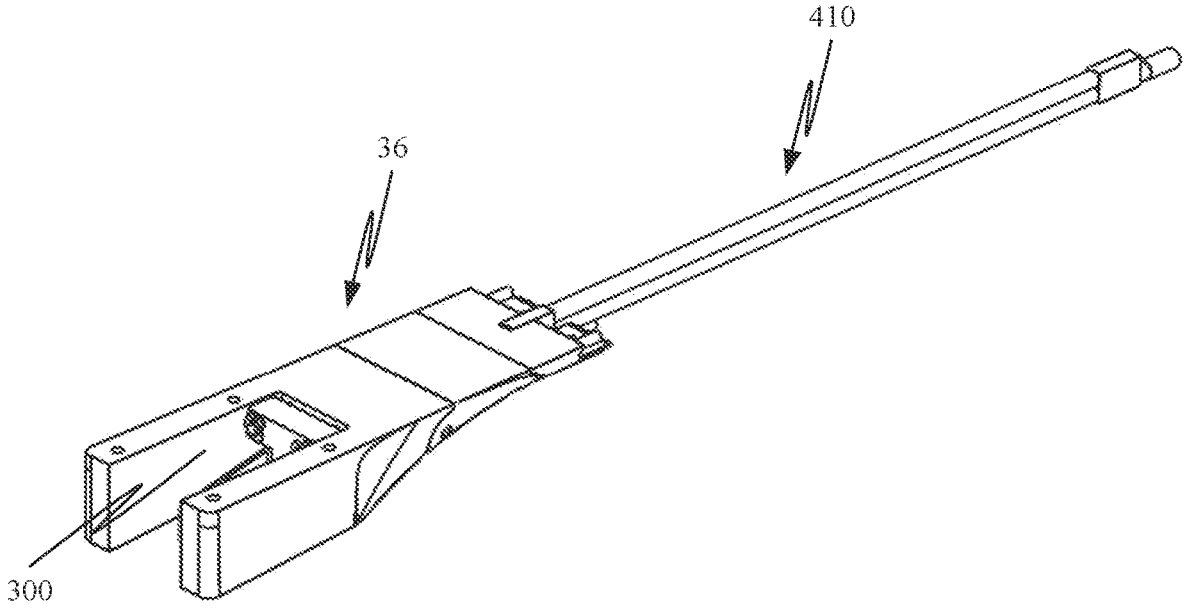
FIGS. 62-63 are top and bottom perspective views, respectively, of the hinge assembly, static (traditional) truss rod, and translating truss assembly in a straight configuration according to aspects of the present invention.
Figure 63:
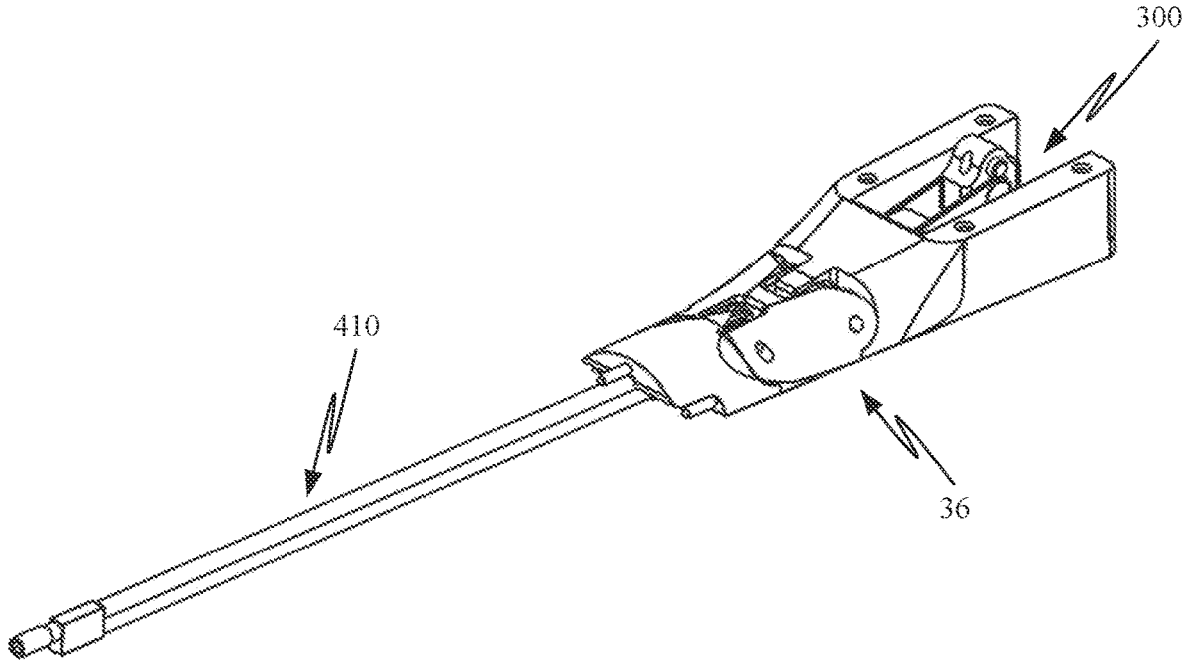
Figure 64:
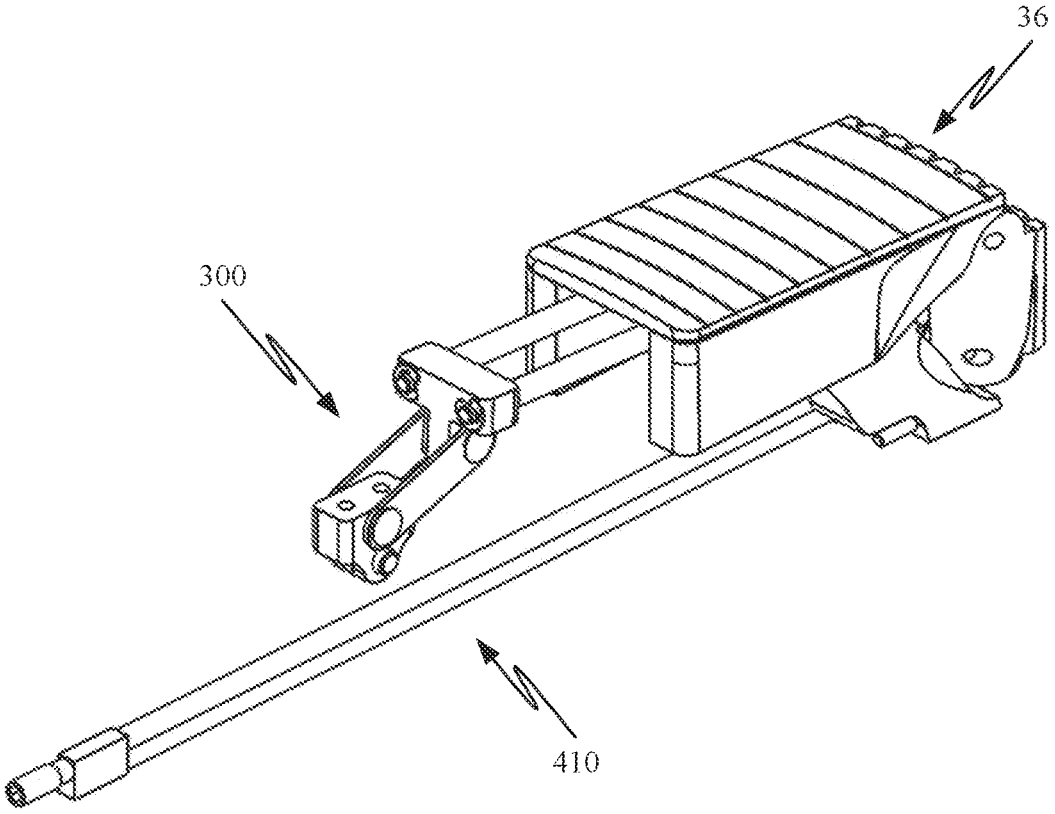
FIGS. 64-65 are top and bottom perspective views, respectively, of the hinge assembly, static (traditional) truss rod, and translating truss assembly in a folded configuration according to aspects of the present invention.
Figure 65:
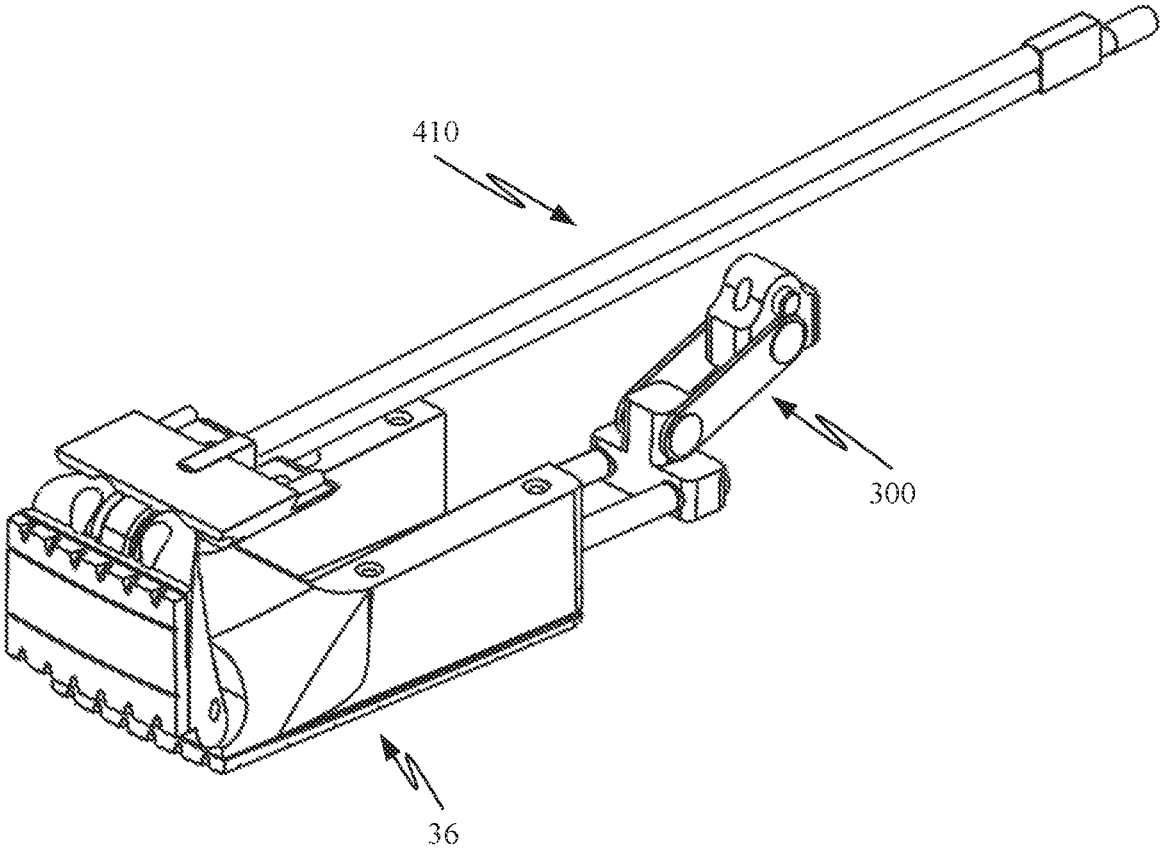

FIGS. 62-64 show the locking and unlocking interaction between the hinge assembly 36 and truss rod assembly 300. In FIGS. 62-63, the truss rod assembly 300 is advanced fully into the hinge base 38 such that the mounting block 302 is abutting or adjacent to the end wall of the hinge base 38. In this state, the truss rods 306 will be advanced fully through the hinge assembly 36 and, in one exemplary embodiment, through the sleeve bearings 364, 378, 380 within the hinge base 38, hinge middle 40, and upper hinge 42, respectively. To accomplish this in use, the handle 48 and actuation mechanism 200 will be in the state shown in FIGS. 26-29, which causes the elongated rod 150 (mounted to the coupler 152) to push the truss rod assembly 300 such that the truss rods 306 extend through the hinge assembly 36. In FIGS.

64-65, the truss assembly 300 is translated (moved) away from the end wall of the hinge base 38 until the truss rods 306 are removed from the hinge assembly 36. To accomplish this in use, the handle 48 and actuation mechanism 200 will be in the state shown in FIGS. 30-32, which causes the elongate rod 150 (mounted to the coupler 152) to pull the truss rod assembly 300 away from the end wall of the hinge base 38 such that the truss rods 306 are fully removed from the hinge assembly 36.

Figure 66:
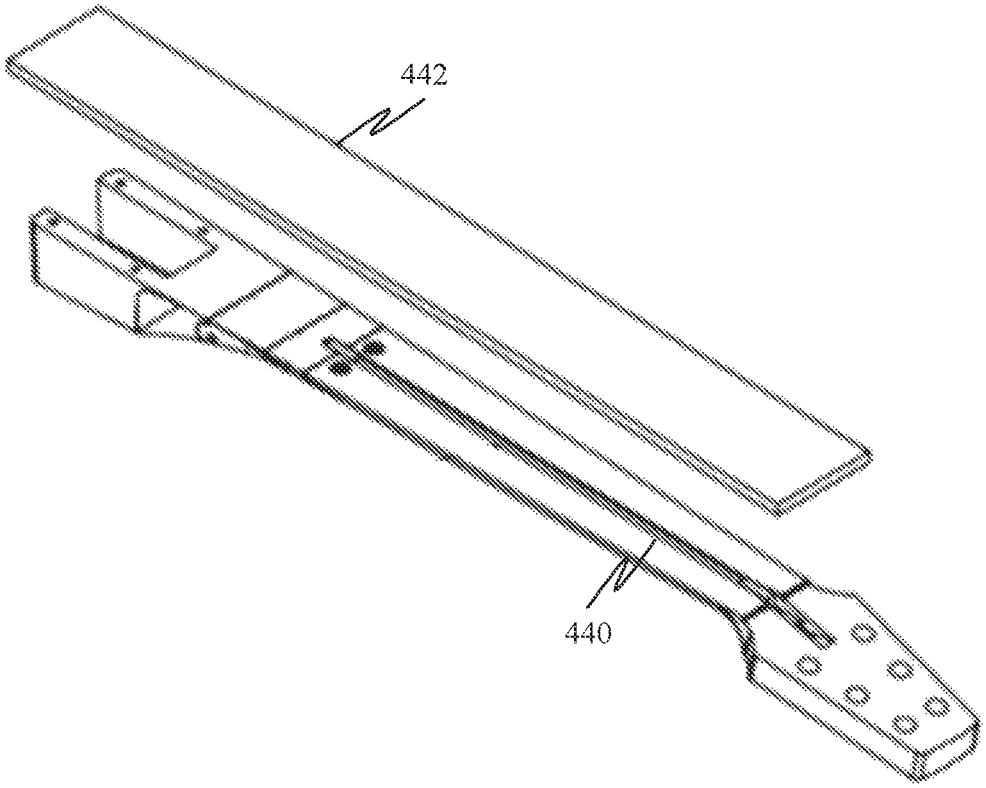
FIGS. 66-68 are perspective views of the neck during stages of manufacture according to aspects of the present invention.
Figure 67:
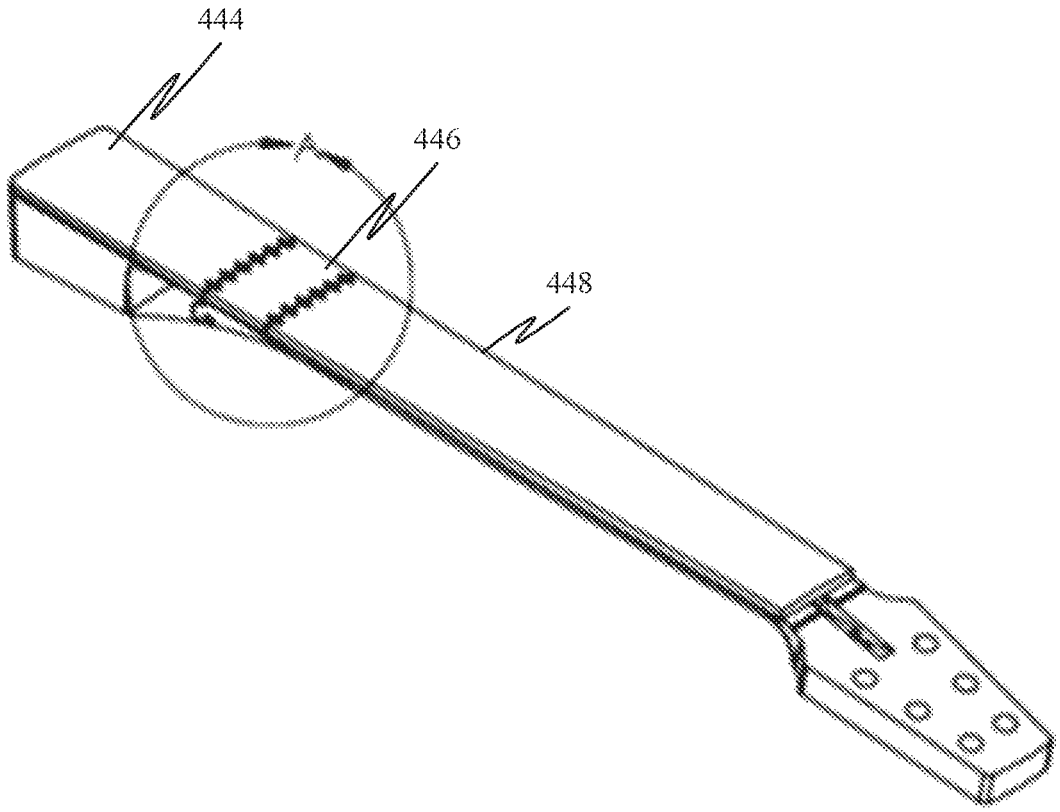
Figure 68:
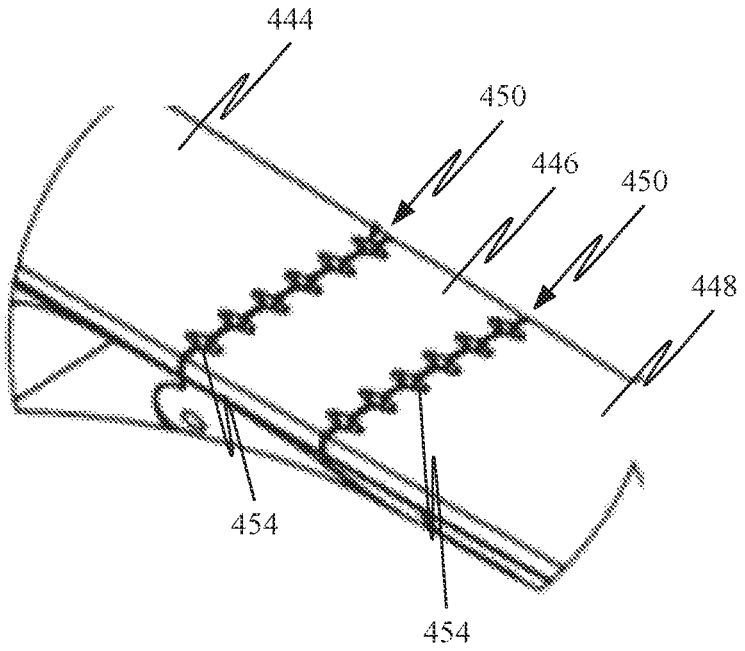

As shown in FIG. 66-68, after the hinge assembly 36 is assembled and the adjustable truss rod 410 positioned within an upper channel 440 in the neck sub-assembly 400, the fret board 442 may be glued to the upper surfaces of the neck sub-assembly 400, hinge base 38, middle hinge 40, and upper hinge 42 (FIG. 66). Thereafter, the fret board 442 may be machined in order to create lower, middle, and upper fret board sections 444, 446, 448, respectively, which define a proximal joint 450 and a distal joint 452 in the fret board 442 (FIG. 67). Lastly, as shown in FIG. 68, the proximal and distal joints 450, 452 are machined in the area of each guitar string path in order to create generally "V-shaped" cut-out regions 454 spanning the proximal and distal fret board joints 450, 452. As best shown in FIGS. 8-9, the cut-out regions, when separated due to folding the guitar 10, are dimensioned to receive the strings 16 to prevent or minimize the unwanted migration of the strings 16 while the guitar 10 is in the folded state. Again, the strings 16 will be under modest tension due to the release of the floating bridge assembly 20 before folding can begin. With the strings 16 coupled to the tail piece 202, and the tail piece 202 under modest tension (1-5 pounds) from the pair of springs 198 extending between the tail piece 202 and the datum block 204, the strings 16 will gently "follow the fold" and stay in place within the cut-out regions 454 for elegant string management.

The operation of the translating bridge assembly 20 is staggered in time relative to the operation of the translating truss assembly 46 such that the strings 16 are detensioned by the translating bridge assembly 20 before the translating truss assembly 46 operates to unlock the hinge assembly 36 of the neck 12. More specifically, when the handle 48 is actuated from the fully locked position shown in FIGS. 26-29 to the unlocked position (nested within the upper region of the recess 50), the floating tailpiece within the translating bridge assembly 20 moves away from the head 18 of the neck 12 such that the strings 16 transition from a tuned state (with forces of up to 150 pounds on the strings 16) to a detensioned state.

In the detensioned state, the primary force acting upon the strings 16 is from one or more springs forming part of the translating bridge assembly 20, which are configured to exert only modest forces (e.g. 1 to 5 pounds, with 3 pounds being preferable) on the strings 16. A variety of friction-reducing techniques are employed to minimize or eliminate friction along the string path (shown in dotted lines in FIGS. 8-10), which is why the primary force acting upon the strings 16 in the folded confirmation is that of the springs 16.

Any of the features or attributes of the above the above described embodiments and variations can be used in combination with any of the other features and attributes of the above described embodiments and variations as desired.

The travel guitars set forth herein overcome or at least improve upon the disadvantages of the prior art by providing a reduced profile for ease of travel and predictable tuning and quality guitar play. Moreover, by using commercially available a computer tablet and/or smart phone, the effective cost of the travel guitar is reduced to the user because those devices are available for other uses.

From the foregoing disclosure and detailed description of certain preferred embodiments, it is also apparent that various modifications, additions and other alternative embodiments are possible without departing from the true scope and spirit. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

The invention claimed is:

1. A foldable stringed instrument, comprising:

a body assembly including a bridge, a string roller assembly, and a translating tail piece all mounted to a body, wherein said translating tail piece is dimensioned to engage a plurality of strings; and a neck assembly having a hinge assembly, a neck coupled to said hinge assembly having a plurality of tuning machines dimensioned to engage said plurality of strings, and a multi-part fingerboard mounted to said neck and said hinge assembly;

wherein said hinge assembly includes a base section, an upper section, and a middle section hingedly coupled to said base section and said upper section so as to enable said neck assembly to be selectively straightened and folded.

2. The foldable stringed instrument of claim 1, wherein said body includes an upper surface, a lower surface, and a recess formed in said lower surface, wherein said bridge is mounted to said upper surface, and wherein said string roller assembly and said translating tail piece are mounted within said recess formed in said lower surface.

3. The foldable stringed instrument of claim 1, wherein said translating tail piece is operable to be selectively moved along a longitudinal axis of said body in a first direction to tension said strings while said neck assembly is straightened and a second direction opposite to said first direction to detension said strings to enable folding said neck assembly.

4. The foldable stringed instrument of claim 1, wherein said base section, said middle section, and said upper section of said hinge assembly each has a generally flat upper surface and a curved lower surface, wherein said generally flat upper surfaces are dimensioned to be generally co-aligned when said neck assembly is straightened.

5. The foldable stringed instrument of claim 1, wherein said hinge assembly enables said neck to be folded approximately 180 degrees relative to said body.

6. The foldable stringed instrument of claim 1, wherein said translating tail piece is movable relative to a longitudinal axis of said body along at least one elongated member positioned along said longitudinal axis of said body.

7. The foldable stringed instrument of claim 1, further comprising at least one locking element dimensioned to lock said hinge assembly when said neck assembly is straightened and to unlock said hinge assembly to enable folding said neck assembly.

8. The foldable stringed instrument of claim 1, further including a lever configured to selectively lock and unlock said translating tail piece, wherein when locked said translating tail piece applies tension to said strings for playing, and wherein when unlocked said translating tail piece removes tension from said strings to enable folding said neck assembly.

9. The foldable stringed instrument of claim 1, further including a mounting plate disposed within a recess formed within said body, said mounting plate dimensioned to mount said siring roller assembly and said translating tail piece to said body.

10. The foldable stringed instrument of claim 1, wherein said body and said neck assembly combine to comprise at least one of an electric guitar, an acoustic guitar, a bass guitar, and a ukulele.

11. A foldable stringed instrument, comprising:

a neck assembly having a hinge assembly, a neck coupled to said hinge assembly, and a multi-part fingerboard mounted to said neck and said hinge assembly, wherein said hinge assembly includes a base section, an upper section, and a middle section hingedly coupled to said base section and said upper section so as to enable said neck assembly to be selectively straightened and folded;

a nut positioned at a first location relative to said multi-part fingerboard, said nut dimensioned to hold a plurality of strings a distance off said multi-part fingerboard when said neck assembly is straightened;

a bridge positioned at a second location relative to said multi-part fingerboard, said bridge dimensioned to hold said plurality of strings a distance off said multi-part fingerboard when said neck assembly is straightened; and a translating tail piece dimensioned to be selectively moved in a first direction to tension said plurality of strings when said neck assembly is straightened and selectively moved in a second direction opposite said first direction to detension said plurality of strings to enable folding said neck assembly.

12. The foldable stringed instrument of claim 11, wherein said base section, said middle section, and said upper section of said hinge assembly each has a generally flat upper surface and a curved lower surface, wherein said generally flat upper surfaces are dimensioned to be generally co-aligned when said neck assembly is straightened.

13. The foldable stringed instrument of claim 11, wherein said base section of said hinge assembly is operable to be folded approximately 180 degrees relative to said upper section of said hinge assembly.

14. The foldable stringed instrument of claim 11, wherein said translating tail piece is movable in said first direction and said second direction along at least one elongated member.

15. The foldable stringed instrument of claim 11, further comprising at least one locking element dimensioned to lock said hinge assembly when said neck assembly is straightened and to unlock said hinge assembly to enable folding said neck assembly.

16. The foldable stringed instrument of claim 11, further comprising a lever configured to selectively lock and unlock said translating tail piece, wherein when locked said translating tail piece applies tension to said strings for playing, and wherein when unlocked said translating tail piece removes tension from said strings to enable folding said neck assembly.

17. The foldable stringed instrument of claim 11, further comprising a body coupled to said neck assembly.

18. The foldable stringed instrument of claim 17, wherein said body and said neck assembly combine to comprise at least one of an electric guitar, an acoustic guitar, a bass guitar, and a ukulele.

19. A foldable stringed instrument, comprising:

a neck assembly having a hinge assembly, a neck coupled to said hinge assembly, and a multi-part fingerboard mounted to said neck and said hinge assembly, wherein said hinge assembly includes a base section, an upper section, and a middle section hingedly coupled to said base section and said upper section so as to enable said neck assembly to be selectively straightened and folded.

20. The foldable stringed instrument of claim 19, further comprising:

a translating tail piece dimensioned to be selectively moved in a first direction to tension a plurality of strings extending between a nut and a bridge when said neck assembly is straightened and selectively moved in a second direction opposite said first direction to detension said plurality of strings to enable folding said neck assembly.

* * * * *